US008803767B2

(12) United States Patent
Phan et al.

(10) Patent No.: US 8,803,767 B2
(45) Date of Patent: Aug. 12, 2014

(54) IMAGE DEVICE WITH PIXELS ARRANGED FOR WHITE BALANCE

(75) Inventors: Gia Chuong Phan, Hong Kong (CN); Hon Wah Wong, Hong Kong (CN)

(73) Assignee: VP Assets Limited, Tortola (VG)

( * ) Notice: Subject to any disclaimer, the term of this patent is extended or adjusted under 35 U.S.C. 154(b) by 62 days.

(21) Appl. No.: 13/526,159

(22) Filed: Jun. 18, 2012

(65) Prior Publication Data

US 2012/0313842 A1 Dec. 13, 2012

Related U.S. Application Data

(63) Continuation-in-part of application No. 12/906,619, filed on Oct. 18, 2010.

(51) Int. Cl.
*G09G 3/20* (2006.01)

(52) U.S. Cl.
USPC ..... 345/55

(58) Field of Classification Search
USPC ..... 345/76–101, 204–211, 55
See application file for complete search history.

(56) References Cited

U.S. PATENT DOCUMENTS

| | | | |
|---|---|---|---|
| 7,268,757 | B2 | 9/2007 | Ben-David et al. |
| 7,286,136 | B2 | 10/2007 | Phan |
| 7,495,722 | B2 | 2/2009 | Roth et al. |
| 7,505,052 | B2 | 3/2009 | Choe et al. |
| 7,505,053 | B2 | 3/2009 | Brown Elliott et al. |
| 7,580,093 | B2 | 8/2009 | Rho |
| 7,701,476 | B2 | 4/2010 | Brown Elliott et al. |
| 7,750,997 | B2 | 7/2010 | Chen et al. |
| 7,876,339 | B2 | 1/2011 | Okazaki et al. |
| 7,876,341 | B2 | 1/2011 | Credelle et al. |
| 7,969,448 | B2 | 6/2011 | Yang et al. |
| 7,990,403 | B2 | 8/2011 | Ben-David et al. |
| 2007/0159492 | A1 | 7/2007 | Lo et al. |
| 2008/0284947 | A1 | 11/2008 | Li et al. |
| 2008/0316235 | A1 | 12/2008 | Okazaki et al. |
| 2009/0141381 | A1 | 6/2009 | Itou et al. |
| 2010/0141812 | A1* | 6/2010 | Hirota ..... 348/279 |
| 2011/0273493 | A1 | 11/2011 | Yoshiga et al. |
| 2012/0092237 | A1 | 4/2012 | Phan |

FOREIGN PATENT DOCUMENTS

| | | | |
|---|---|---|---|
| CN | 1494036 | A | 5/2004 |
| CN | 1509083 | A | 6/2004 |
| CN | 1722193 | A | 1/2006 |
| CN | 101286311 | A | 10/2008 |
| CN | 102243828 | A | 11/2011 |

* cited by examiner

*Primary Examiner* — Liliana Cerullo
(74) *Attorney, Agent, or Firm* — Birch, Stewart, Kolasch & Birch, LLP

(57) ABSTRACT

The present invention is to provide an image device. The image device includes a plurality of sections. Each section includes a first pixel group, a second pixel group, a third pixel group and a fourth pixel group. The first pixel group comprises at least one first color dot and a second color dot or a fourth color dot, the second pixel group comprises at least one third color dot and the second color dot, the third pixel group comprises at least one fourth color dot and the second color dot, the fourth pixel group comprises at least one fifth color dot or at least one second color dot. Any four adjacent the first pixel group, the second pixel group, the third pixel group and the fourth pixel group arranged in a 2×2 matrix reach a white balance.

64 Claims, 66 Drawing Sheets

IMAGE DEVICE WITH PIXELS ARRANGED FOR WHITE BALANCE

CROSS REFERENCE TO RELATED APPLICATIONS

This application is a Continuation-in-Part of copending application Ser. No. 12/906,619 filed on Oct. 18, 2010. The entire contents of the above application is hereby incorporated by reference.

BACKGROUND OF THE INVENTION

1. Field of the Invention

The invention relates to an image device.

2. Description of the Related Art

Referring to FIG. 1, it shows a conventional RGB stripe display. The conventional RGB stripe display 10 comprises a plurality of RGB pixel groups 11 and 12. The RGB pixel group 11 includes a red dot (R1) 111, a green dot (G1) 112 and a blue dot (B1) 113 arranged in a row direction, and the RGB pixel group 12 includes a red dot (R2) 121, a green dot (G2) 122 and a blue dot (B2) 123 arranged next to the RGB pixel group 11 in the row direction.

Since the area of the color dot is fixed and the colors of the color dot are fixed, it is hard to adjust to reach a white balance for the conventional RGB pixel group. Therefore, there is a need for an image display to solve the above problems.

SUMMARY OF THE INVENTION

The present invention is to provide an image device. The image device includes a plurality of sections. Each section includes a plurality of pixel groups arranged in a first predetermined identical matrix form, and each pixel group includes a plurality of dots arranged in a second predetermined identical matrix form. Each section includes a first pixel group, a second pixel group, a third pixel group and a fourth pixel group. The first pixel group comprises at least one first color dot and a second color dot or a fourth color dot, the second pixel group comprises at least one third color dot and the second color dot, the third pixel group comprises at least one fourth color dot and the second color dot, the fourth pixel group comprises at least one fifth color dot or at least one second color dot. Any four adjacent the first pixel group, the second pixel group, the third pixel group and the fourth pixel group arranged in a 2×2 matrix reach a white balance.

The advantage of the invention is to provide a white balance for any four adjacent pixel groups by adjusting the color of the color dot or the area of the color dot. Furthermore, black and white lines can be formed in rows or columns of the image device of the invention.

BRIEF DESCRIPTION OF THE DRAWING

Further advantageous measures are described in the dependent claims. The invention is shown in the attached drawing and is described hereinafter in greater detail.

DETAILED DESCRIPTION OF THE INVENTION

Figure 1:
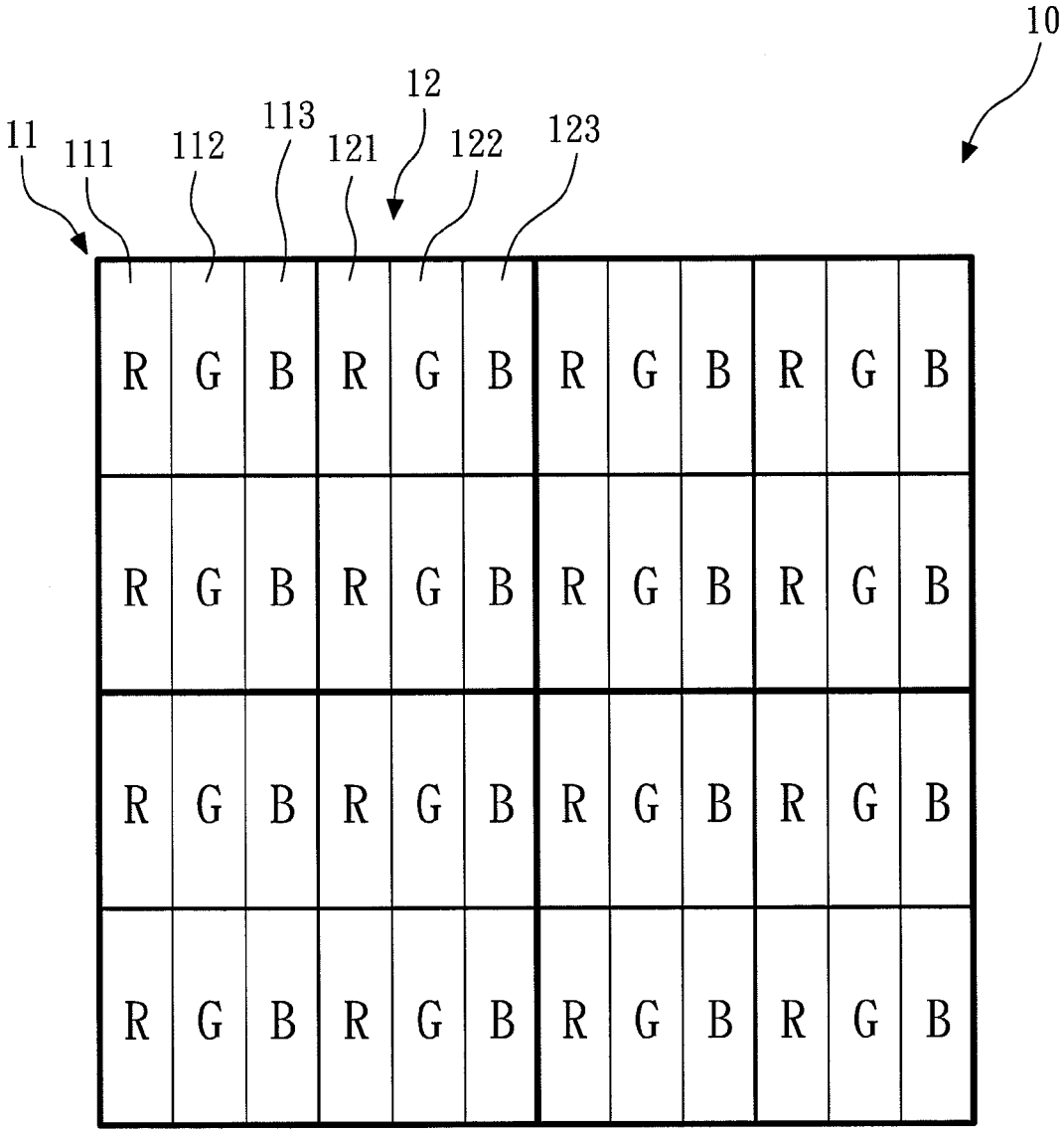
FIG. 1 PRIOR ART
FIG. 1 shows a conventional RGB stripe display.
Figure 2:
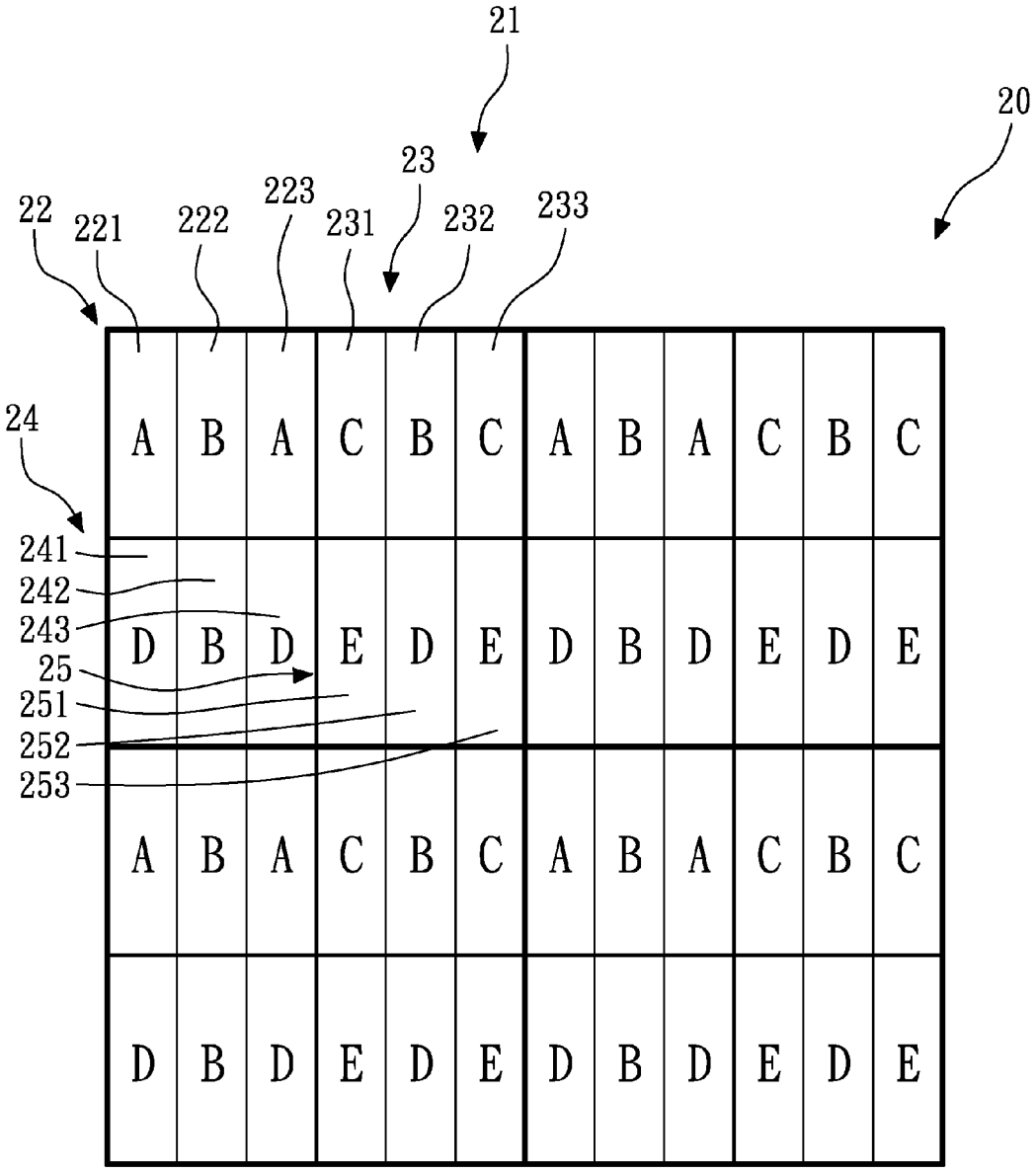
FIG. 2 shows the image device according to a first embodiment of the invention.

Referring to FIG. 2, it shows the image device according to the invention. The image device 20 includes a plurality of first sections 21. Each first section 21 includes a plurality of pixel groups arranged in a first predetermined identical matrix form, for example, in this embodiment, the first section 21 includes four pixel groups 22, 23, 24 and 25 arranged in a 2×2 matrix. The first section 21 includes a first pixel group 22, a second pixel group 23, a third pixel group 24 and a fourth pixel group 25. The area of the first pixel group 22, the second pixel group 23, the third pixel group 24 or the fourth pixel group 25 is the same as that of the conventional RGB pixel group.

Each pixel group includes a plurality of dots arranged in a second predetermined identical matrix form, for example, in this embodiment, the pixel group includes three color dots arranged in a 3×1 matrix. The first pixel group 22 includes two first color dots (A) 221, 223 and a second color dot (B) 222, the second pixel group 23 includes two third color dots (C) 231, 233 and the second color dot (B) 232, the third pixel group 24 includes two fourth color dots (D) 241, 243 and the second color dot (B) 242, and the fourth pixel group 25 includes two fifth color dots (E) 251, 253 and the fourth color dot (D) 253.

The second color dot (B) 222 is disposed between the two first color dots (A) 221, 223 in the first pixel group 22, the second color dot (B) 232 is disposed between the two third color dots (C) 231, 233 in the second pixel group 23, the second color dot (B) 242 is disposed between the two fourth color dots (D) 241, 243 in the third pixel group 24, the fourth color dot (D) 252 is disposed between the two fifth color dots (E) 251, 253 in the fourth pixel group 25.

In the first sections 21, the first pixel group 22, the second pixel group 23, the third pixel group 24 and the fourth pixel group 25 reach a white balance. Further, it is not limited in a single section, any four adjacent the first pixel group, the second pixel group, the third pixel group and the fourth pixel group arranged in a 2×2 matrix reach a white balance.

Figure 3:
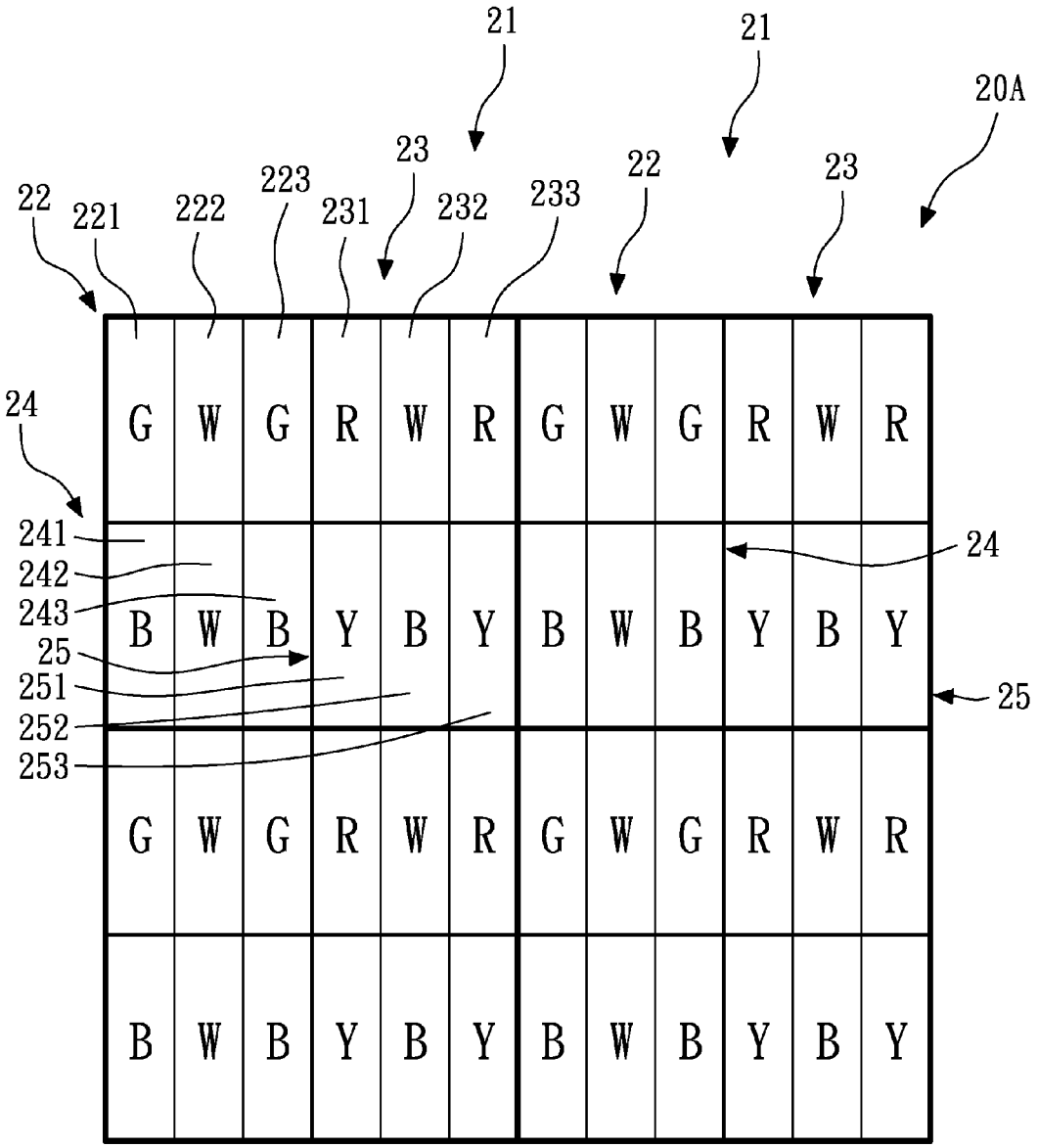
FIG. 3 shows the image device according to a first embodiment of the invention.

Referring to FIG. 3, it shows the image device according to a first embodiment of the invention. Referring to FIG. 2 and FIG. 3, according to the first embodiment of the invention, the image device 20A includes a plurality of first sections 21. In this embodiment, the first color dot (A) is a green color dot (G), the second color dot (B) is a white color dot (W), the third color dot (C) is a red color dot (R), the fourth color dot (D) is a blue color dot (B) and the fifth color dot (E) is a yellow color dot (Y).

The second color dot (W) 222 is disposed between the two first color dots (G) 221, 223 in the first pixel group 22, the second color dot (W) 232 is disposed between the two third color dots (R) 231, 233 in the second pixel group 23, the second color dot (W) 242 is disposed between the two fourth color dots (B) 241, 243 in the third pixel group 24, the fourth color dot (B) 252 is disposed between the two fifth color dots (Y) 251, 253 in the fourth pixel group 25.

In this embodiment, the first pixel group 22 is disposed on a first column and first row position of the first section 21, the second pixel group 23 is disposed on a second column and first row position of the first section 21, the third pixel group 24 is disposed on a first column and second row position of the first section 21, the fourth pixel group 25 is disposed on a second column and second row position of the first section 21. In the first section, the first pixel group 22, the second pixel group 23, the third pixel group 24 and the fourth pixel group 25 reach a white balance. Further, the second pixel group 23 and the fourth pixel group 25 in the first section 21 and the first pixel group 22 and the third pixel group 24 in the adjacent first section 21 arranged in a 2×2 matrix also can reach a white balance.

Figure 4:
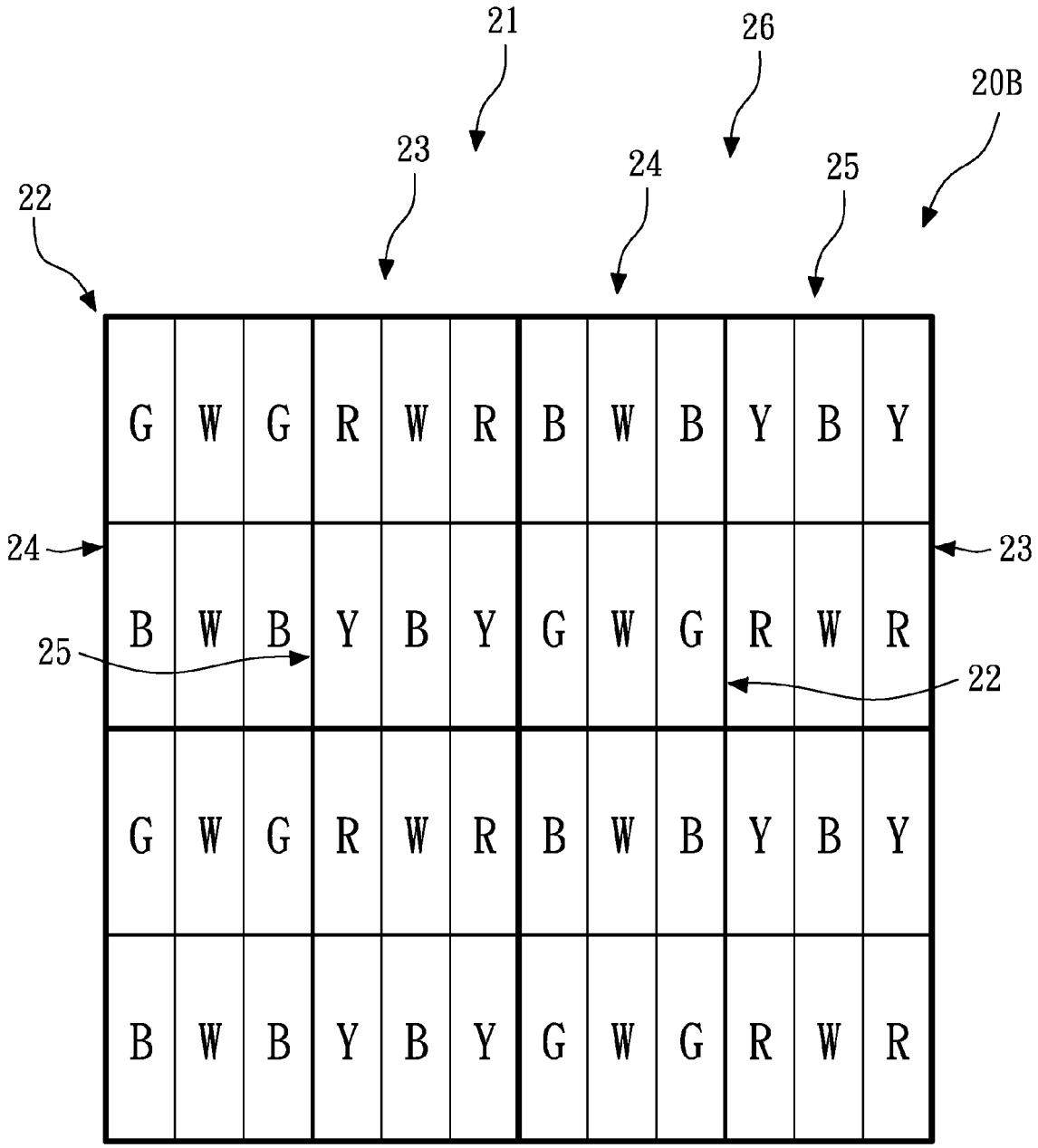
FIG. 4 shows the image device according to a second embodiment of the invention.

Referring to FIG. 4, it shows the image device according to a second embodiment of the invention. In this embodiment, the image device 20B comprises a plurality of first sections 21 and a plurality of second sections 26. Each second section 26 comprises the first pixel group 22, the second pixel group 23, the third pixel group 24 and the fourth pixel group 25. The third pixel group 24 is disposed on a first column and first row position of the second section 26, the fourth pixel group 25 is disposed on a second column and first row position of the second section 26, the first pixel group 22 is disposed on a first column and second row position of the second section 26, the second pixel group 23 is disposed on a second column and second row position of the second section 26.

In the second sections 26, the first pixel group 22, the second pixel group 23, the third pixel group 24 and the fourth pixel group 25 reach a white balance. Further, the second pixel group 23 and the fourth pixel group 25 in the first section 21 and the first pixel group 22 and the third pixel group 24 in the adjacent second section 26 arranged in a 2×2 matrix also can reach a white balance.

Figure 5:
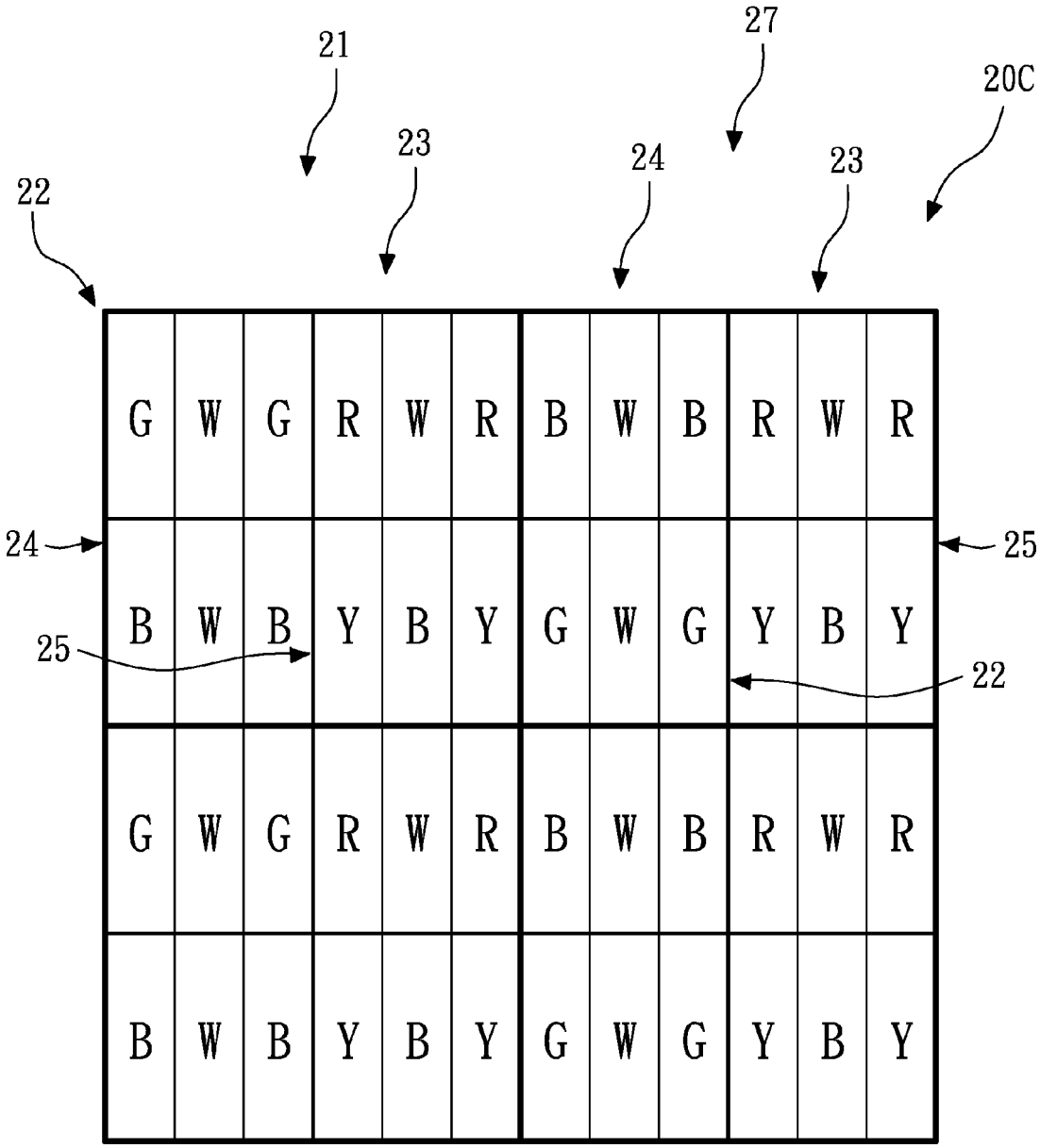
FIG. 5 shows the image device according to a third embodiment of the invention.

Referring to FIG. 5, it shows the image device according to a third embodiment of the invention. In this embodiment, the image device 20C comprises a plurality of first sections 21 and a plurality of third sections 27. Each third section 27 comprises the first pixel group 22, the second pixel group 23, the third pixel group 24 and the fourth pixel group 25. The third pixel group 24 is disposed on a first column and first row position of the third section 27, the second pixel group 23 is disposed on a second column and first row position of the third section 27, the first pixel group 22 is disposed on a first column and second row position of the third section 27, the fourth pixel group 25 is disposed on a second column and second row position of the third section 27.

In the third section 27, the first pixel group 22, the second pixel group 23, the third pixel group 24 and the fourth pixel group 25 reach a white balance. Further, the second pixel group 23 and the fourth pixel group 25 in the first section 21 and the first pixel group 22 and the third pixel group 24 in the adjacent third section 27 arranged in a 2×2 matrix also can reach a white balance.

Figure 6:
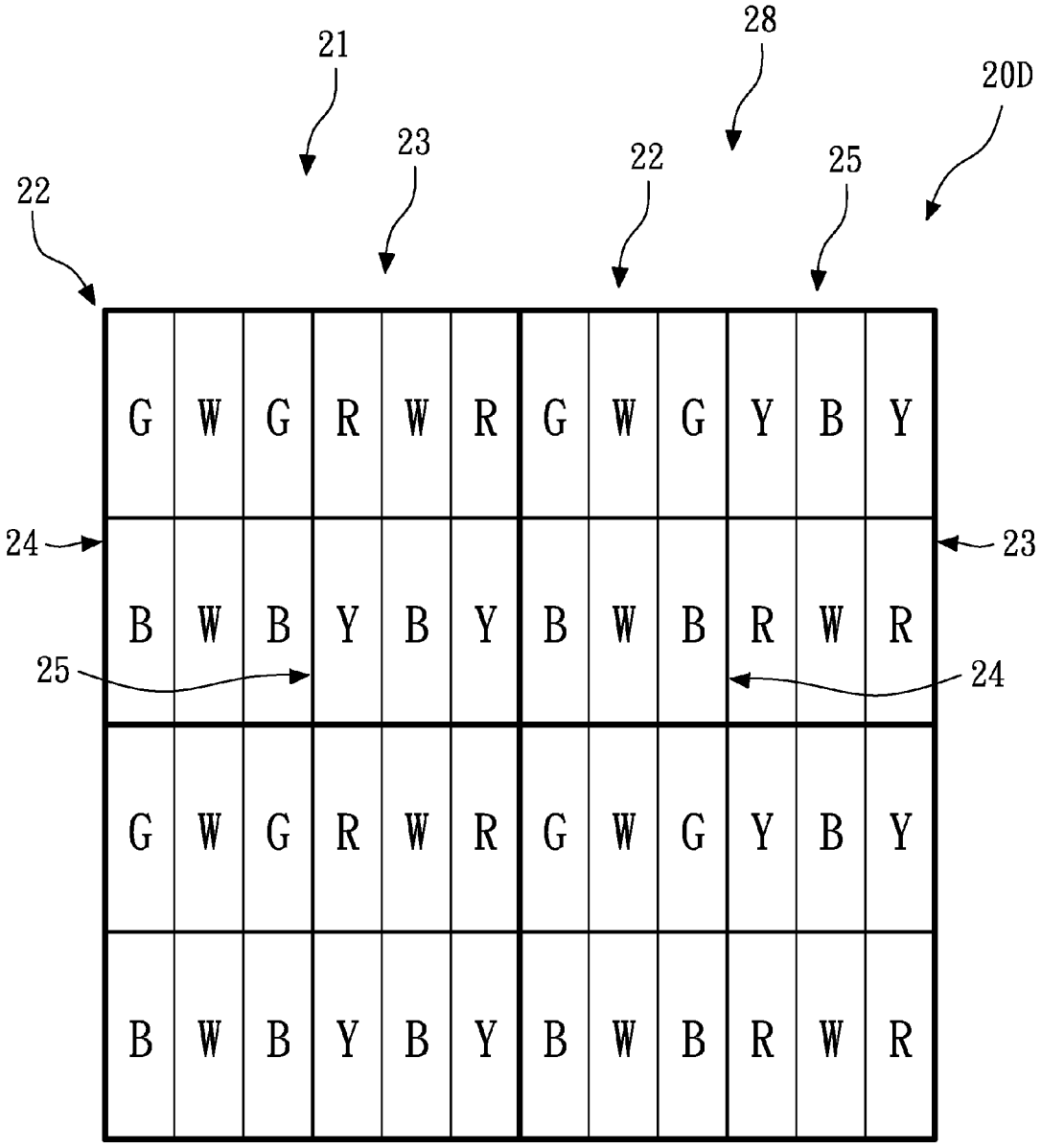
FIG. 6 shows the image device according to a fourth embodiment of the invention.

Referring to FIG. 6, it shows the image device according to a fourth embodiment of the invention. In this embodiment, the image device 20D comprises a plurality of first sections 21 and a plurality of fourth sections 28. Each fourth section 28 comprises the first pixel group 22, the second pixel group 23, the third pixel group 24 and the fourth pixel group 25. The first pixel group 22 is disposed on a first column and first row position of the fourth section 28, the fourth pixel group 25 is disposed on a second column and first row position of the fourth section 28, the third pixel group 24 is disposed on a first column and second row position of the fourth section 28, the second pixel group 23 is disposed on a second column and second row position of the fourth section 28.

In the fourth sections 28, the first pixel group 22, the second pixel group 23, the third pixel group 24 and the fourth pixel group 25 reach a white balance. Further, the second pixel group 23 and the fourth pixel group 25 in the first section 21 and the first pixel group 22 and the third pixel group 24 in the adjacent second section 28 arranged in a 2×2 matrix also can reach a white balance.

Figure 7:
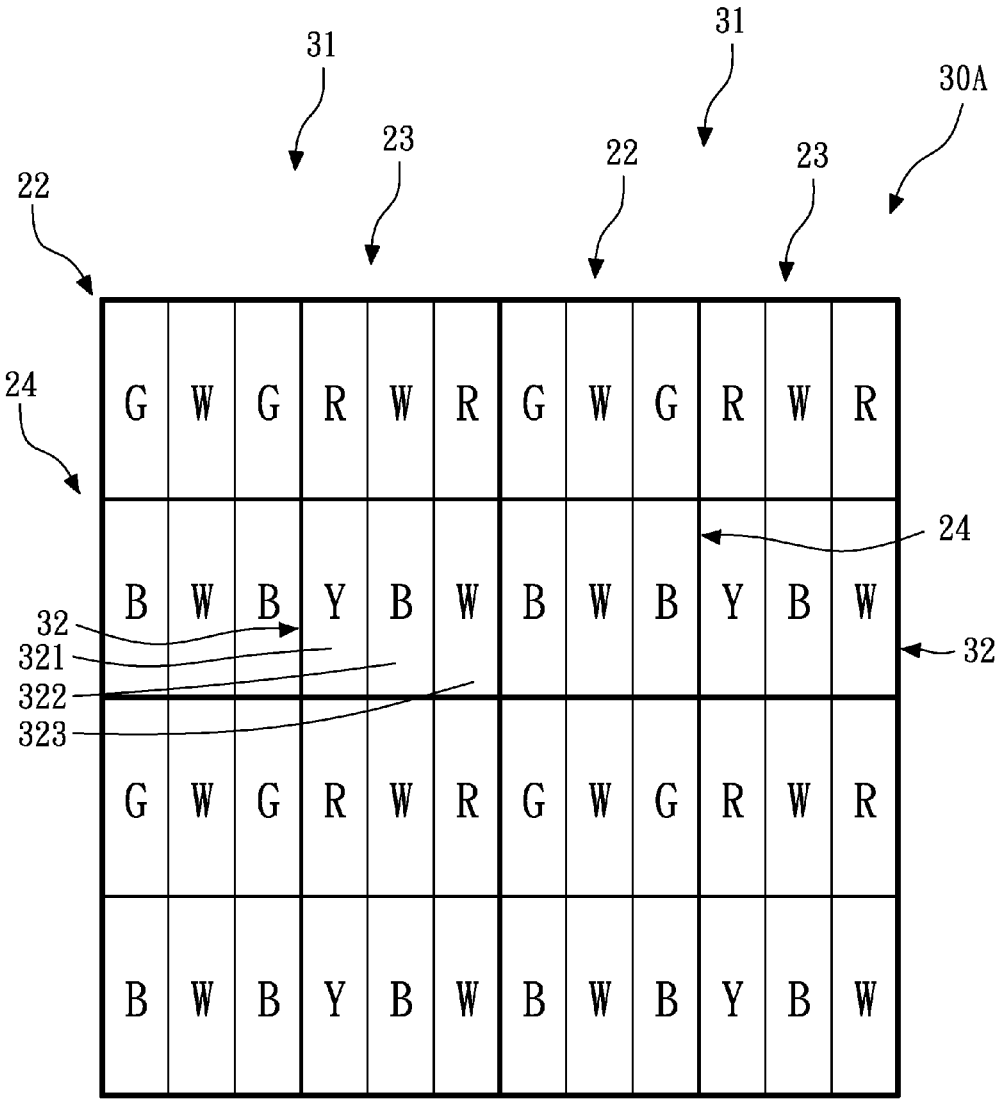
FIG. 7 shows the image device according to a fifth embodiment of the invention.

Referring to FIG. 7, it shows the image device according to a fifth embodiment of the invention. In this embodiment, the image device 30A comprises a plurality of fifth sections 31. Each fifth section 31 comprises the first pixel group 22, the second pixel group 23, the third pixel group 24 and the fourth pixel group 32. In this embodiment, the first pixel group 22, the second pixel group 23, the third pixel group 24 are the same as those in the above embodiment. The fourth pixel group 32 comprises one yellow color dot (Y) 321, one blue color dot (B) 322 and one white color dot (W) 323, the blue color dot (B) 322 is disposed between the yellow color dot (Y) 321 and the white color dot (W) 323.

The first pixel group 22 is disposed on a first column and first row position of the fifth section 31, the second pixel group 23 is disposed on a second column and first row position of the fifth section 31, the third pixel group 24 is disposed on a first column and second row position of the fifth section 31, the fourth pixel group 32 is disposed on a second column and second row position of the fifth section 31. In the fifth section 31, the first pixel group 22, the second pixel group 23, the third pixel group 24 and the fourth pixel group 32 reach a white balance. Further, the second pixel group 23 and the fourth pixel group 32 in the fifth section 31 and the first pixel group 22 and the third pixel group 24 in the adjacent fifth section 31 arranged in a 2×2 matrix also can reach a white balance.

Figure 8:
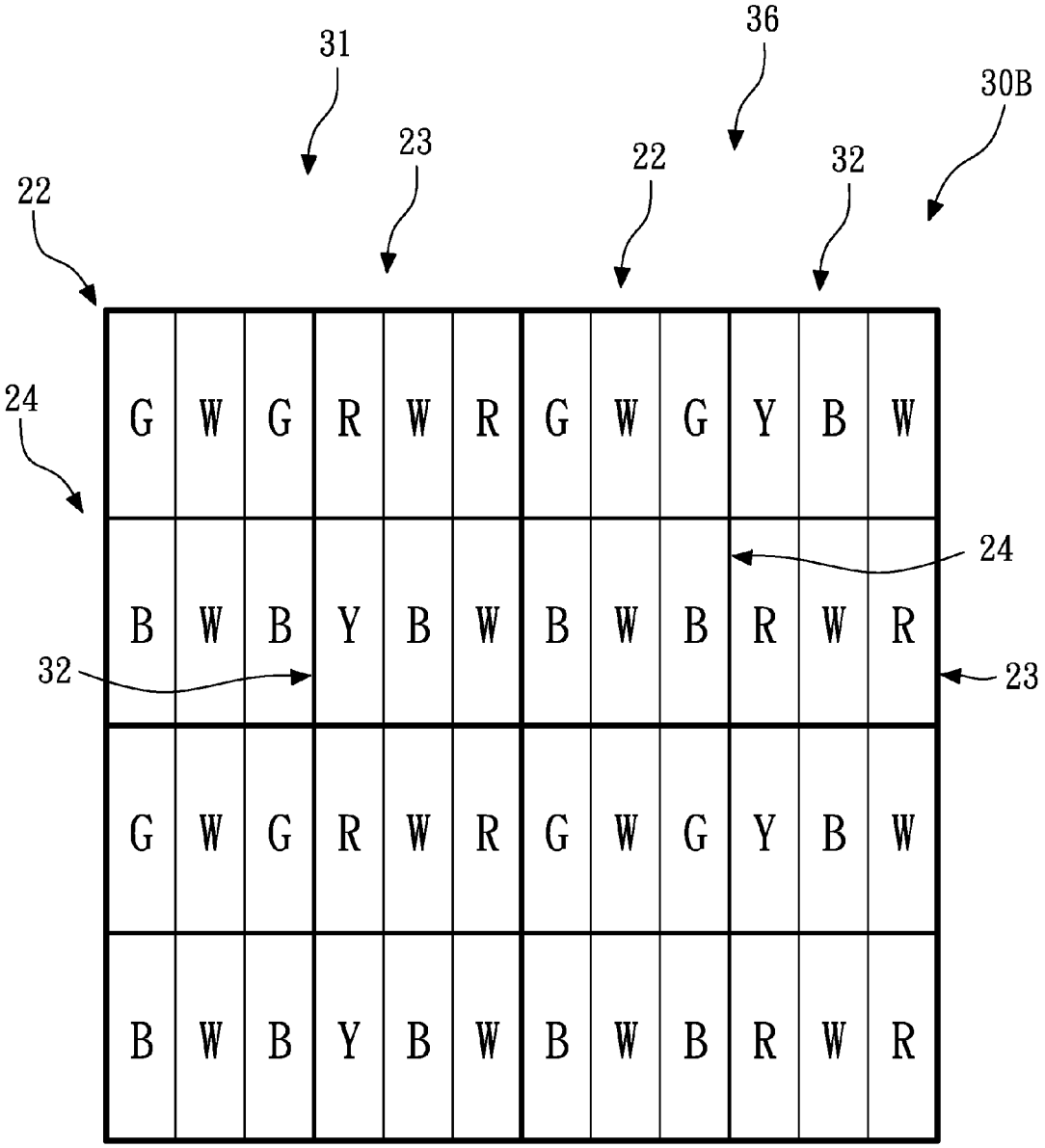
FIG. 8 shows the image device according to a sixth embodiment of the invention.

Referring to FIG. 8, it shows the image device according to a sixth embodiment of the invention. In this embodiment, the image device 30B comprises a plurality of fifth sections 31 and a plurality of sixth sections 36. Each sixth section 36 comprises the first pixel group 22, the second pixel group 23, the third pixel group 24 and the fourth pixel group 32. The first pixel group 22 is disposed on a first column and first row position of the sixth section 36, the fourth pixel group 32 is disposed on a second column and first row position of the sixth section 36, the third pixel group 24 is disposed on a first column and second row position of the sixth section 36, the second pixel group 23 is disposed on a second column and second row position of the sixth section 36.

In the sixth sections 36, the first pixel group 22, the second pixel group 23, the third pixel group 24 and the fourth pixel group 32 reach a white balance. Further, the second pixel group 23 and the fourth pixel group 32 in the fifth section 31 and the first pixel group 22 and the third pixel group 24 in the adjacent sixth section 36 arranged in a 2×2 matrix also can reach a white balance.

Figure 9:
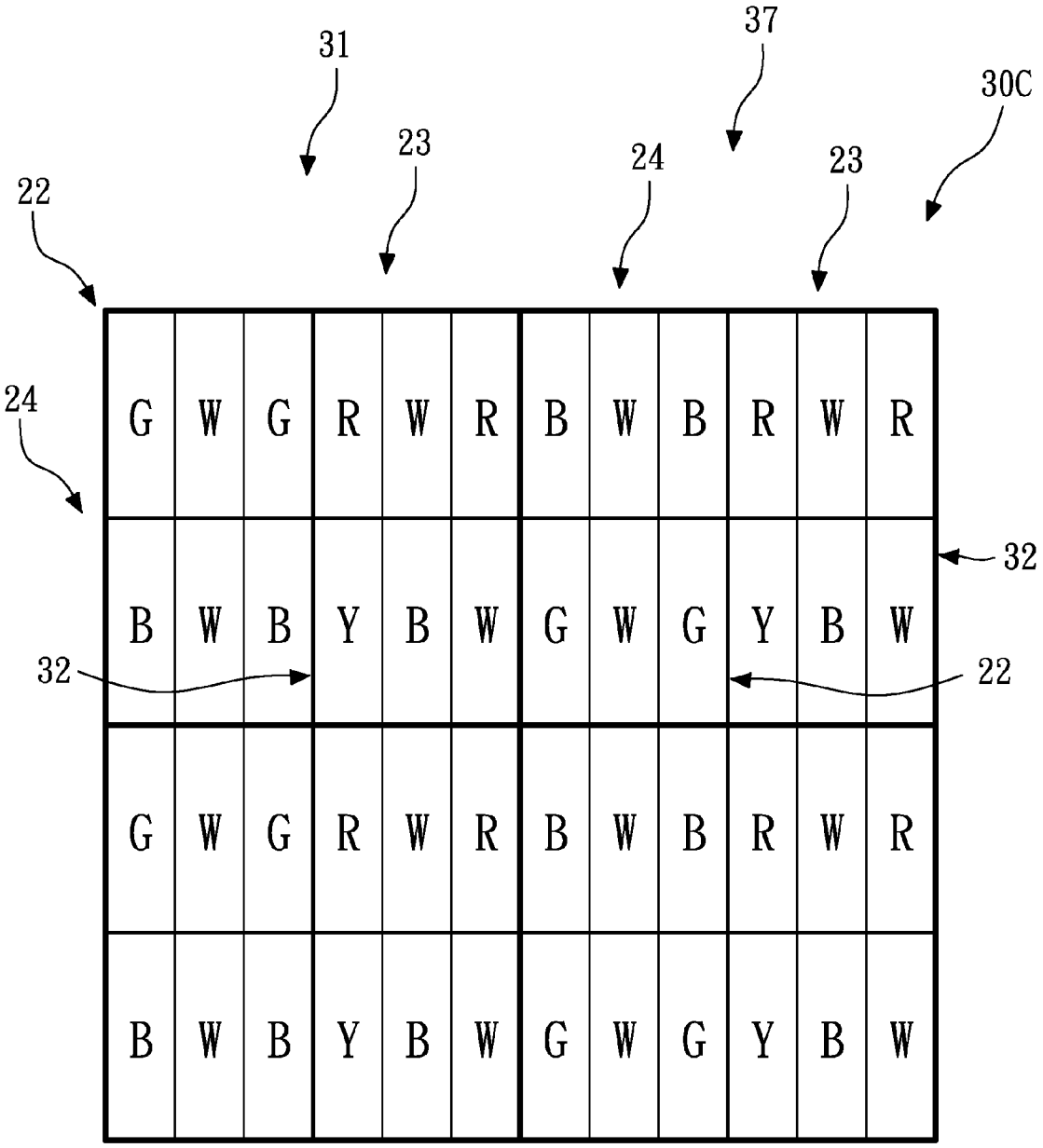
FIG. 9 shows the image device according to a seventh embodiment of the invention.

Referring to FIG. 9, it shows the image device according to a seventh embodiment of the invention. In this embodiment, the image device 30C comprises a plurality of fifth sections 31 and a plurality of seventh sections 37. Each seventh section 37 comprises the first pixel group 22, the second pixel group 23, the third pixel group 24 and the fourth pixel group 32. The third pixel group 24 is disposed on a first column and first row position of the seventh section 37, the second pixel group 23 is disposed on a second column and first row position of the seventh section 37, the first pixel group 22 is disposed on a first column and second row position of the seventh section 37, the fourth pixel group 32 is disposed on a second column and second row position of the seventh section 37.

In the seventh sections 37, the first pixel group 22, the second pixel group 23, the third pixel group 24 and the fourth pixel group 32 reach a white balance. Further, the second pixel group 23 and the fourth pixel group 32 in the fifth section 31 and the first pixel group 22 and the third pixel group 24 in the adjacent seventh section 37 arranged in a 2×2 matrix also can reach a white balance.

Figure 10:
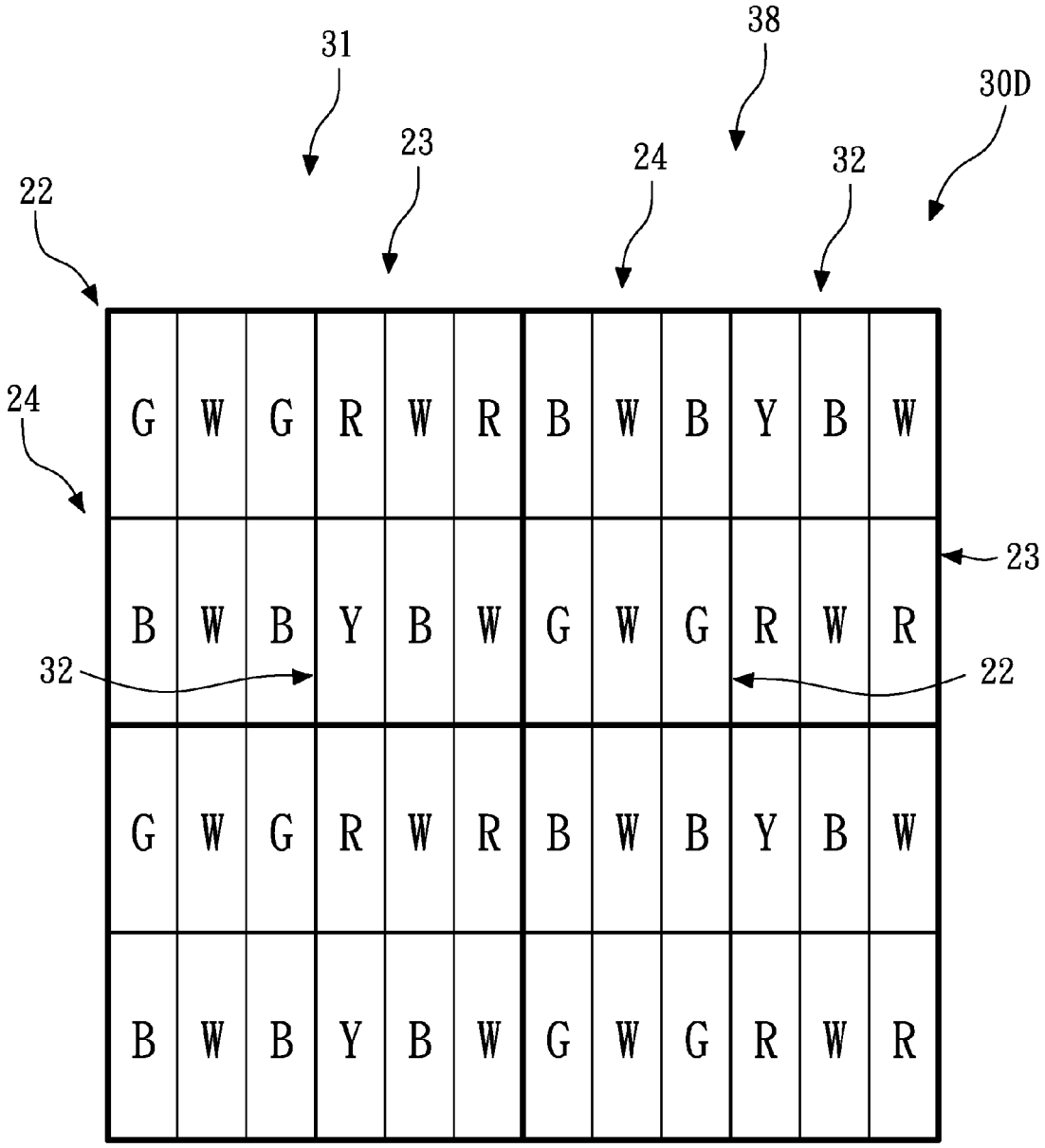
FIG. 10 shows the image device according to a eighth embodiment of the invention.

Referring to FIG. 10, it shows the image device according to a eighth embodiment of the invention. In this embodiment, the image device 30D comprises a plurality of fifth sections 31 and a plurality of eighth sections 38. Each eighth section 38 comprises the first pixel group 22, the second pixel group 23, the third pixel group 24 and the fourth pixel group 32. The third pixel group 24 is disposed on a first column and first row position of the eighth section 38, the fourth pixel group 32 is disposed on a second column and first row position of the eighth section 38, the first pixel group 22 is disposed on a first column and second row position of the eighth section 38, the second pixel group 23 is disposed on a second column and second row position of the eighth section 38.

In the eighth sections 38, the first pixel group 22, the second pixel group 23, the third pixel group 24 and the fourth pixel group 32 reach a white balance. Further, the second pixel group 23 and the fourth pixel group 32 in the fifth section 31 and the first pixel group 22 and the third pixel group 24 in the adjacent eighth section 38 arranged in a 2×2 matrix also can reach a white balance.

Figure 11:
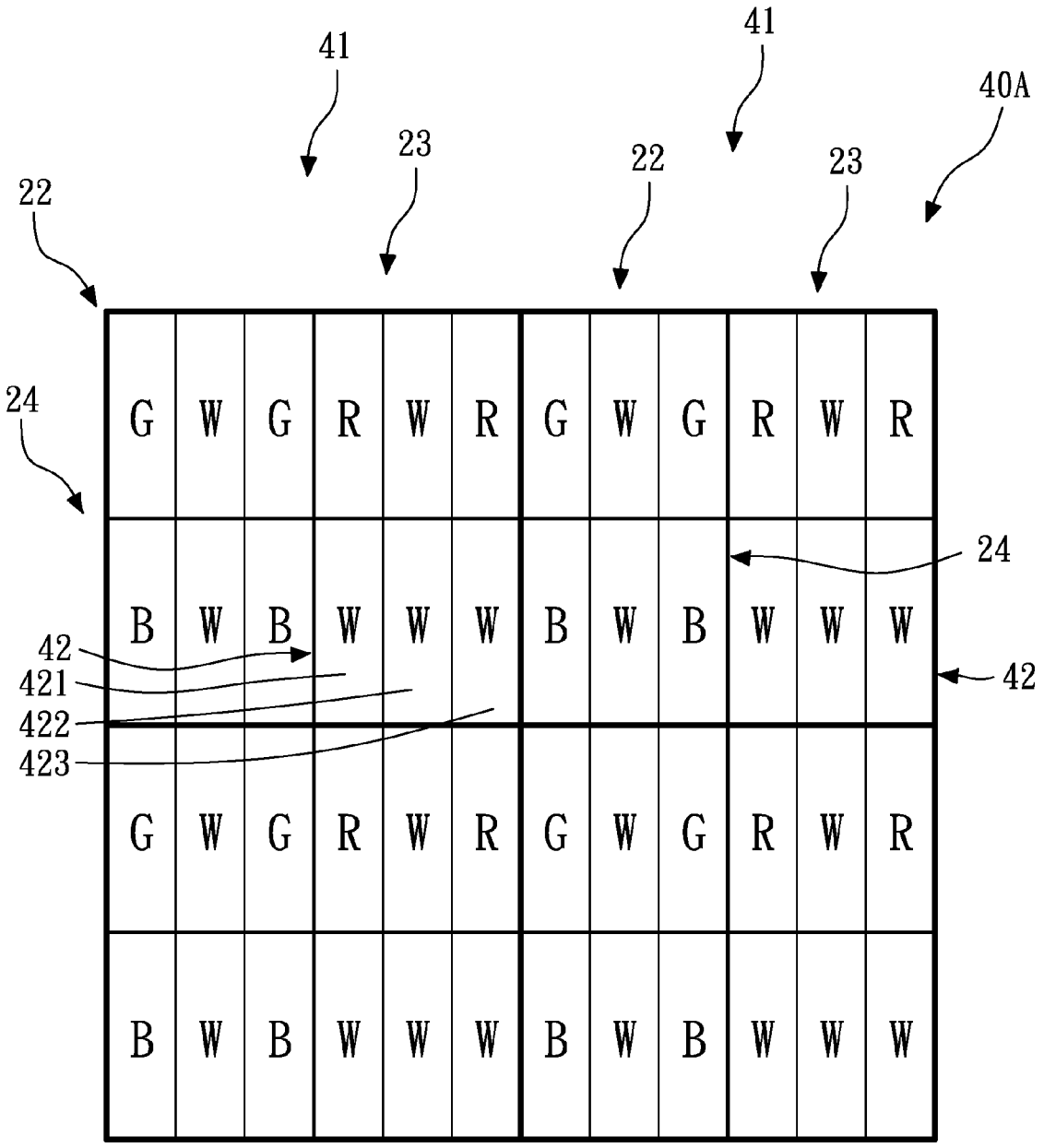
FIG. 11 shows the image device according to a ninth embodiment of the invention.

Referring to FIG. 11, it shows the image device according to a ninth embodiment of the invention. In this embodiment, the image device 40A comprises a plurality of ninth sections 41. Each ninth section 41 comprises the first pixel group 22, the second pixel group 23, the third pixel group 24 and the fourth pixel group 42. In this embodiment, the first pixel group 22, the second pixel group 23, the third pixel group 24 are the same as those in the above embodiment. The fourth pixel group 42 comprises three white color dots (W) 421, 422, 423.

The first pixel group 22 is disposed on a first column and first row position of the ninth section 41, the second pixel group 23 is disposed on a second column and first row position of the ninth section 41, the third pixel group 24 is disposed on a first column and second row position of the ninth section 41, the fourth pixel group 42 is disposed on a second column and second row position of the ninth section 41. In the ninth section 41, the first pixel group 22, the second pixel group 23, the third pixel group 24 and the fourth pixel group 42 reach a white balance. Further, the second pixel group 23 and the fourth pixel group 42 in the ninth section 41 and the first pixel group 22 and the third pixel group 24 in the adjacent ninth section 41 arranged in a 2×2 matrix also can reach a white balance.

Figure 12:
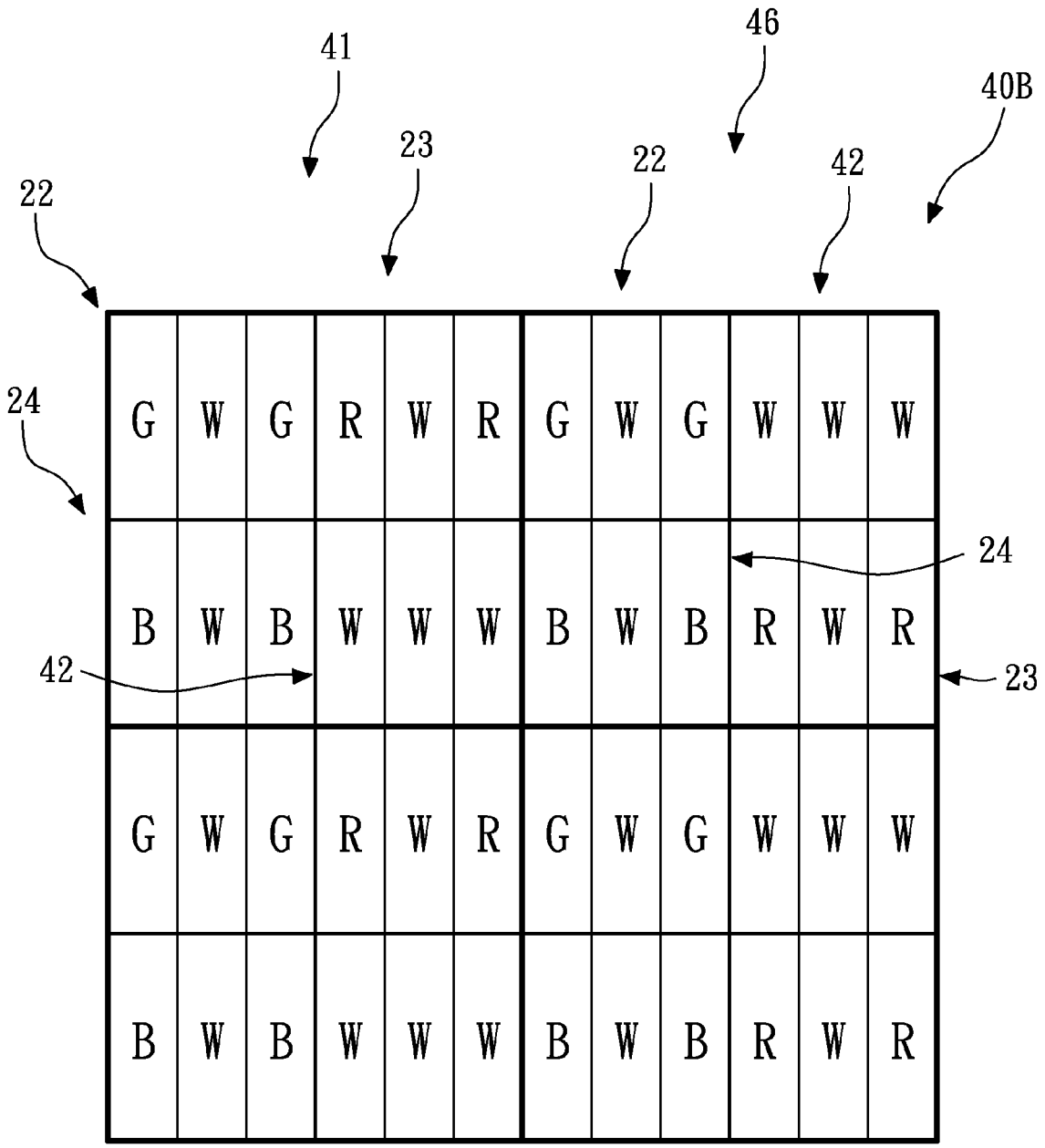
FIG. 12 shows the image device according to a tenth embodiment of the invention.

Referring to FIG. 12, it shows the image device according to a tenth embodiment of the invention. In this embodiment, the image device 40B comprises a plurality of ninth sections 41 and a plurality of tenth sections 46. Each tenth section 46 comprises the first pixel group 22, the second pixel group 23, the third pixel group 24 and the fourth pixel group 42. The first pixel group 22 is disposed on a first column and first row position of the tenth section 46, the fourth pixel group 42 is disposed on a second column and first row position of the tenth section 46, the third pixel group 24 is disposed on a first column and second row position of the tenth section 46, the second pixel group 23 is disposed on a second column and second row position of the tenth section 46.

In the tenth section 46, the first pixel group 22, the second pixel group 23, the third pixel group 24 and the fourth pixel group 42 reach a white balance. Further, the second pixel group 23 and the fourth pixel group 42 in the ninth section 41 and the first pixel group 22 and the third pixel group 24 in the adjacent tenth section 46 arranged in a 2×2 matrix also can reach a white balance.

Figure 13:
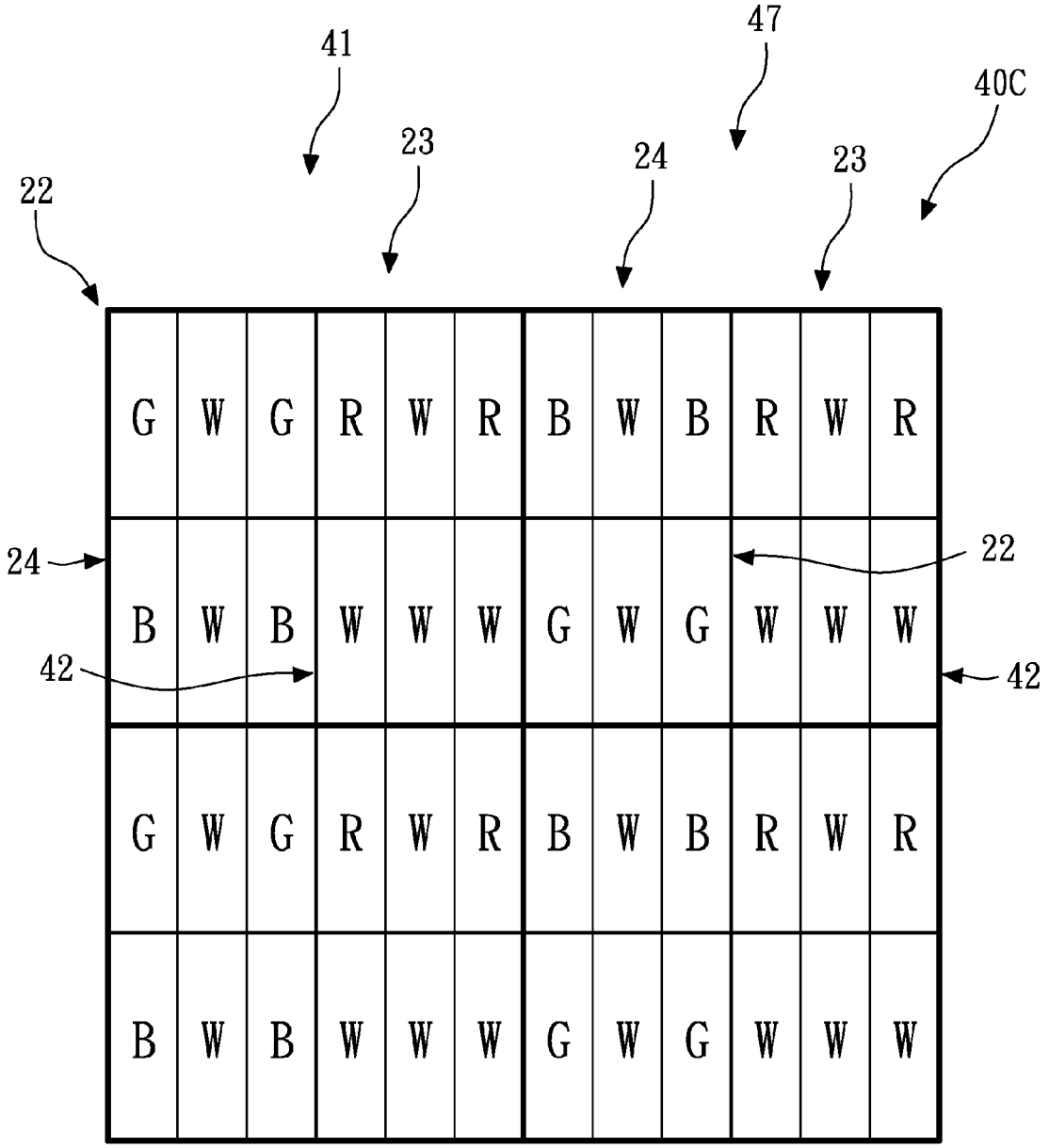
FIG. 13 shows the image device according to an eleventh embodiment of the invention.

Referring to FIG. 13, it shows the image device according to an eleventh embodiment of the invention. In this embodiment, the image device 40C comprises a plurality of ninth sections 41 and a plurality of eleventh sections 47. Each eleventh section 47 comprises the first pixel group 22, the second pixel group 23, the third pixel group 24 and the fourth pixel group 42. The third pixel group 24 is disposed on a first column and first row position of the eleventh section 47, the second pixel group 23 is disposed on a second column and first row position of the eleventh section 47, the first pixel group 22 is disposed on a first column and second row position of the eleventh section 47, the fourth pixel group 42 is disposed on a second column and second row position of the eleventh section 47.

In the eleventh section 47, the first pixel group 22, the second pixel group 23, the third pixel group 24 and the fourth pixel group 42 reach a white balance. Further, the second pixel group 23 and the fourth pixel group 42 in the ninth section 41 and the first pixel group 22 and the third pixel group 24 in the adjacent eleventh section 47 arranged in a 2×2 matrix also can reach a white balance.

Figure 14:
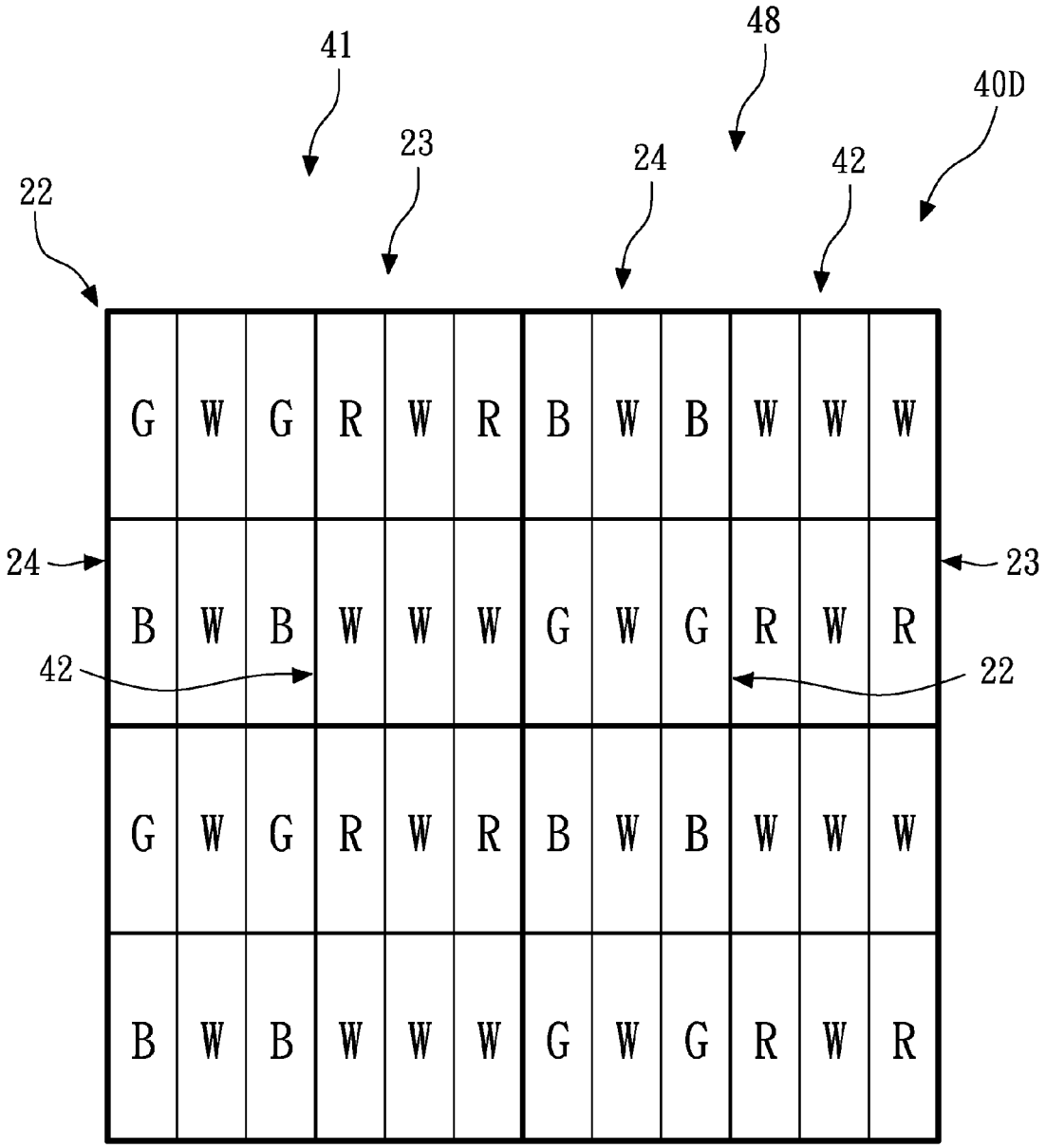
FIG. 14 shows the image device according to a twelfth embodiment of the invention.

Referring to FIG. 14, it shows the image device according to a twelfth embodiment of the invention. In this embodiment, the image device 40D comprises a plurality of ninth sections 41 and a plurality of twelfth sections 48. Each twelfth section 48 comprises the first pixel group 22, the second pixel group 23, the third pixel group 24 and the fourth pixel group 42. The third pixel group 24 is disposed on a first column and first row position of the twelfth section 48, the fourth pixel group 42 is disposed on a second column and first row position of the twelfth section 48, the first pixel group 22 is disposed on a first column and second row position of the twelfth section 48, the second pixel group 23 is disposed on a second column and second row position of the twelfth section 48.

In the twelfth section 48, the first pixel group 22, the second pixel group 23, the third pixel group 24 and the fourth pixel group 42 reach a white balance. Further, the second pixel group 23 and the fourth pixel group 42 in the ninth section 41 and the first pixel group 22 and the third pixel group 24 in the adjacent twelfth section 48 arranged in a 2×2 matrix also can reach a white balance.

Figure 15:
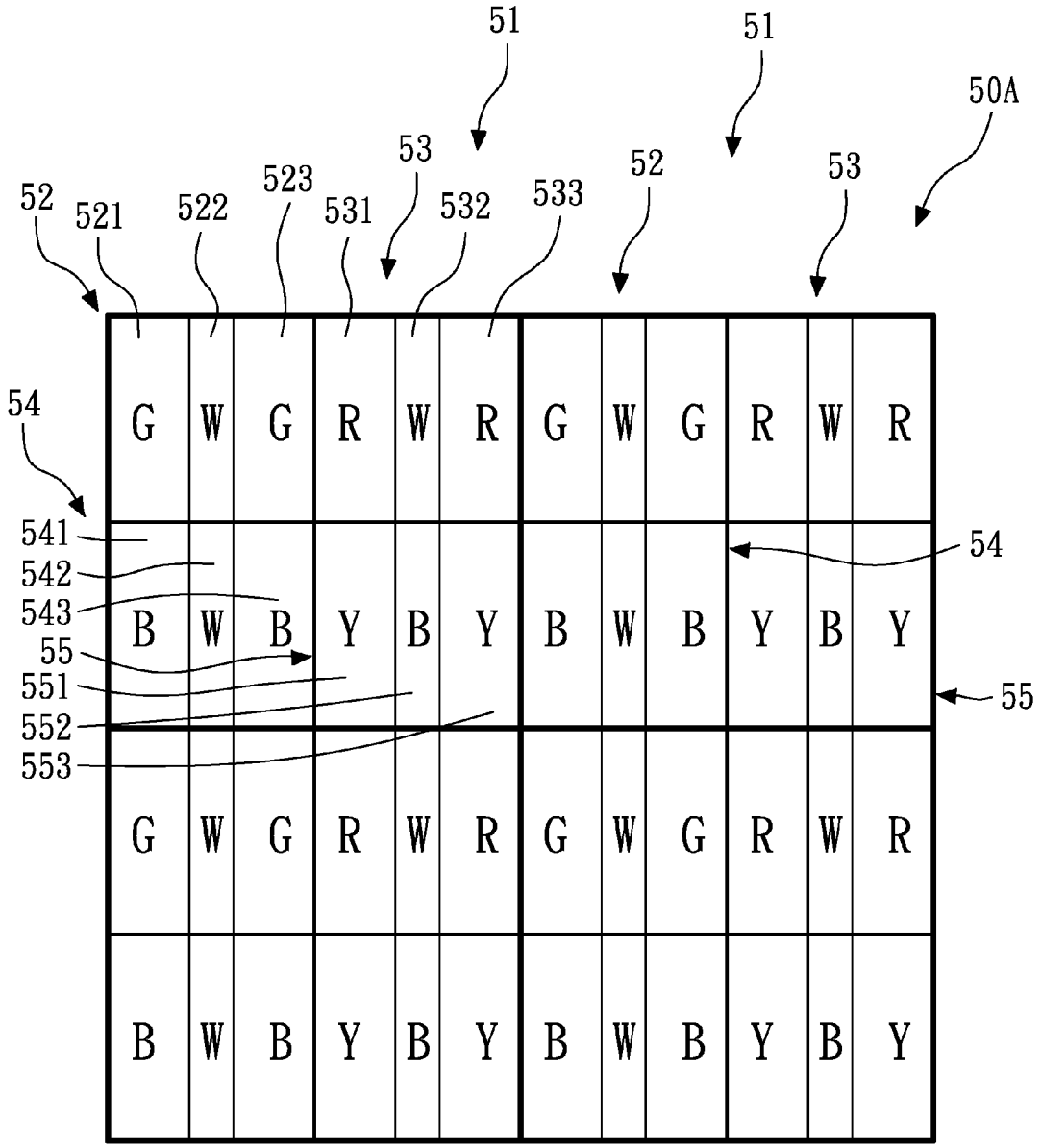
FIG. 15 shows the image device according to a thirteenth embodiment of the invention.

Referring to FIG. 15, it shows the image device according to a thirteenth embodiment of the invention. In this embodiment, the image device 50A comprises a plurality of first sections 51. The first section 51 includes a first pixel group 52, a second pixel group 53, a third pixel group 54 and a fourth pixel group 55. The first pixel group 52 includes two first color dots (G) 521, 523 and a second color dot (W) 522, the second pixel group 53 includes two third color dots (R) 531, 533 and the second color dot (W) 532, the third pixel group 54 includes two fourth color dots (B) 541, 543 and the second color dot (W) 542, and the fourth pixel group 55 includes two fifth color dots (Y) 551, 553 and the fourth color dot (B) 553. The second color dot (W) 522 is disposed between the two first color dots (G) 521, 523 in the first pixel group 52, the second color dot (W) 532 is disposed between the two third color dots (R) 531, 533 in the second pixel group 53, the second color dot (W) 542 is disposed between the two fourth color dots (B) 541, 543 in the third pixel group 54, the fourth color dot (B) 552 is disposed between the two fifth color dots (Y) 551, 553 in the fourth pixel group 25. The area of the first pixel group 52, the second pixel group 53, the third pixel group 54 or the fourth pixel group 55 is the same as that of the conventional RGB pixel group.

The differences between the first embodiment in FIG. 3 and the thirteenth embodiment in FIG. 15 are: an area of the second color dot 522 is smaller than that of the first color dots 521, 523 in the first pixel group 52, an area of the second color dot 532 is smaller than that of the third color dots 531, 533 in the second pixel group 53, and an area of the second color dot 542 is smaller than that of the fourth color dots 541, 543 in the third pixel group 54; an area of the fourth color dot 552 is smaller than that of the fifth color dots 551, 553 in the fourth pixel group 55. In FIG. 15, the area of the second color dot 522 is about ⅓ area of the first color dot 521 in the first pixel group 52.

In this embodiment, in the first section 51, the first pixel group 52, the second pixel group 53, the third pixel group 54 and the fourth pixel group 55 reach a white balance. Further, the second pixel group 53 and the fourth pixel group 55 in the first section 51 and the first pixel group 52 and the third pixel group 54 in the adjacent first section 51 arranged in a 2×2 matrix also can reach a white balance.

Figure 16:
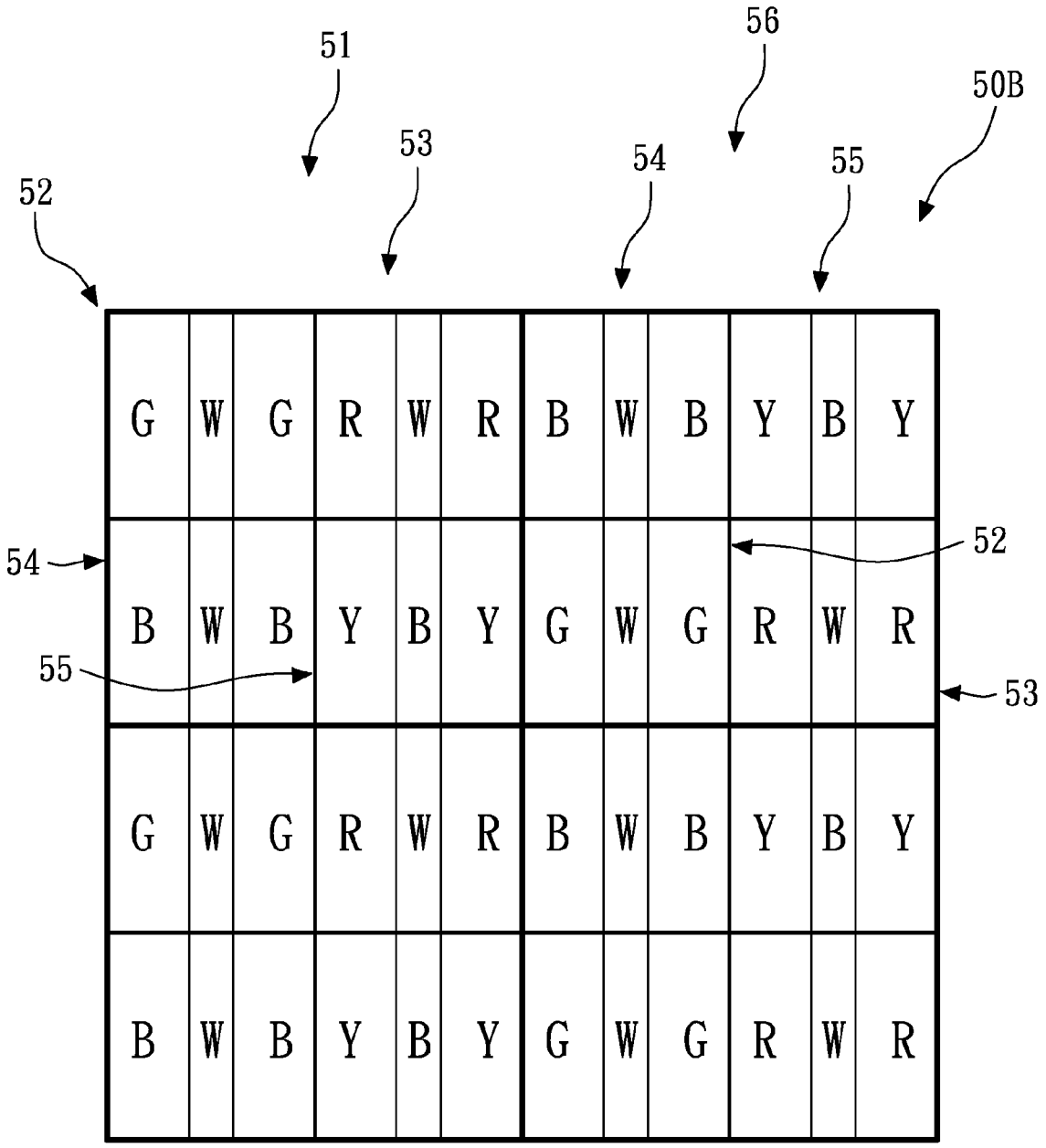
FIG. 16 shows the image device according to a fourteenth embodiment of the invention.

Referring to FIG. 16, it shows the image device according to a fourteenth embodiment of the invention. In this embodiment, the image device 50B comprises a plurality of first sections 51 and a plurality of second sections 56. Each second section 56 comprises the first pixel group 52, the second pixel group 53, the third pixel group 54 and the fourth pixel group 55. The third pixel group 54 is disposed on a first column and first row position of the second section 56, the fourth pixel group 55 is disposed on a second column and first row position of the second section 56, the first pixel group 52 is disposed on a first column and second row position of the second section 56, the second pixel group 53 is disposed on a second column and second row position of the second section 56.

In the second sections 56, the first pixel group 52, the second pixel group 53, the third pixel group 54 and the fourth pixel group 55 reach a white balance. Further, the second pixel group 53 and the fourth pixel group 55 in the first section 51 and the first pixel group 52 and the third pixel group 54 in the adjacent second section 56 arranged in a 2×2 matrix also can reach a white balance.

Figure 17:
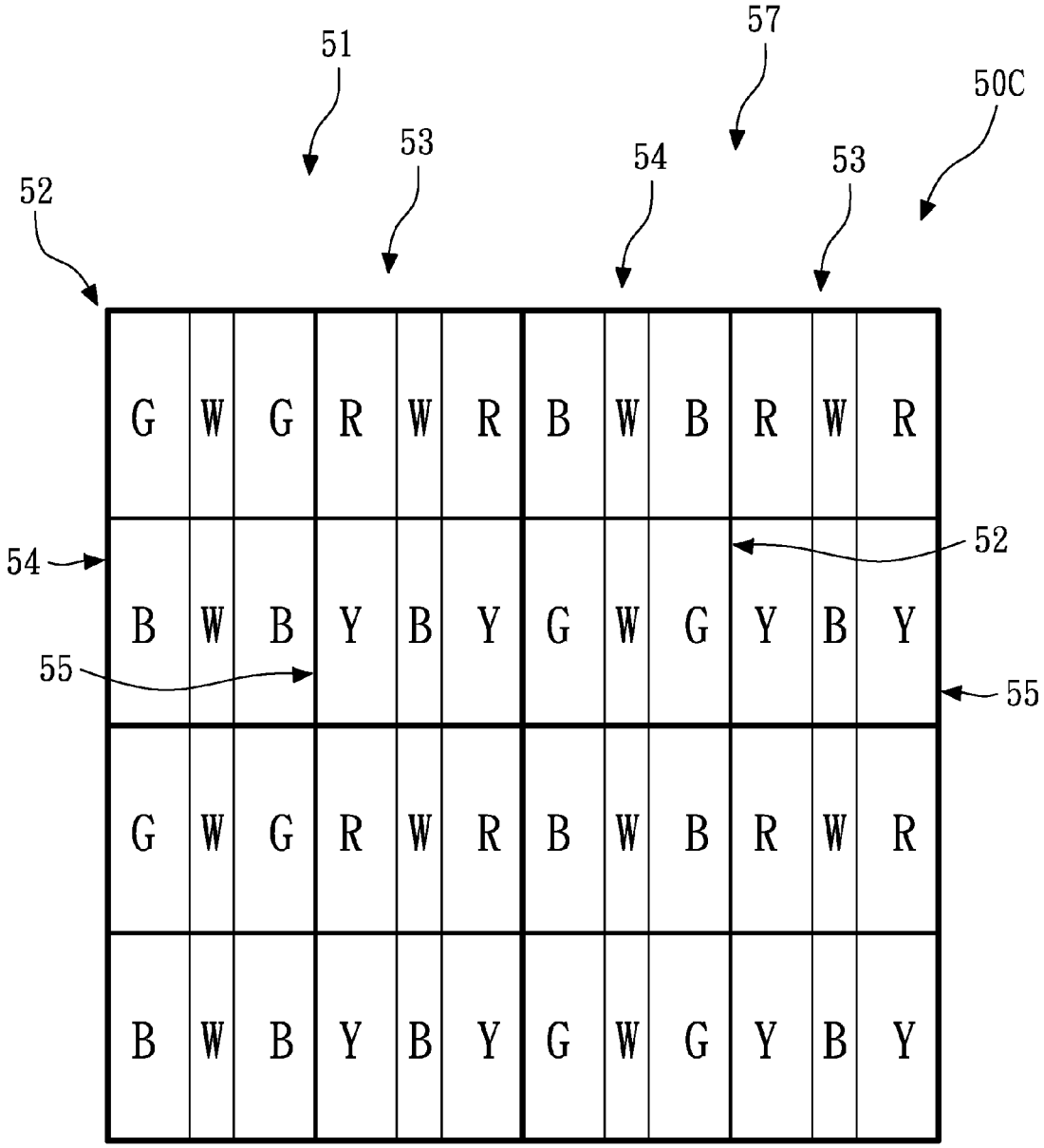
FIG. 17 shows the image device according to a fifteenth embodiment of the invention.

Referring to FIG. 17, it shows the image device according to a fifteenth embodiment of the invention. In this embodiment, the image device 50C comprises a plurality of first sections 51 and a plurality of third sections 57. Each third section 57 comprises the first pixel group 52, the second pixel group 53, the third pixel group 54 and the fourth pixel group 55. The third pixel group 54 is disposed on a first column and first row position of the third section 57, the second pixel group 53 is disposed on a second column and first row position of the third section 57, the first pixel group 52 is disposed on a first column and second row position of the third section 57, the fourth pixel group 55 is disposed on a second column and second row position of the third section 57.

In the third section 57, the first pixel group 52, the second pixel group 53, the third pixel group 54 and the fourth pixel group 55 reach a white balance. Further, the second pixel group 53 and the fourth pixel group 55 in the first section 51 and the first pixel group 52 and the third pixel group 54 in the adjacent third section 57 arranged in a 2×2 matrix also can reach a white balance.

Figure 18:
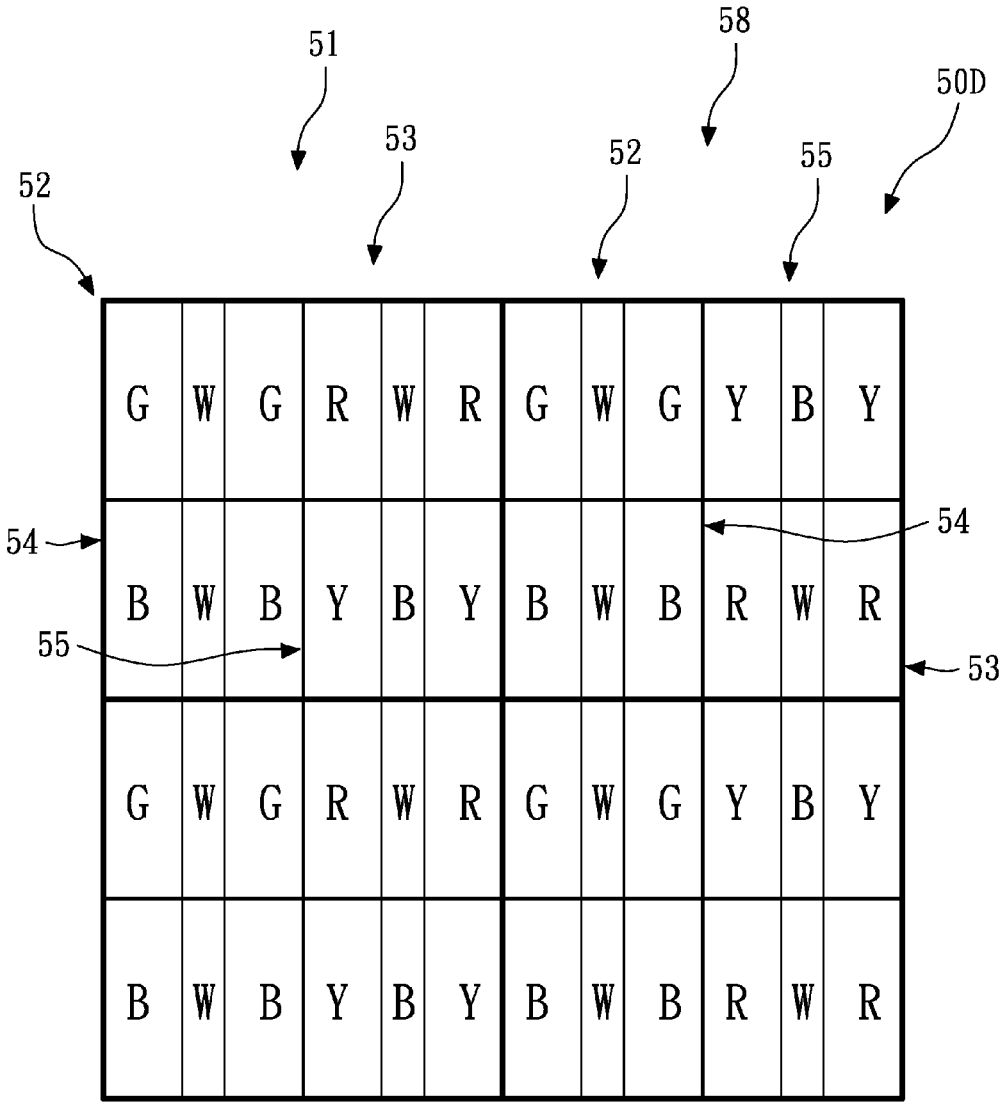
FIG. 18 shows the image device according to a sixteenth embodiment of the invention.

Referring to FIG. 18, it shows the image device according to a sixteenth embodiment of the invention. In this embodiment, the image device 50D comprises a plurality of first sections 51 and a plurality of fourth sections 58. Each fourth section 58 comprises the first pixel group 52, the second pixel group 53, the third pixel group 54 and the fourth pixel group 55. The first pixel group 52 is disposed on a first column and first row position of the fourth section 58, the fourth pixel group 55 is disposed on a second column and first row position of the fourth section 58, the third pixel group 54 is disposed on a first column and second row position of the fourth section 58, the second pixel group 53 is disposed on a second column and second row position of the fourth section 58.

In the fourth sections 58, the first pixel group 52, the second pixel group 53, the third pixel group 54 and the fourth pixel group 55 reach a white balance. Further, the second pixel group 53 and the fourth pixel group 55 in the first section 51 and the first pixel group 52 and the third pixel group 54 in the adjacent second section 58 arranged in a 2×2 matrix also can reach a white balance.

Figure 19:
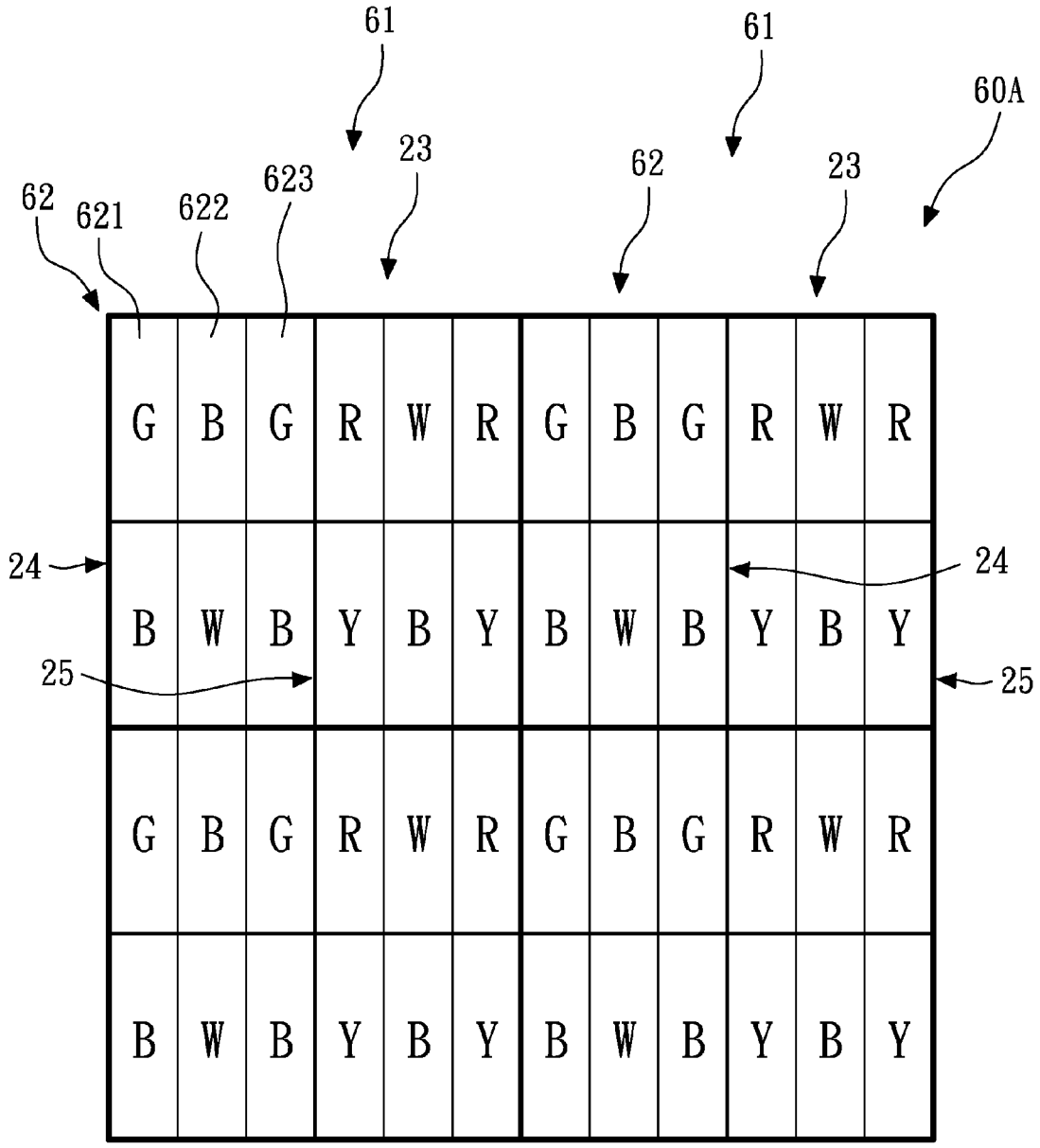
FIG. 19 shows the image device according to a seventeenth embodiment of the invention.

Referring to FIG. 19, it shows the image device according to a seventeenth embodiment of the invention. In this embodiment, the image device 60A comprises a plurality of thirteenth sections 61. Each thirteenth section 61 comprises the first pixel group 62, the second pixel group 23, the third pixel group 24 and the fourth pixel group 25. In this embodiment, the second pixel group 23, the third pixel group 24 and fourth pixel group 25 are the same as those in the first embodiment. The first pixel group 62 comprises two first color dots (G) 621, 623 and one fourth color dot (B) 622, the fourth color dot (B) 622 is disposed between the two first color dots (G) 621, 623.

The first pixel group 62 is disposed on a first column and first row position of the thirteenth section 61, the second pixel group 23 is disposed on a second column and first row position of the thirteenth section 61, the third pixel group 24 is disposed on a first column and second row position of the thirteenth section 61, the fourth pixel group 25 is disposed on a second column and second row position of the thirteenth section 61. In the thirteenth section 61, the first pixel group 62, the second pixel group 23, the third pixel group 24 and the fourth pixel group 25 reach a white balance. Further, the second pixel group 23 and the fourth pixel group 25 in the thirteenth section 61 and the first pixel group 62 and the third pixel group 24 in the adjacent thirteenth section 61 arranged in a 2×2 matrix also can reach a white balance.

Figure 20:
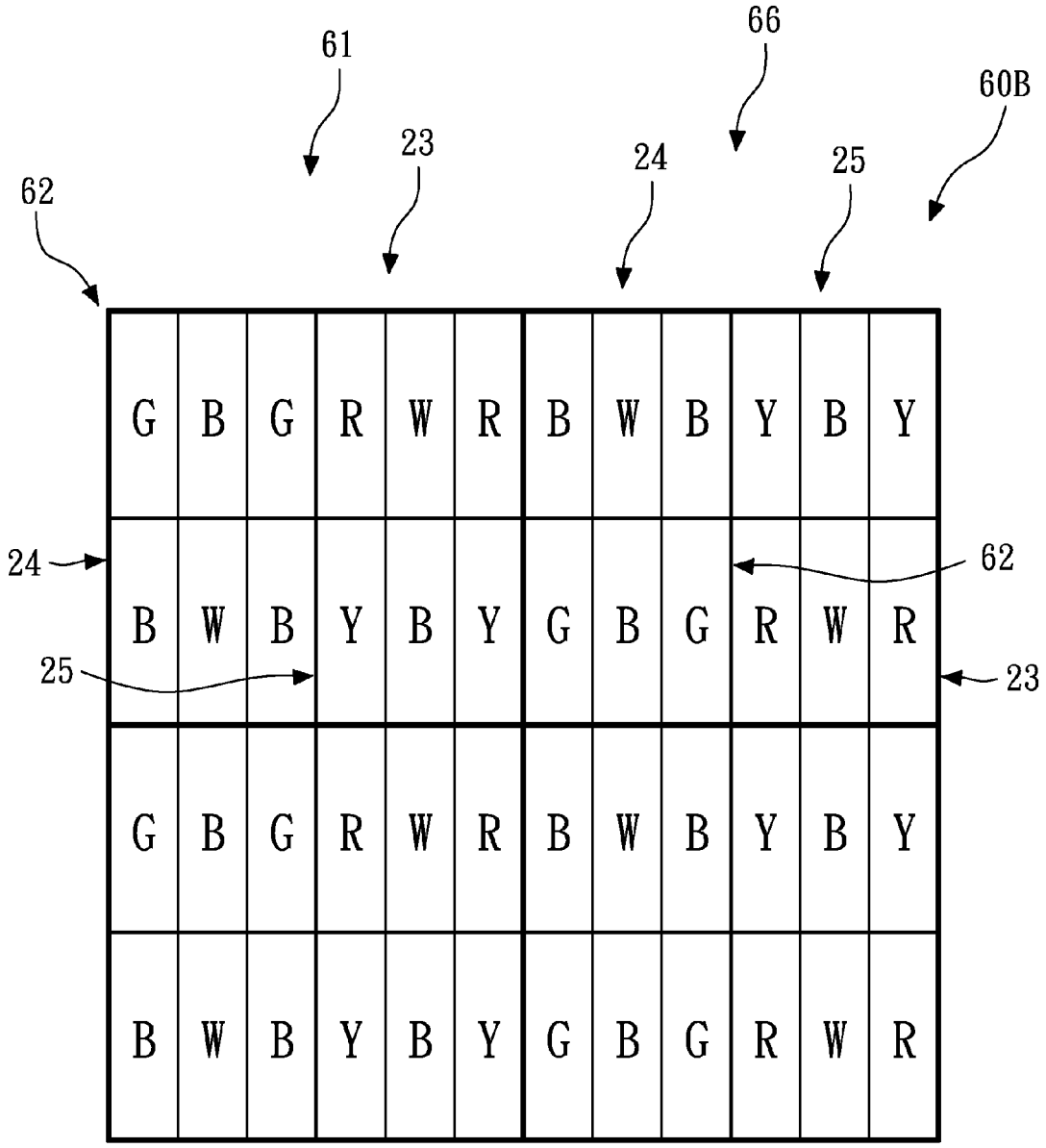
FIG. 20 shows the image device according to a eighteenth embodiment of the invention.

Referring to FIG. 20, it shows the image device according to a eighteenth embodiment of the invention. In this embodiment, the image device 60B comprises a plurality of thirteenth sections 61 and a plurality of fourteenth sections 66. Each fourteenth section 66 comprises the first pixel group 62, the second pixel group 23, the third pixel group 24 and the fourth pixel group 25. The third pixel group 24 is disposed on a first column and first row position of the fourteenth section 66, the fourth pixel group 25 is disposed on a second column and first row position of the fourteenth section 66, the first pixel group 62 is disposed on a first column and second row position of the fourteenth section 66, the second pixel group 23 is disposed on a second column and second row position of the fourteenth section 66.

In the fourteenth section 66, the first pixel group 62, the second pixel group 23, the third pixel group 24 and the fourth pixel group 25 reach a white balance. Further, the second pixel group 23 and the fourth pixel group 25 in the thirteenth section 61 and the first pixel group 62 and the third pixel group 24 in the adjacent fourteenth section 66 arranged in a 2×2 matrix also can reach a white balance.

Figure 21:
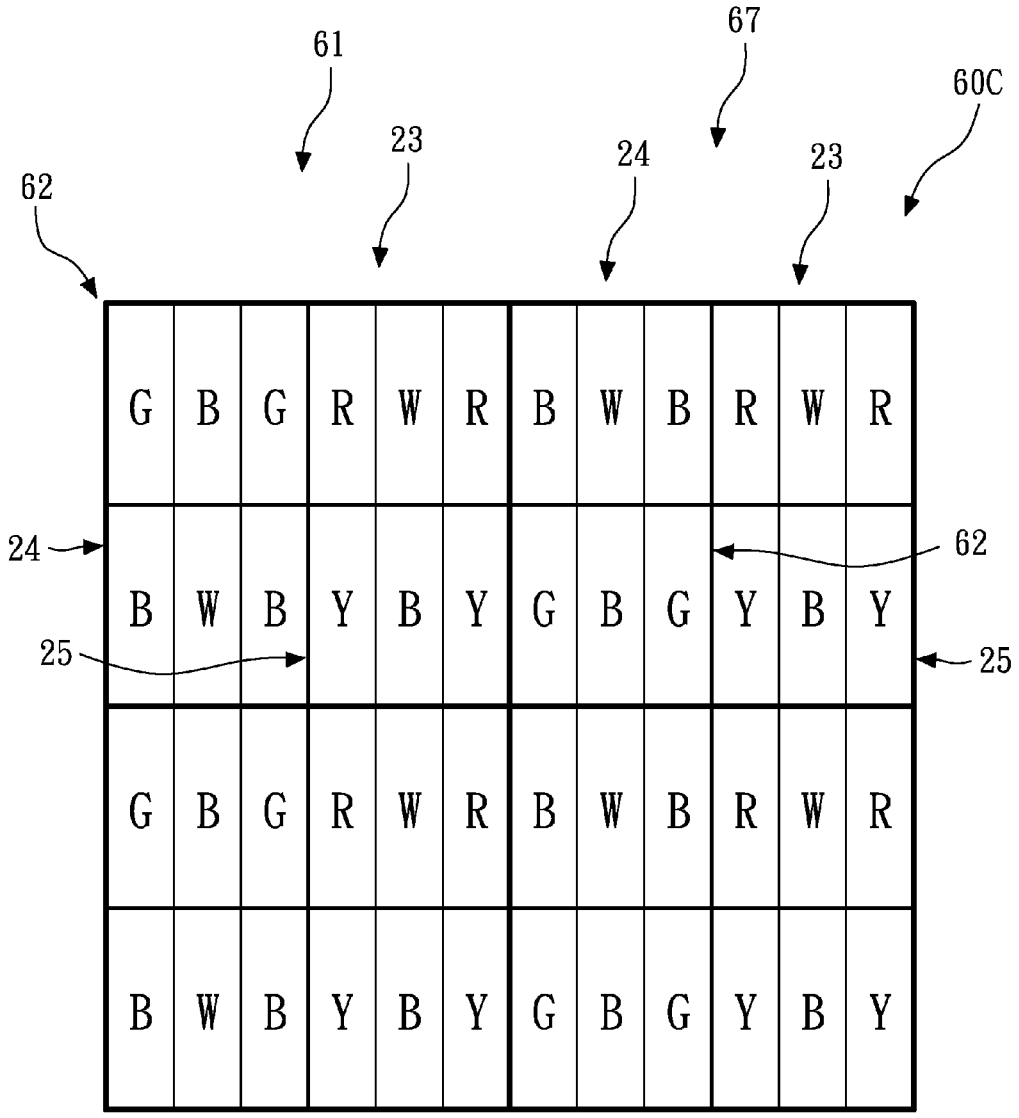
FIG. 21 shows the image device according to a nineteenth embodiment of the invention.

Referring to FIG. 21, it shows the image device according to a nineteenth embodiment of the invention. In this embodiment, the image device 60C comprises a plurality of thirteenth sections 61 and a plurality of fifteenth sections 67. Each fifteenth section 67 comprises the first pixel group 62, the second pixel group 23, the third pixel group 24 and the fourth pixel group 25. The third pixel group 24 is disposed on a first column and first row position of the fifteenth section 67, the second pixel group 23 is disposed on a second column and first row position of the fifteenth section 67, the first pixel group 62 is disposed on a first column and second row position of the fifteenth section 67, the fourth pixel group 25 is disposed on a second column and second row position of the fifteenth section 67.

In the fifteenth section 67, the first pixel group 62, the second pixel group 23, the third pixel group 24 and the fourth pixel group 25 reach a white balance. Further, the second pixel group 23 and the fourth pixel group 25 in the thirteenth section 61 and the first pixel group 62 and the third pixel group 24 in the adjacent fifteenth section 67 arranged in a 2×2 matrix also can reach a white balance.

Figure 22:
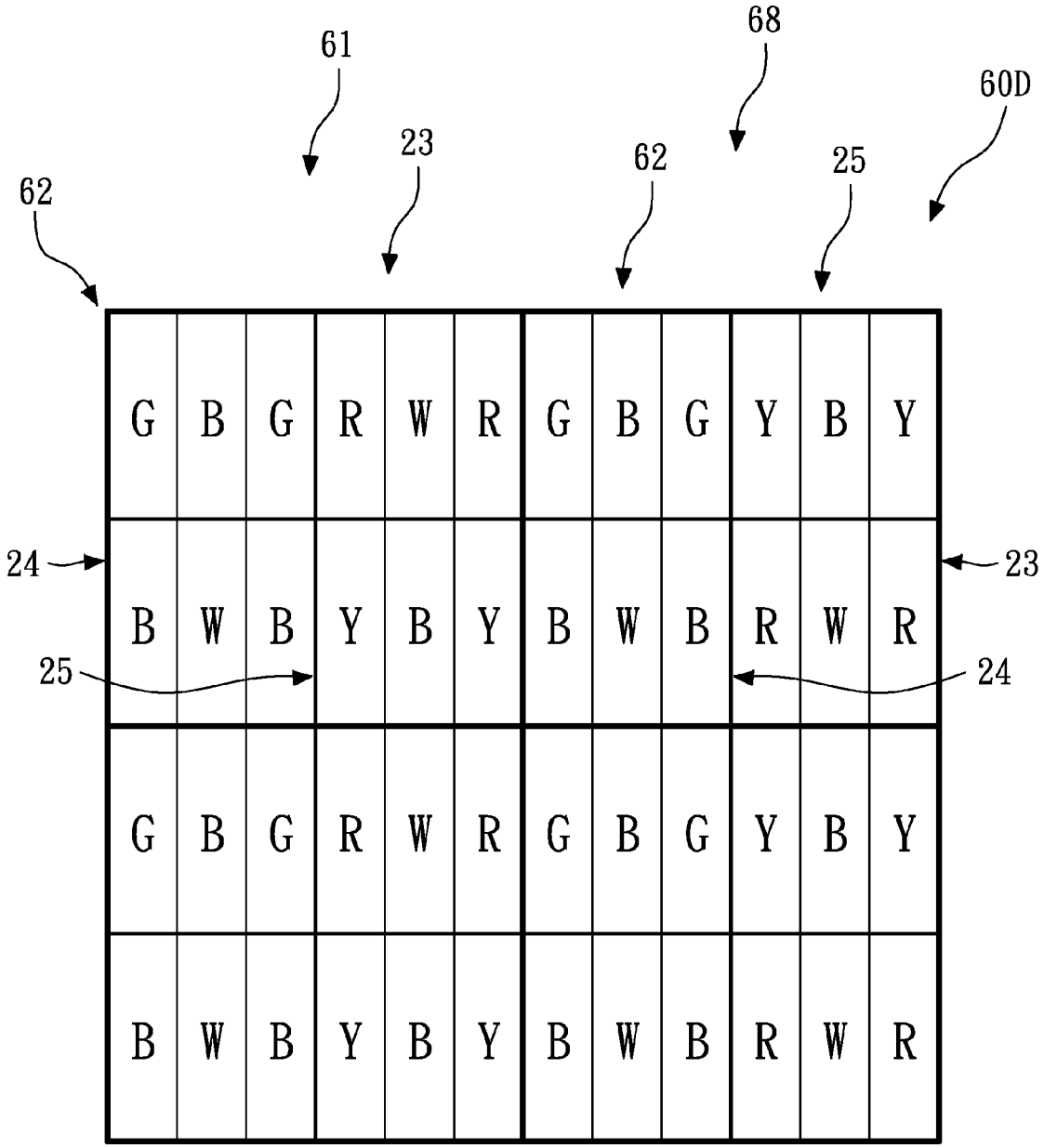
FIG. 22 shows the image device according to a twentieth embodiment of the invention.

Referring to FIG. 22, it shows the image device according to a twentieth embodiment of the invention. In this embodiment, the image device 60D comprises a plurality of thirteenth sections 61 and a plurality of sixteenth sections 68. Each sixteenth section 68 comprises the first pixel group 62, the second pixel group 23, the third pixel group 24 and the fourth pixel group 25. The first pixel group 62 is disposed on a first column and first row position of the sixteenth section 68, the fourth pixel group 25 is disposed on a second column and first row position of the sixteenth section 68, the third pixel group 24 is disposed on a first column and second row position of the sixteenth section 68, the second pixel group 23 is disposed on a second column and second row position of the sixteenth section 68.

In the sixteenth section 68, the first pixel group 62, the second pixel group 23, the third pixel group 24 and the fourth pixel group 25 reach a white balance. Further, the second pixel group 23 and the fourth pixel group 25 in the thirteenth section 61 and the first pixel group 62 and the third pixel group 24 in the adjacent sixteenth section 68 arranged in a 2×2 matrix also can reach a white balance.

Figure 23:
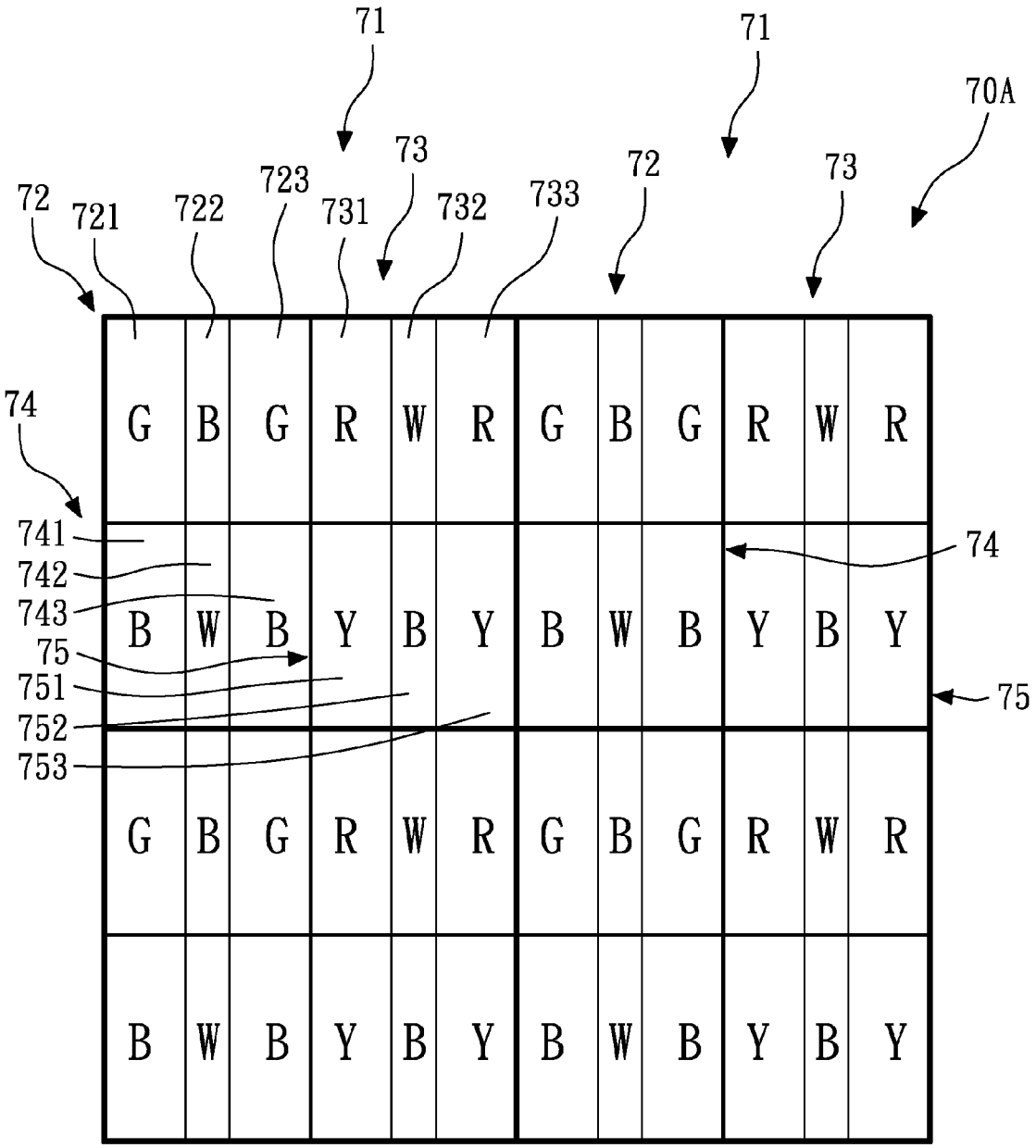
FIG. 23 shows the image device according to a twenty-first embodiment of the invention.

Referring to FIG. 23, it shows the image device according to a twenty-first embodiment of the invention. In this embodiment, the image device 70A comprises a plurality of thirteenth sections 71. The thirteenth section 71 includes a first pixel group 72, a second pixel group 73, a third pixel group 74 and a fourth pixel group 75. The first pixel group 72 includes two first color dots (G) 721, 723 and a fourth color dot (B) 722, the second pixel group 73 includes two third color dots (R) 731, 733 and the second color dot (W) 732, the third pixel group 74 includes two fourth color dots (B) 741, 743 and the second color dot (W) 742, and the fourth pixel group 75 includes two fifth color dots (Y) 751, 753 and the fourth color dot (B) 753.

The differences between the seventeenth embodiment in FIG. 19 and the twenty-first embodiment in FIG. 23 are: an area of the fourth color dot 722 is smaller than that of the first color dots 721, 723 in the first pixel group 72, an area of the second color dot 732 is smaller than that of the third color dots 731, 733 in the second pixel group 73, and an area of the second color dot 742 is smaller than that of the fourth color dots 741, 743 in the third pixel group 74; an area of the fourth color dot 752 is smaller than that of the fifth color dots 751, 753 in the fourth pixel group 75.

In this embodiment, in the thirteenth section 71, the first pixel group 72, the second pixel group 73, the third pixel group 74 and the fourth pixel group 75 reach a white balance. Further, the second pixel group 73 and the fourth pixel group 75 in the first section 71 and the first pixel group 72 and the third pixel group 74 in the adjacent thirteenth section 71 arranged in a 2×2 matrix also can reach a white balance.

Figure 24:
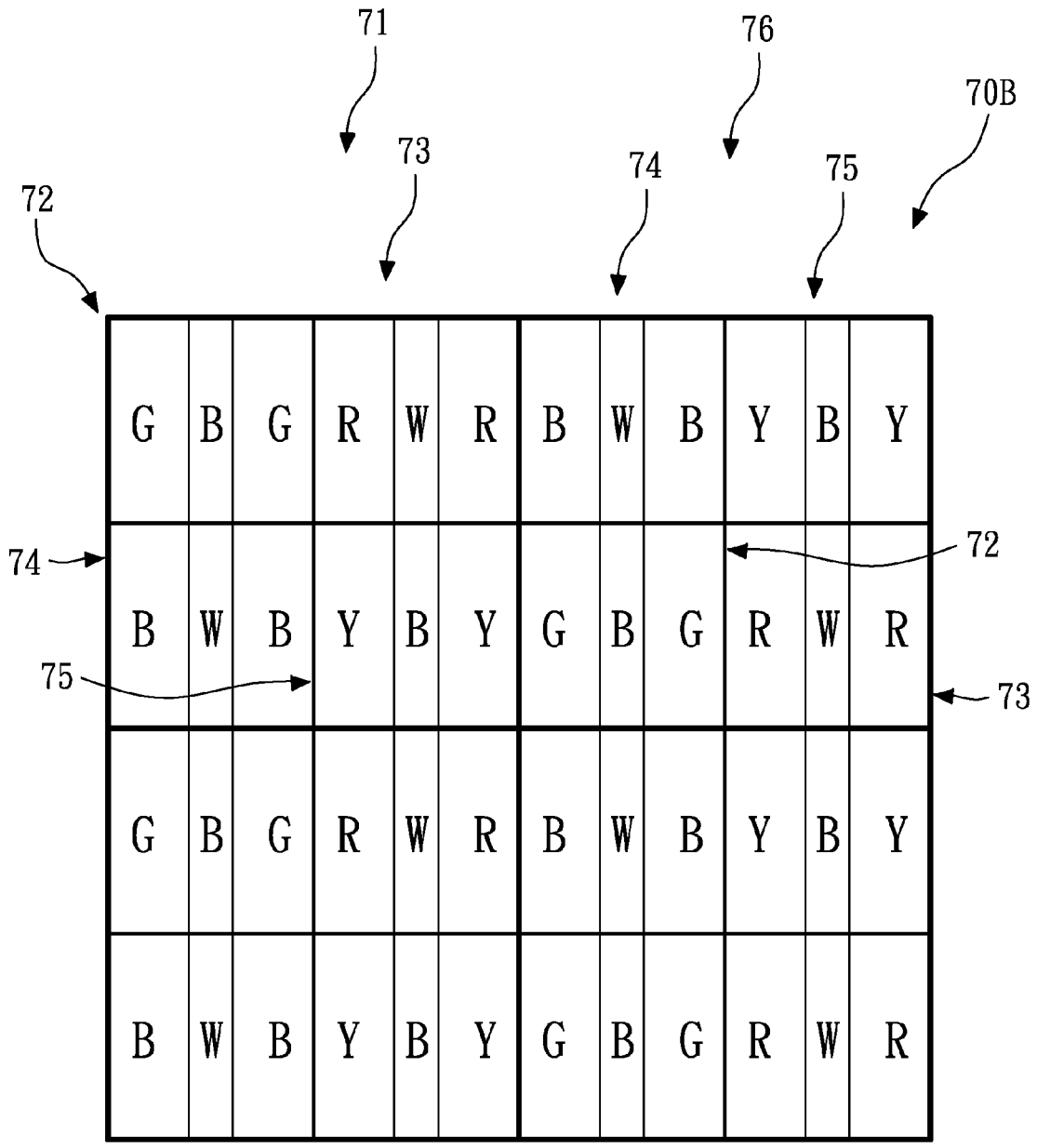
FIG. 24 shows the image device according to a twenty-second embodiment of the invention.

Referring to FIG. 24, it shows the image device according to a twenty-second embodiment of the invention. In this embodiment, the image device 70B comprises a plurality of thirteenth sections 71 and a plurality of fourteenth sections 76. Each fourteenth section 76 comprises the first pixel group 72, the second pixel group 73, the third pixel group 74 and the fourth pixel group 75. The third pixel group 74 is disposed on a first column and first row position of the fourteenth section 76, the fourth pixel group 75 is disposed on a second column and first row position of the fourteenth section 76, the first pixel group 72 is disposed on a first column and second row position of the fourteenth section 76, the second pixel group 73 is disposed on a second column and second row position of the fourteenth section 76.

In the fourteenth sections 76, the first pixel group 72, the second pixel group 73, the third pixel group 74 and the fourth pixel group 75 reach a white balance. Further, the second pixel group 73 and the fourth pixel group 75 in the thirteenth section 71 and the first pixel group 72 and the third pixel group 74 in the adjacent fourteenth section 76 arranged in a 2×2 matrix also can reach a white balance.

Figure 25:
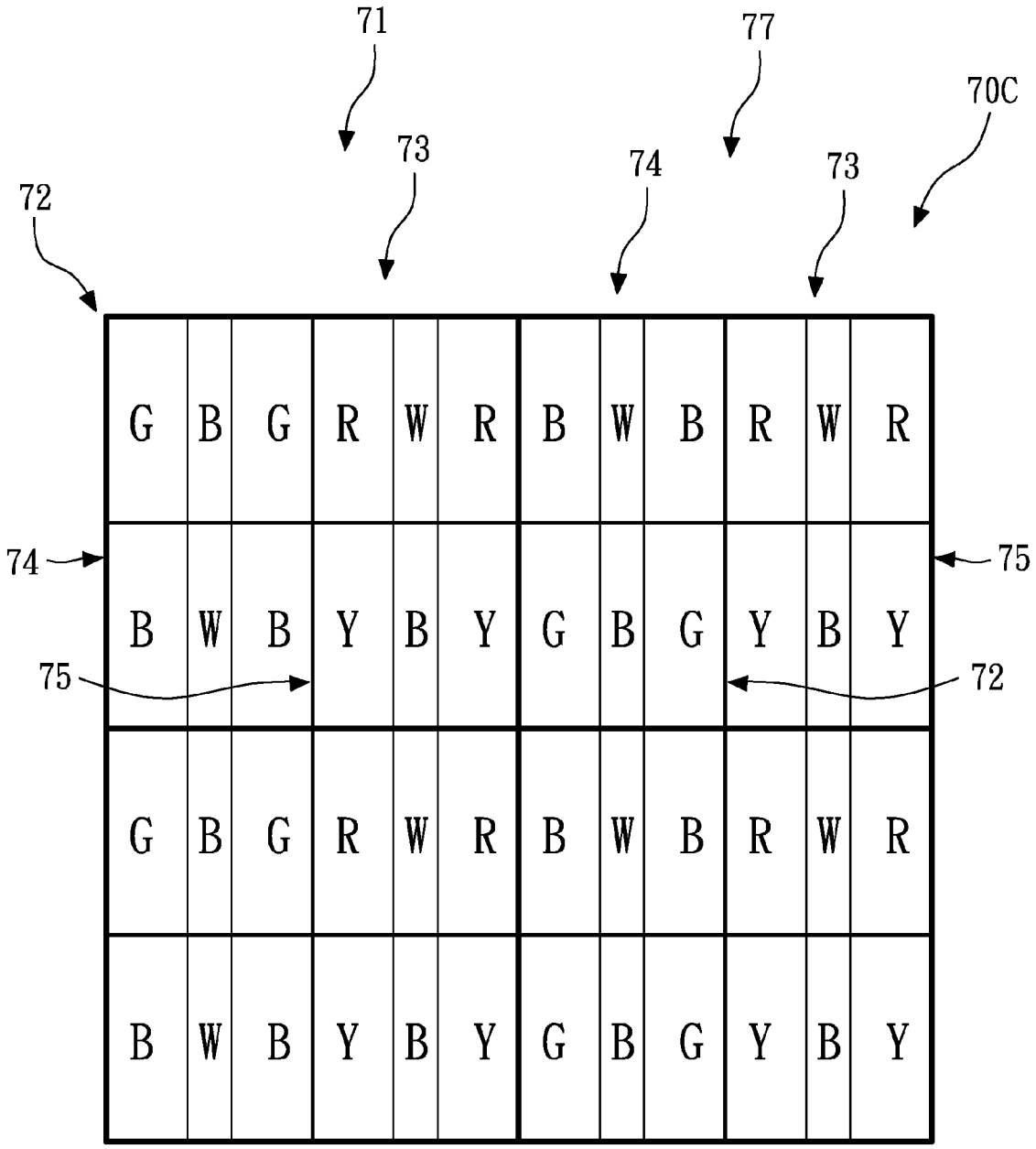
FIG. 25 shows the image device according to a twenty-third embodiment of the invention.

Referring to FIG. 25, it shows the image device according to a twenty-third embodiment of the invention. In this embodiment, the image device 70C comprises a plurality of thirteenth sections 71 and a plurality of fifteenth sections 77. Each fifteenth section 77 comprises the first pixel group 72, the second pixel group 73, the third pixel group 74 and the fourth pixel group 75. The third pixel group 74 is disposed on a first column and first row position of the fifteenth section 77, the second pixel group 73 is disposed on a second column and first row position of the fifteenth section 77, the first pixel group 72 is disposed on a first column and second row position of the fifteenth section 77, the fourth pixel group 75 is disposed on a second column and second row position of the fifteenth section 77.

In the fifteenth section 77, the first pixel group 72, the second pixel group 73, the third pixel group 74 and the fourth pixel group 75 reach a white balance. Further, the second pixel group 73 and the fourth pixel group 75 in the thirteenth section 71 and the first pixel group 72 and the third pixel group 74 in the adjacent fifteenth section 77 arranged in a 2×2 matrix also can reach a white balance.

Figure 26:
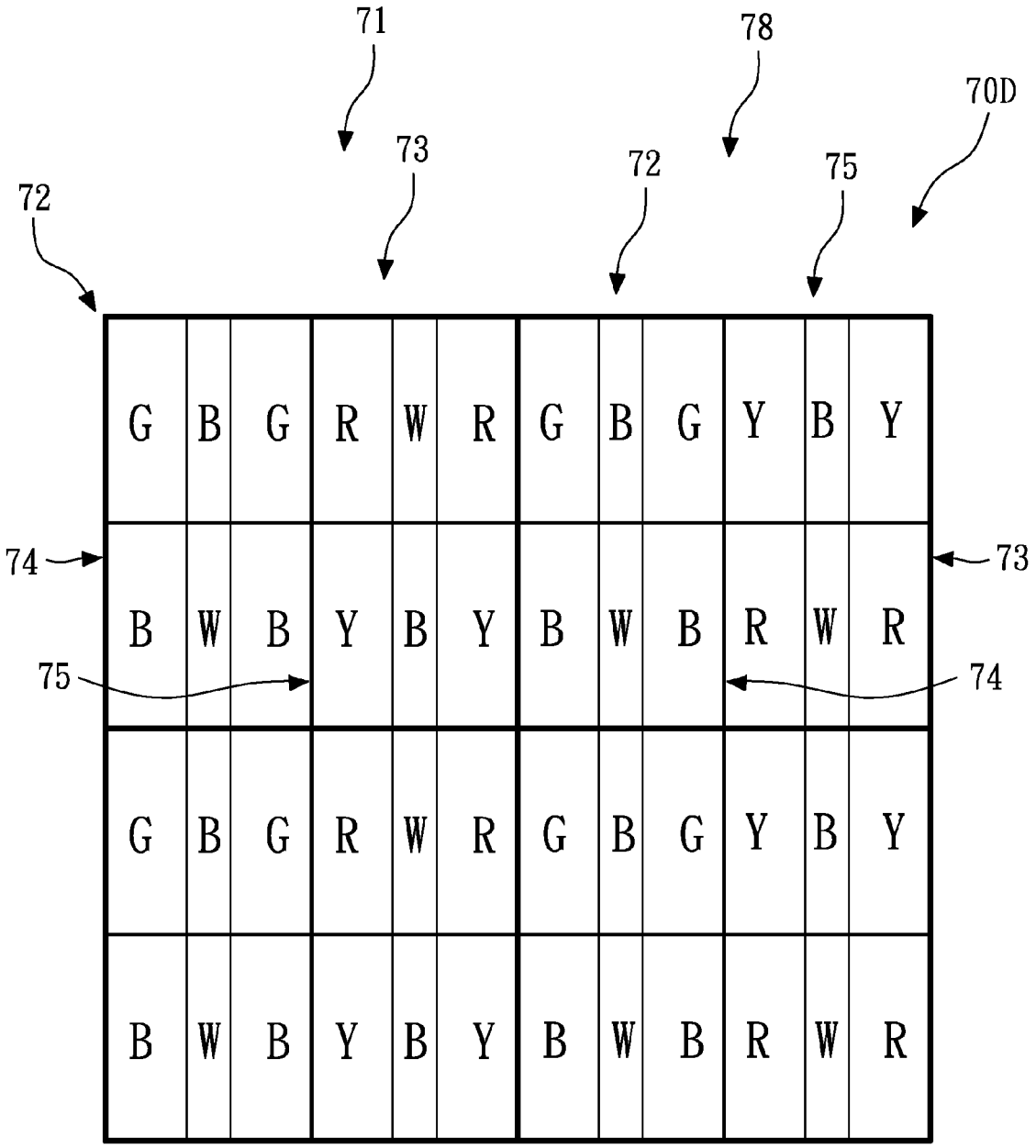
FIG. 26 shows the image device according to a twenty-fourth embodiment of the invention.

Referring to FIG. 26, it shows the image device according to a twenty-fourth embodiment of the invention. In this embodiment, the image device 70D comprises a plurality of thirteenth sections 71 and a plurality of sixteenth sections 78. Each sixteenth section 78 comprises the first pixel group 72, the second pixel group 73, the third pixel group 74 and the fourth pixel group 75. The first pixel group 72 is disposed on a first column and first row position of the sixteenth section 78, the fourth pixel group 75 is disposed on a second column and first row position of the sixteenth section 78, the third pixel group 74 is disposed on a first column and second row position of the sixteenth section 78, the second pixel group 73 is disposed on a second column and second row position of the sixteenth section 78.

In the sixteenth section 78, the first pixel group 72, the second pixel group 73, the third pixel group 74 and the fourth pixel group 75 reach a white balance. Further, the second pixel group 73 and the fourth pixel group 75 in the thirteenth section 71 and the first pixel group 72 and the third pixel group 74 in the adjacent sixteenth section 78 arranged in a 2×2 matrix also can reach a white balance.

Figure 27:
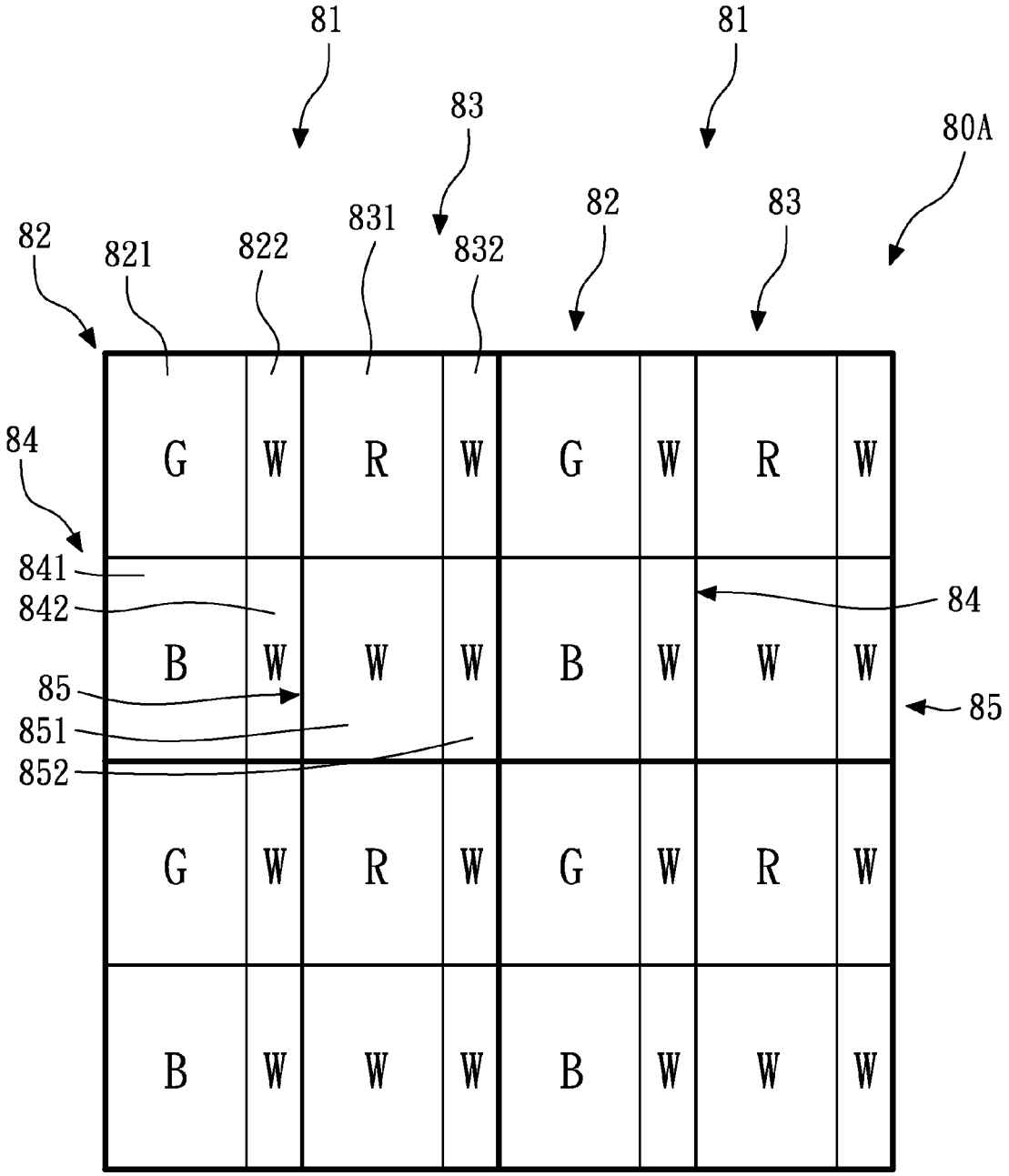
FIG. 27 shows the image device according to a twenty-fifth embodiment of the invention.

Referring to FIG. 27, it shows the image device according to a twenty-fifth embodiment of the invention. In this embodiment, the image device 80A comprises a plurality of seventeenth sections 81. The seventeenth section 81 includes a first pixel group 82, a second pixel group 83, a third pixel group 84 and a fourth pixel group 85. The first pixel group 82 comprises one first color dot (G) 821 and one second color dot (W) 822, an area of the first color dot (G) 821 is bigger than that of the second color dot (W) 822. The second pixel group 83 comprises one third color dot (R) 831 and one second color dot (W) 832, an area of the third color dot (R) 831 is bigger than that of the second color dot (W) 832. The third pixel group 84 comprises one fourth color dot (B) 841 and one second color dot (W) 842, an area of the fourth color dot (B) 841 is bigger than that of the second color dot (W) 842. The fourth pixel group 85 comprises two second color dots (W) 851, 852, an area of one of two second color dots (W) 851 is bigger than that of the other second color dot (W) 852. The area of the first pixel group 82, the second pixel group 83, the third pixel group 84 or the fourth pixel group 85 is the same as that of the conventional RGB pixel group.

The first pixel group 82 is disposed on a first column and first row position of the seventeenth section 81, the second pixel group 83 is disposed on a second column and first row position of the seventeenth section 81, the third pixel group 84 is disposed on a first column and second row position of the seventeenth section 81, the fourth pixel group 85 is disposed on a second column and second row position of the seventeenth section 81.

In this embodiment, in the seventeenth section 81, the first pixel group 82, the second pixel group 83, the third pixel group 84 and the fourth pixel group 85 reach a white balance. Further, the second pixel group 83 and the fourth pixel group 85 in the seventeenth section 81 and the first pixel group 82 and the third pixel group 84 in the adjacent seventeenth section 81 arranged in a 2×2 matrix also can reach a white balance.

Figure 28:
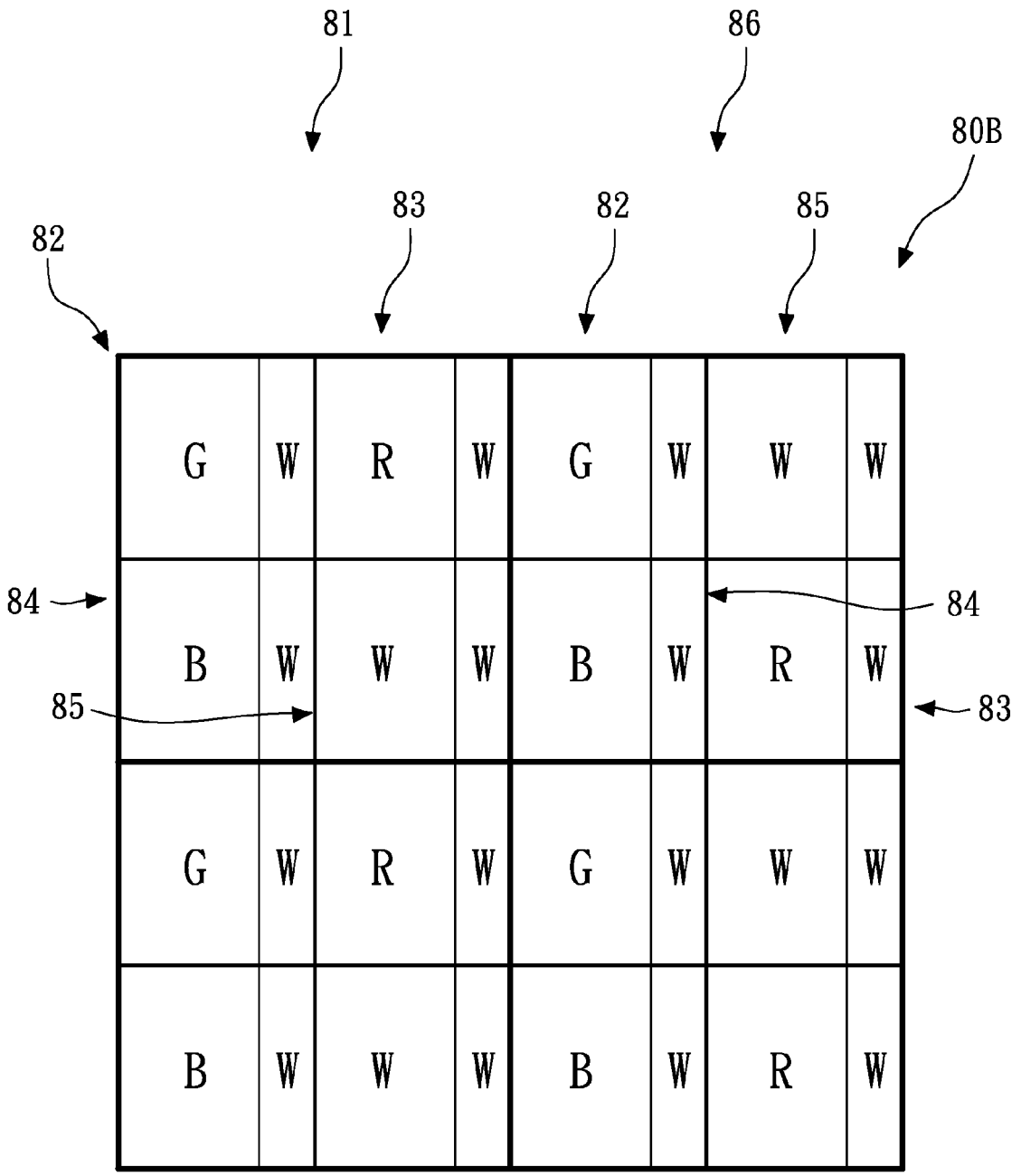
FIG. 28 shows the image device according to a twenty-sixth embodiment of the invention.

Referring to FIG. 28, it shows the image device according to a twenty-sixth embodiment of the invention. In this embodiment, the image device 80B comprises a plurality of seventeenth sections 81 and a plurality of eighteenth sections 86. Each eighteenth section 86 comprises the first pixel group 82, the second pixel group 83, the third pixel group 84 and the fourth pixel group 85. The first pixel group 82 is disposed on a first column and first row position of the eighteenth section 86, the fourth pixel group 85 is disposed on a second column and first row position of the eighteenth section 86, the third pixel group 84 is disposed on a first column and second row position of the eighteenth section 86, the second pixel group 83 is disposed on a second column and second row position of the eighteenth section 86.

In the eighteenth section 86, the first pixel group 82, the second pixel group 83, the third pixel group 84 and the fourth pixel group 85 reach a white balance. Further, the second pixel group 83 and the fourth pixel group 85 in the seventeenth section 81 and the first pixel group 82 and the third pixel group 84 in the adjacent eighteenth section 86 arranged in a 2×2 matrix also can reach a white balance.

Figure 29:
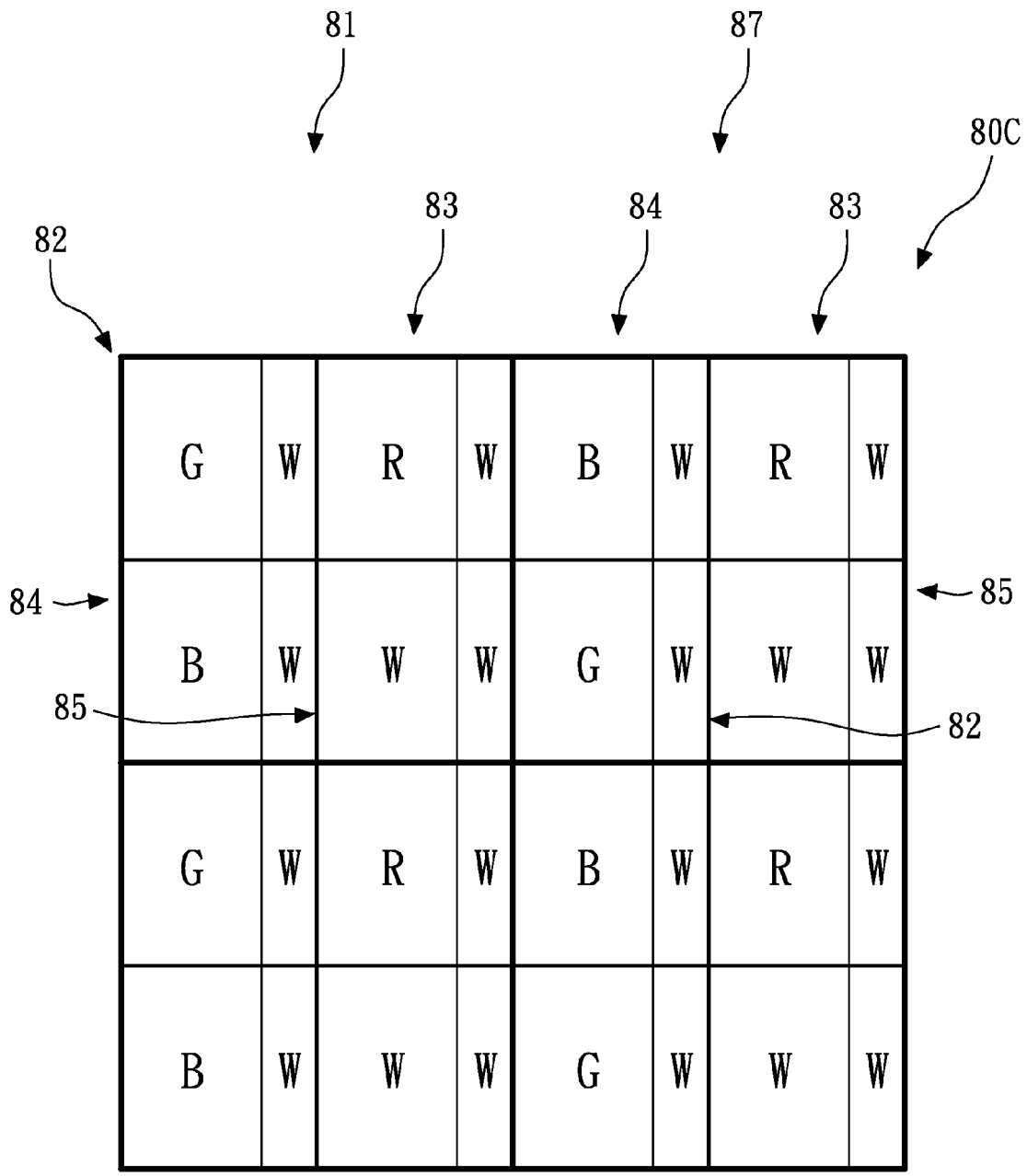
FIG. 29 shows the image device according to a twenty-seventh embodiment of the invention.

Referring to FIG. 29, it shows the image device according to a twenty-seventh embodiment of the invention. In this embodiment, the image device 80C comprises a plurality of seventeenth sections 81 and a plurality of nineteenth sections 87. Each nineteenth section 87 comprises the first pixel group 82, the second pixel group 83, the third pixel group 84 and the fourth pixel group 85. The third pixel group 84 is disposed on a first column and first row position of the nineteenth section 87, the second pixel group 83 is disposed on a second column and first row position of the nineteenth section 87, the first pixel group 82 is disposed on a first column and second row position of the nineteenth section 87, the fourth pixel group 85 is disposed on a second column and second row position of the nineteenth section 87.

In the nineteenth section 87, the first pixel group 82, the second pixel group 83, the third pixel group 84 and the fourth pixel group 85 reach a white balance. Further, the second pixel group 83 and the fourth pixel group 85 in the seventeenth section 81 and the first pixel group 82 and the third pixel group 84 in the adjacent nineteenth section 87 arranged in a 2×2 matrix also can reach a white balance.

Figure 30:
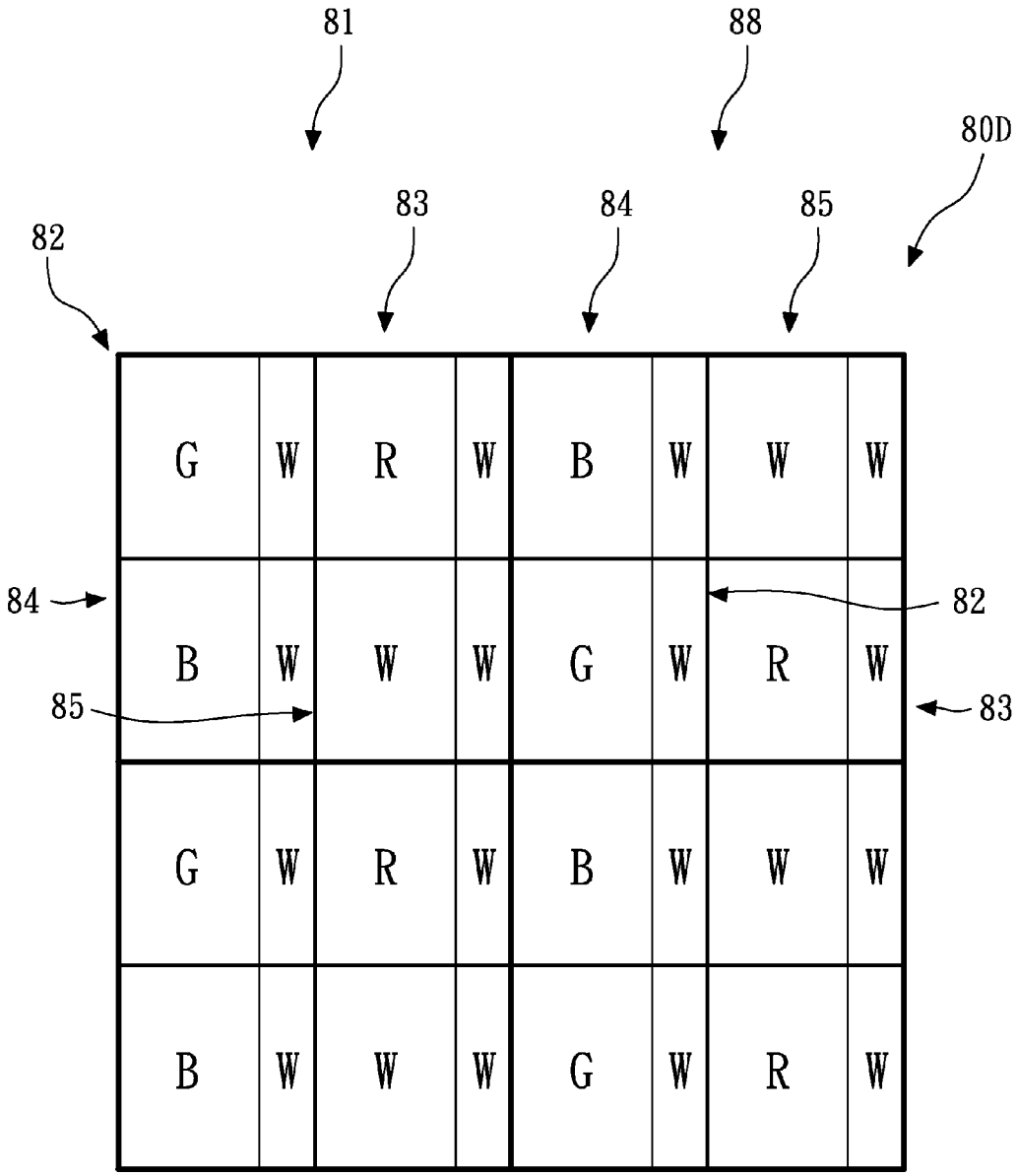
FIG. 30 shows the image device according to a twenty-eighth embodiment of the invention.

Referring to FIG. 30, it shows the image device according to a twenty-eighth embodiment of the invention. In this embodiment, the image device 80D comprises a plurality of seventeenth sections 81 and a plurality of twentieth sections 88. Each twentieth section 88 comprises the first pixel group 82, the second pixel group 83, the third pixel group 84 and the fourth pixel group 85. The third pixel group 84 is disposed on a first column and first row position of the twentieth section 88, the fourth pixel group 85 is disposed on a second column and first row position of the twentieth section 88, the first pixel group 82 is disposed on a first column and second row position of the twentieth section 88, the second pixel group 83 is disposed on a second column and second row position of the twentieth section 88.

In the twentieth section 88, the first pixel group 82, the second pixel group 83, the third pixel group 84 and the fourth pixel group 85 reach a white balance. Further, the second pixel group 83 and the fourth pixel group 85 in the seventeenth section 81 and the first pixel group 82 and the third pixel group 84 in the adjacent twentieth section 88 arranged in a 2×2 matrix also can reach a white balance.

Figure 31:
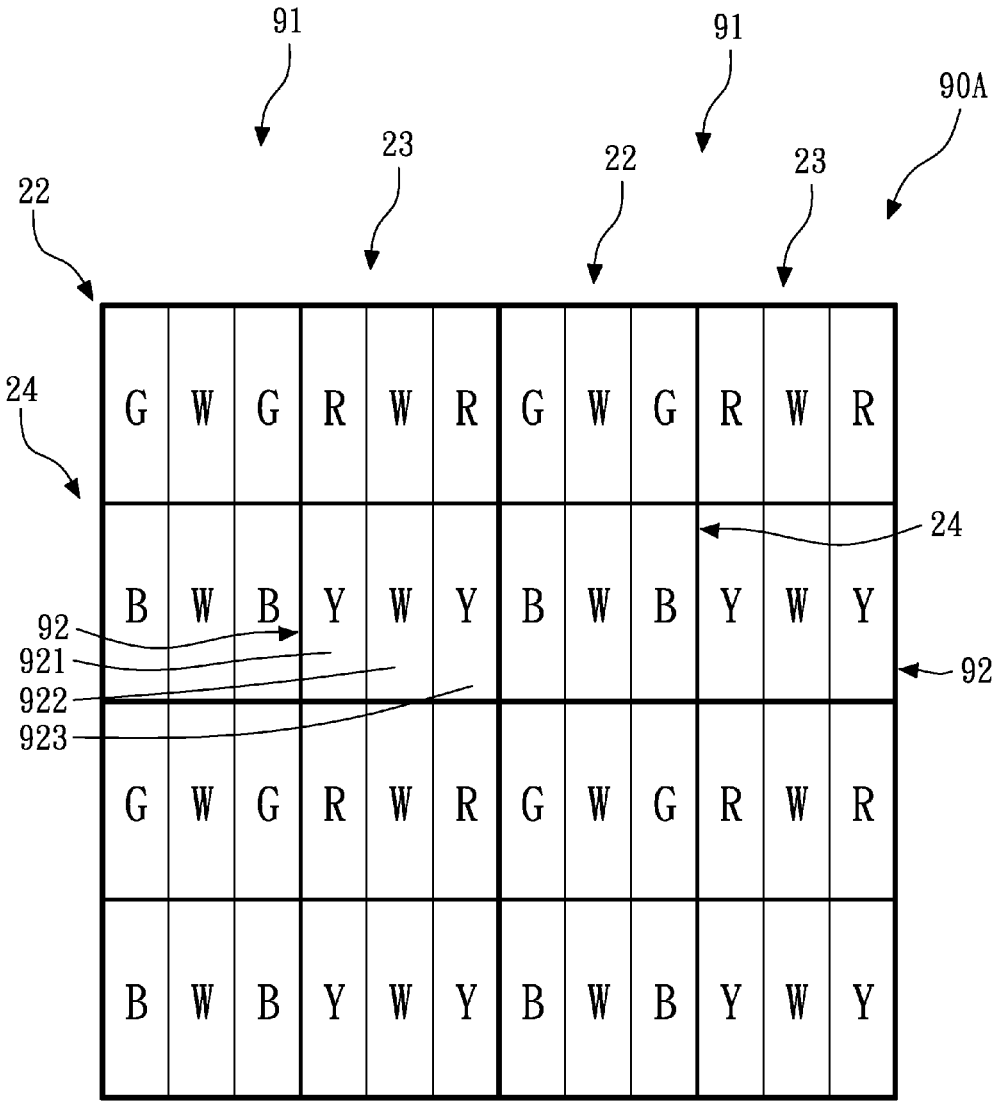
FIG. 31 shows the image device according to a twenty-ninth embodiment of the invention.

Referring to FIG. 31, it shows the image device according to a twenty-ninth embodiment of the invention. In this embodiment, the image device 90A comprises a plurality of twenty-first sections 91. Each twenty-first section 91 comprises the first pixel group 22, the second pixel group 23, the third pixel group 24 and the fourth pixel group 92. In this embodiment, the first pixel group 22, the second pixel group 23, the third pixel group 24 are the same as those in the above embodiment. The fourth pixel group 92 comprises two fifth color dots (Y) 921, 923 and one second color dot (W) 922, the second color dot (W) 922 is disposed between the two fifth color dots (Y) 921, 923 in the fourth pixel group 92 and the fifth color dot is a yellow color dot.

In this embodiment, the first pixel group 22 is disposed on a first column and first row position of the twenty-first section 91, the second pixel group 23 is disposed on a second column and first row position of the twenty-first section 91, the third pixel group 24 is disposed on a first column and second row position of the twenty-first section 91, the fourth pixel group 92 is disposed on a second column and second row position of the twenty-first section 91. In the twenty-first section 91, the first pixel group 22, the second pixel group 23, the third pixel group 24 and the fourth pixel group 92 reach a white balance. Further, the second pixel group 23 and the fourth pixel group 92 in the twenty-first section 91 and the first pixel group 22 and the third pixel group 24 in the adjacent twenty-first section 91 arranged in a 2×2 matrix also can reach a white balance.

Figure 32:
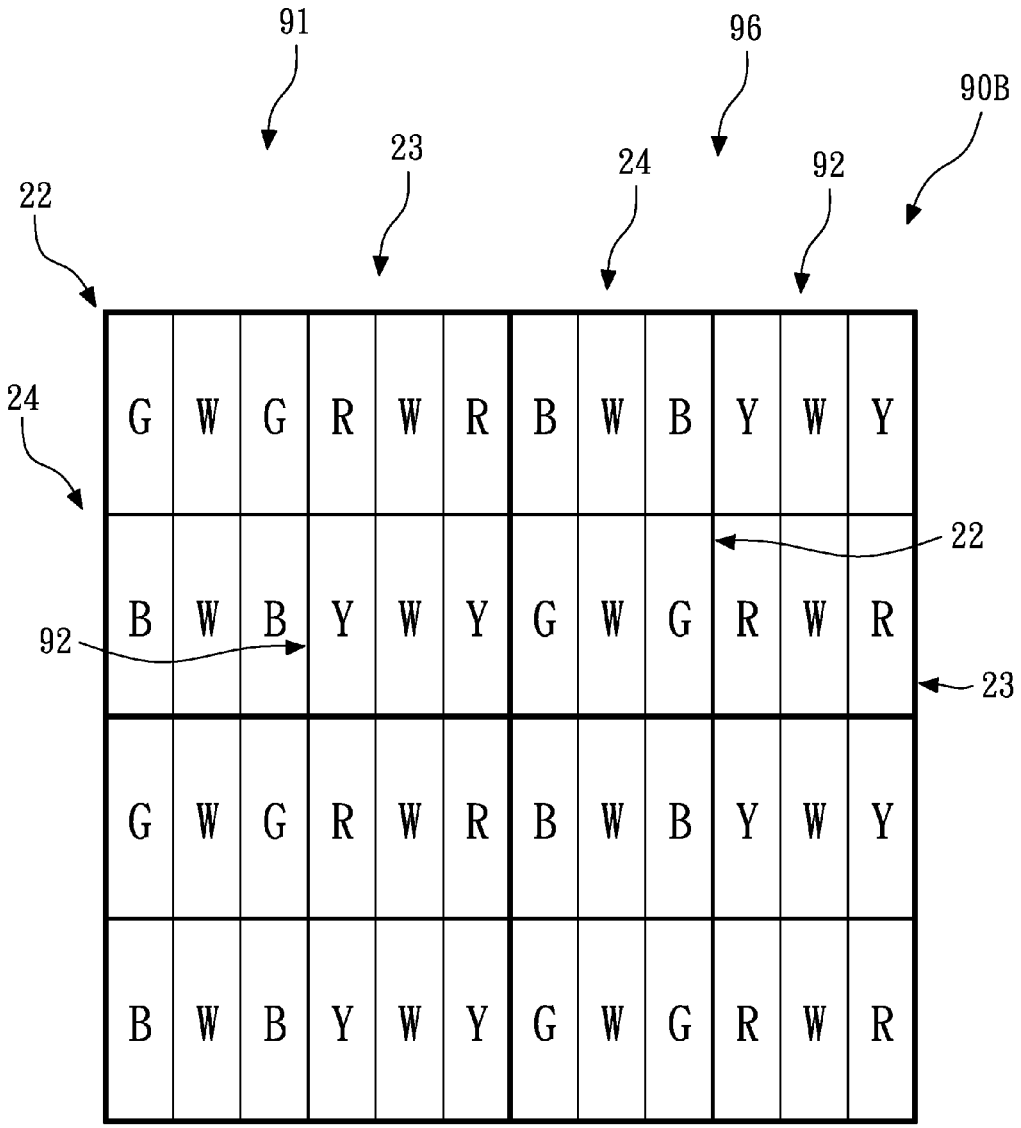
FIG. 32 shows the image device according to a thirtieth embodiment of the invention.

Referring to FIG. 32, it shows the image device according to a thirtieth embodiment of the invention. In this embodiment, the image device 90B comprises a plurality of twenty-first sections 91 and a plurality of twenty-second sections 96. Each twenty-second section 96 comprises the first pixel group 22, the second pixel group 23, the third pixel group 24 and the fourth pixel group 92. The third pixel group 24 is disposed on a first column and first row position of the twenty-second section 96, the fourth pixel group 92 is disposed on a second column and first row position of the twenty-second section 96, the first pixel group 22 is disposed on a first column and second row position of the twenty-second section 96, the second pixel group 23 is disposed on a second column and second row position of the twenty-second section 96.

In the twenty-second sections 96, the first pixel group 22, the second pixel group 23, the third pixel group 24 and the fourth pixel group 92 reach a white balance. Further, the second pixel group 23 and the fourth pixel group 92 in the twenty-first section 91 and the first pixel group 22 and the third pixel group 24 in the adjacent twenty-second section 96 arranged in a 2×2 matrix also can reach a white balance.

Figure 33:
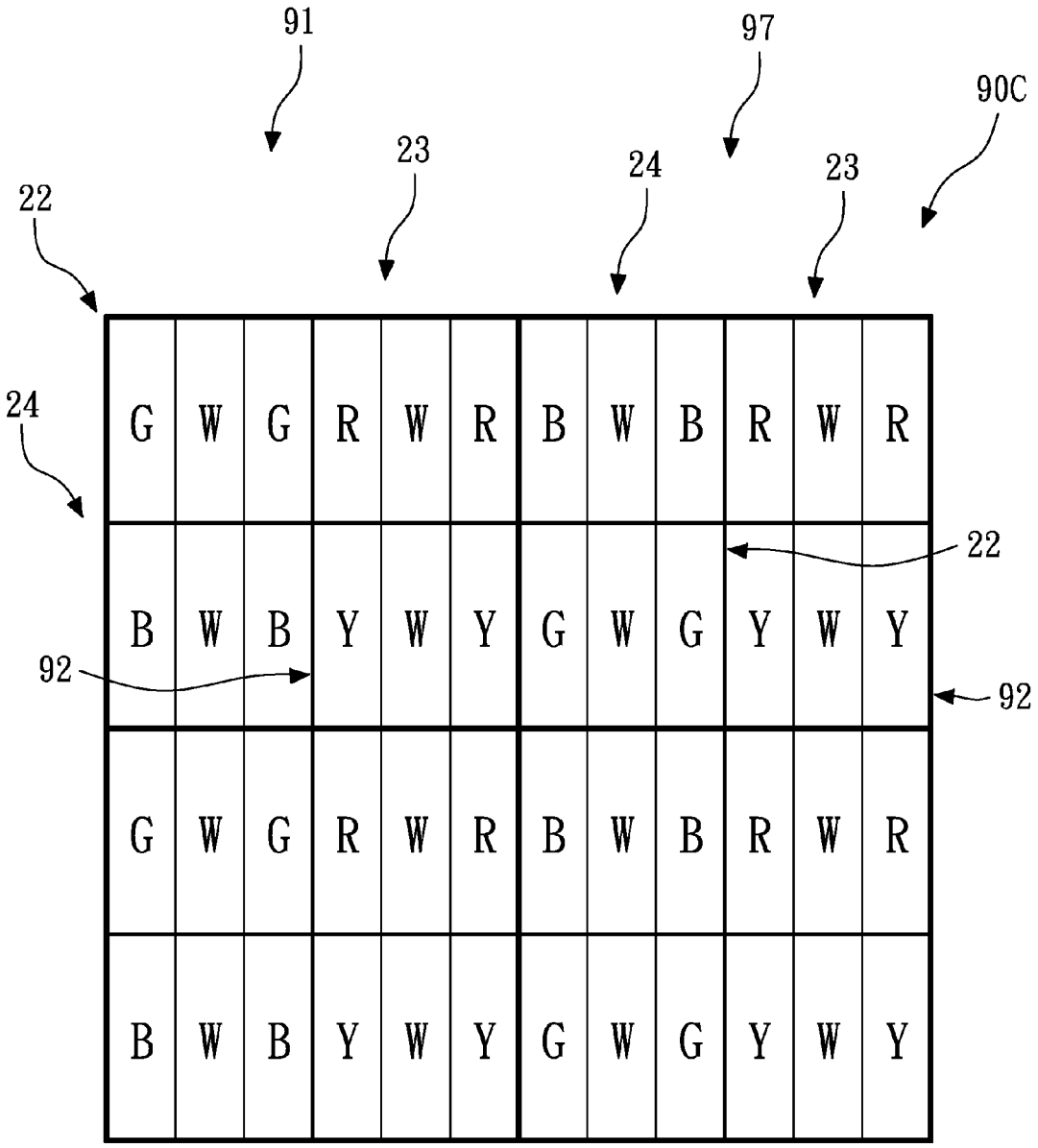
FIG. 33 shows the image device according to a thirtieth-first embodiment of the invention.

Referring to FIG. 33, it shows the image device according to a thirtieth-first embodiment of the invention. In this embodiment, the image device 90C comprises a plurality of twenty-first sections 91 and a plurality of twenty-third sections 97. Each twenty-third section 97 comprises the first pixel group 22, the second pixel group 23, the third pixel group 24 and the fourth pixel group 92. The third pixel group 24 is disposed on a first column and first row position of the twenty-third section 97, the second pixel group 23 is disposed on a second column and first row position of the twenty-third section 97, the first pixel group 22 is disposed on a first column and second row position of the twenty-third section 97, the fourth pixel group 92 is disposed on a second column and second row position of the twenty-third section 97.

In the twenty-third section 97, the first pixel group 22, the second pixel group 23, the third pixel group 24 and the fourth pixel group 92 reach a white balance. Further, the second pixel group 23 and the fourth pixel group 92 in the twenty-first section 91 and the first pixel group 22 and the third pixel group 24 in the adjacent twenty-third section 97 arranged in a 2×2 matrix also can reach a white balance.

Figure 34:
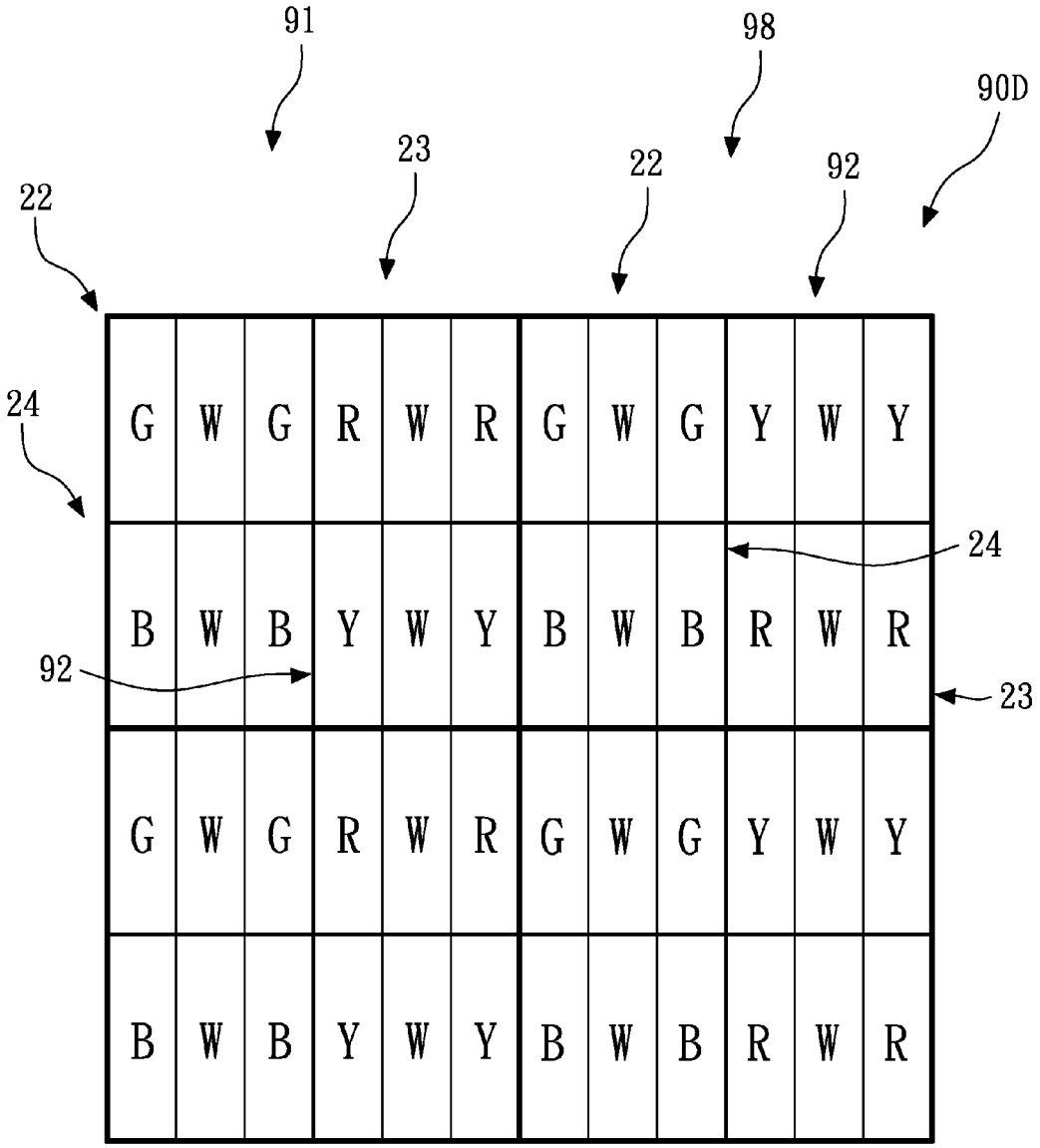
FIG. 34 shows the image device according to a thirtieth-second embodiment of the invention.

Referring to FIG. 34, it shows the image device according to a thirtieth-second embodiment of the invention. In this embodiment, the image device 90D comprises a plurality of twenty-first sections 91 and a plurality of twenty-fourth sections 98. Each twenty-fourth section 98 comprises the first pixel group 22, the second pixel group 23, the third pixel group 24 and the fourth pixel group 92. The first pixel group 22 is disposed on a first column and first row position of the twenty-fourth section 98, the fourth pixel group 92 is disposed on a second column and first row position of the twenty-fourth section 98, the third pixel group 24 is disposed on a first column and second row position of the twenty-fourth section 98, the second pixel group 23 is disposed on a second column and second row position of the twenty-fourth section 98.

In the twenty-fourth section 98, the first pixel group 22, the second pixel group 23, the third pixel group 24 and the fourth pixel group 92 reach a white balance. Further, the second pixel group 23 and the fourth pixel group 92 in the twenty-first section 91 and the first pixel group 22 and the third pixel group 24 in the adjacent twenty-fourth section 98 arranged in a 2×2 matrix also can reach a white balance.

Figure 35:
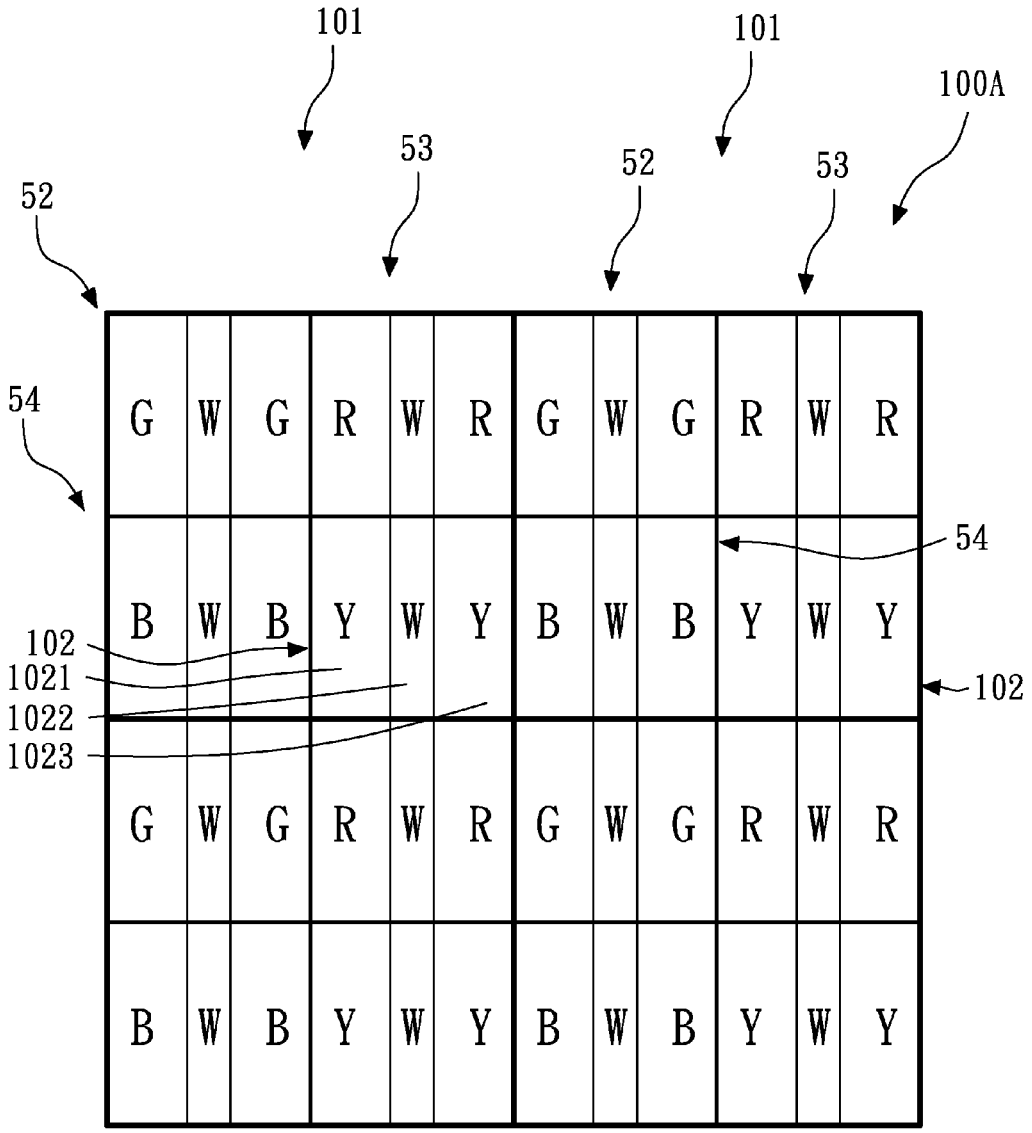
FIG. 35 shows the image device according to a thirtieth-third embodiment of the invention.

Referring to FIG. 35, it shows the image device according to a thirtieth-third embodiment of the invention. In this embodiment, the image device 100A comprises a plurality of twenty-first sections 101. The twenty-first section 101 includes a first pixel group 52, a second pixel group 53, a third pixel group 54 and a fourth pixel group 102. In this embodiment, the first pixel group 52, the second pixel group 53, the third pixel group 54 are the same as those in the thirteenth embodiment. The fourth pixel group 102 comprises two fifth color dots (Y) 1021, 1023 and one second color dot (W) 1022, the second color dot (W) 1022 is disposed between the two fifth color dots (Y) 1021, 1023 in the fourth pixel group 102.

The differences between the twenty-ninth embodiment in FIG. 31 and the thirty-third embodiment in FIG. 35 are: an area of the second color dot 522 is smaller than that of the first color dots 521, 523 in the first pixel group 52, an area of the second color dot 532 is smaller than that of the third color dots 531, 533 in the second pixel group 53, and an area of the second color dot 542 is smaller than that of the fourth color dots 541, 543 in the third pixel group 54; an area of the second color dot 1022 is smaller than that of the fifth color dots 1021, 1023 in the fourth pixel group 102. In FIG. 35, the area of the second color dot 1022 is about ⅓ area of the fifth color dot 1021 in the fourth pixel group 102.

In this embodiment, the first pixel group 52 is disposed on a first column and first row position of the twenty-first section 101, the second pixel group 53 is disposed on a second column and first row position of the twenty-first section 101, the third pixel group 54 is disposed on a first column and second row position of the twenty-first section 101, the fourth pixel group 102 is disposed on a second column and second row position of the twenty-first section 101. In the twenty-first section 101, the first pixel group 52, the second pixel group 53, the third pixel group 54 and the fourth pixel group 102 reach a white balance. Further, the second pixel group 53 and the fourth pixel group 102 in the twenty-first section 101 and the first pixel group 52 and the third pixel group 54 in the adjacent twenty-first section 101 arranged in a 2×2 matrix also can reach a white balance.

Figure 36:
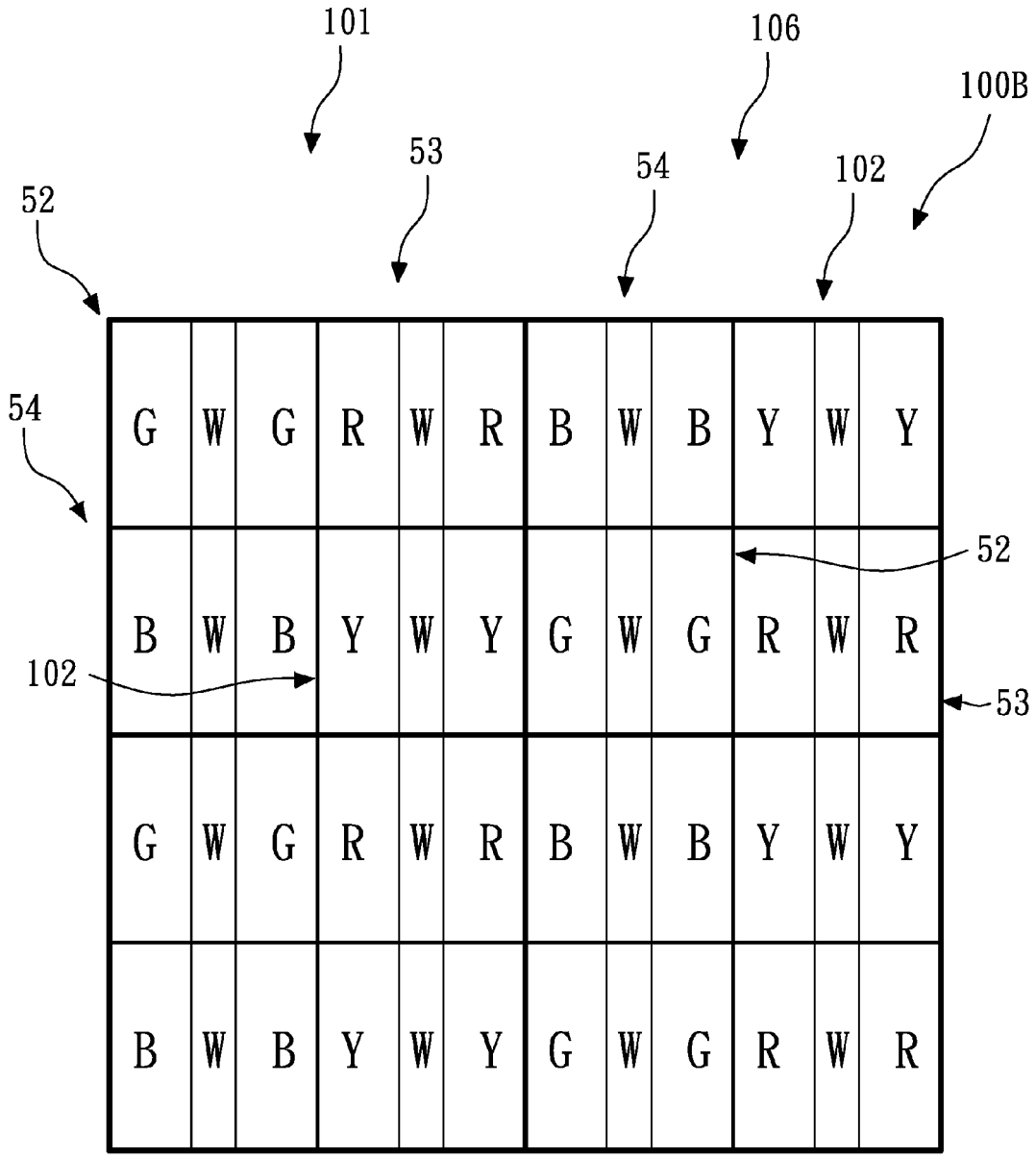
FIG. 36 shows the image device according to a thirty-fourth embodiment of the invention.

Referring to FIG. 36, it shows the image device according to a thirty-fourth embodiment of the invention. In this embodiment, the image device 100B comprises a plurality of twenty-first sections 101 and a plurality of twenty-second sections 106. Each twenty-second section 106 comprises the first pixel group 52, the second pixel group 53, the third pixel group 54 and the fourth pixel group 102. The third pixel group 54 is disposed on a first column and first row position of the twenty-second section 106, the fourth pixel group 102 is disposed on a second column and first row position of the twenty-second section 106, the first pixel group 52 is disposed on a first column and second row position of the twenty-second section 106, the second pixel group 53 is disposed on a second column and second row position of the twenty-second section 106.

In the twenty-second section 106, the first pixel group 52, the second pixel group 53, the third pixel group 54 and the fourth pixel group 102 reach a white balance. Further, the second pixel group 53 and the fourth pixel group 102 in the twenty-first section 101 and the first pixel group 52 and the third pixel group 54 in the adjacent twenty-second section 106 arranged in a 2×2 matrix also can reach a white balance.

Figure 37:
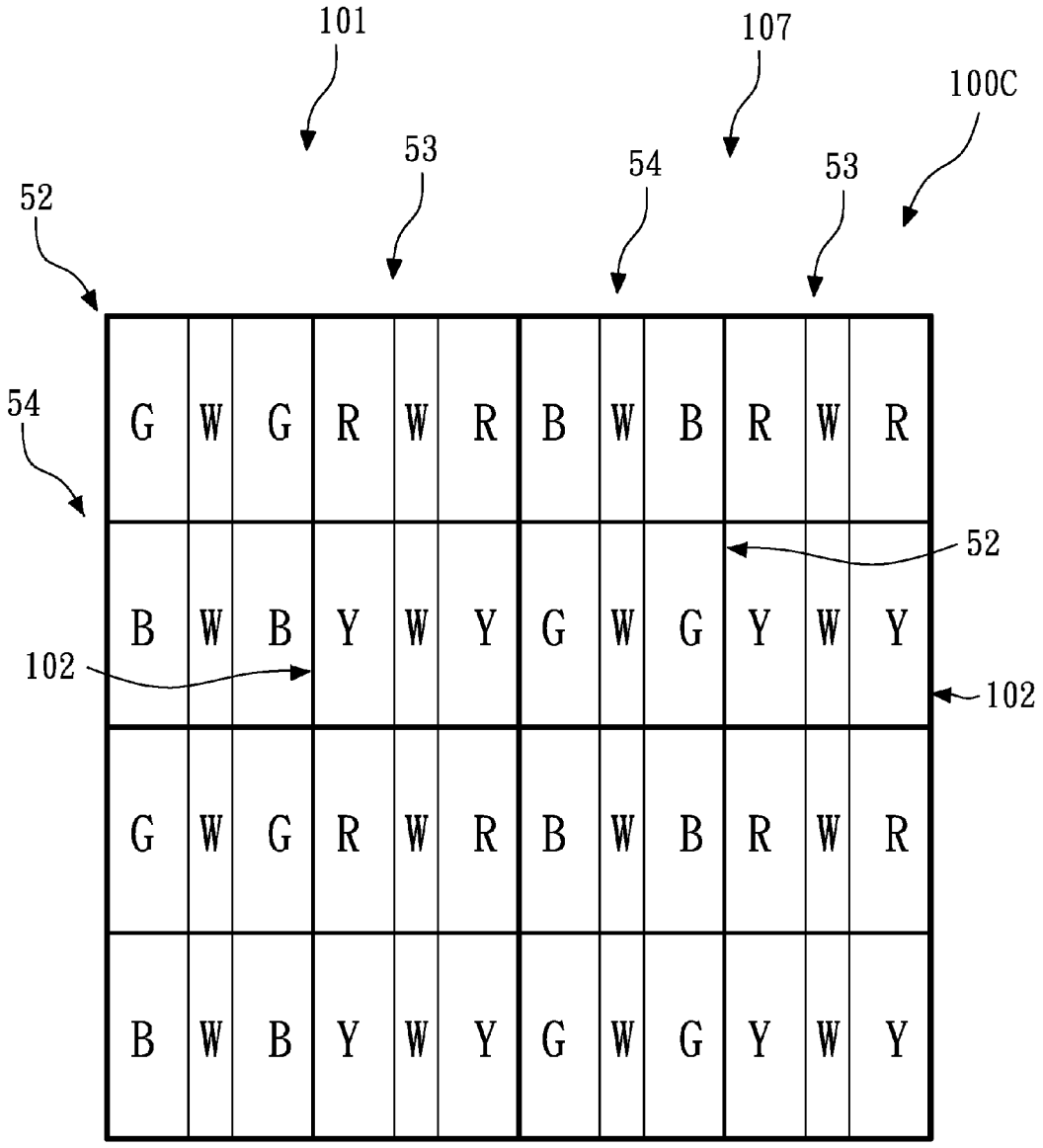
FIG. 37 shows the image device according to a thirty-fifth embodiment of the invention.

Referring to FIG. 37, it shows the image device according to a thirty-fifth embodiment of the invention. In this embodiment, the image device 100C comprises a plurality of twenty-first sections 101 and a plurality of twenty-third sections 107. Each twenty-third section 107 comprises the first pixel group 52, the second pixel group 53, the third pixel group 54 and the fourth pixel group 102. The third pixel group 54 is disposed on a first column and first row position of the twenty-third section 107, the second pixel group 53 is disposed on a second column and first row position of the twenty-third section 107, the first pixel group 52 is disposed on a first column and second row position of the twenty-third section 107, the fourth pixel group 102 is disposed on a second column and second row position of the twenty-third section 107.

In the twenty-third section 107, the first pixel group 52, the second pixel group 53, the third pixel group 54 and the fourth pixel group 102 reach a white balance. Further, the second pixel group 53 and the fourth pixel group 102 in the twenty-first section 101 and the first pixel group 52 and the third pixel group 54 in the adjacent twenty-third section 107 arranged in a 2×2 matrix also can reach a white balance.

Figure 38:
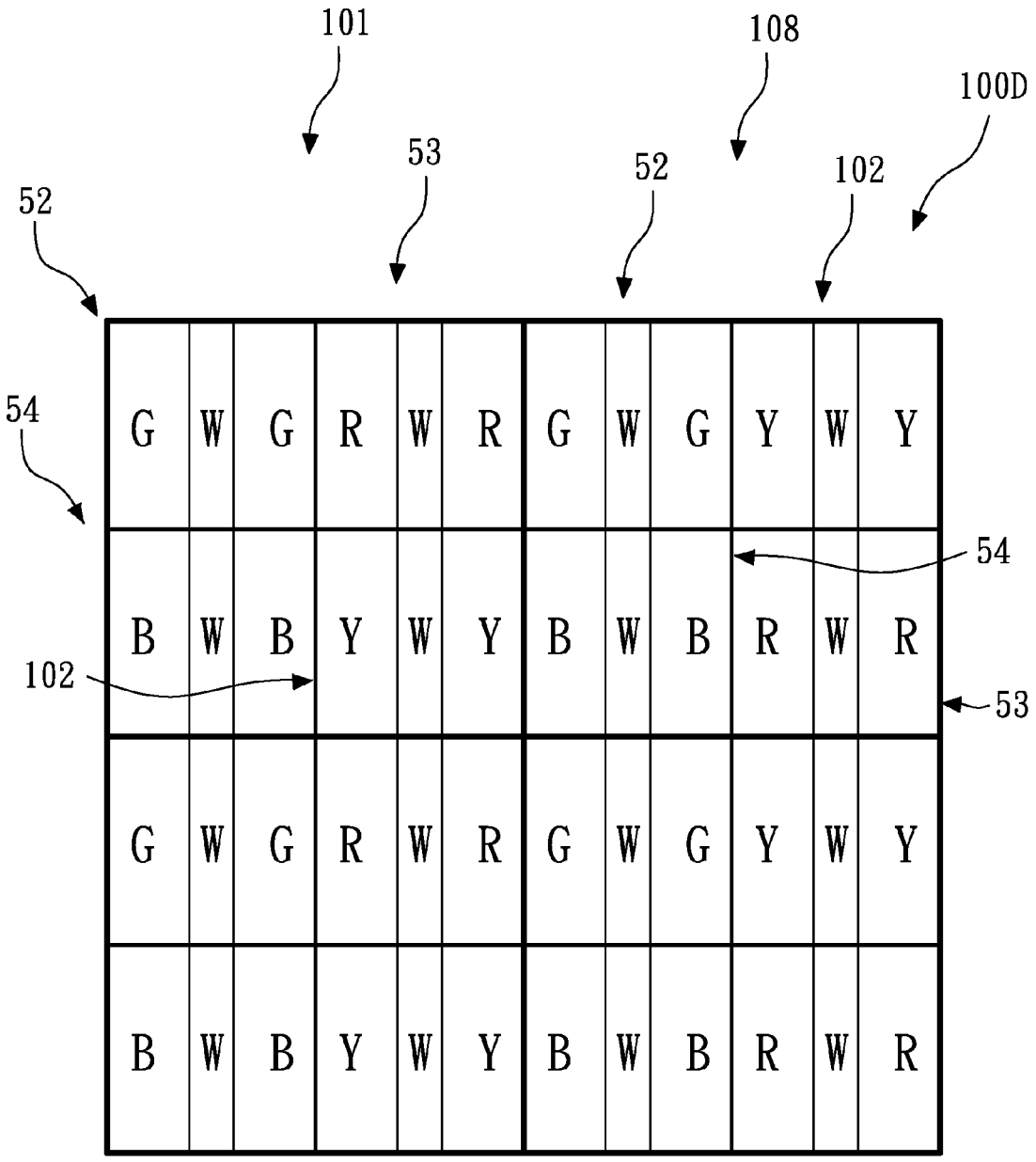
FIG. 38 shows the image device according to a thirty-sixth embodiment of the invention.

Referring to FIG. 38, it shows the image device according to a thirty-sixth embodiment of the invention. In this embodiment, the image device 100D comprises a plurality of twenty-first sections 101 and a plurality of twenty-fourth sections 108. Each twenty-fourth section 108 comprises the first pixel group 52, the second pixel group 53, the third pixel group 54 and the fourth pixel group 102. The first pixel group 52 is disposed on a first column and first row position of the twenty-fourth section 108, the fourth pixel group 102 is disposed on a second column and first row position of the twenty-fourth section 108, the third pixel group 54 is disposed on a first column and second row position of the twenty-fourth section 108, the second pixel group 53 is disposed on a second column and second row position of the twenty-fourth section 108.

In the twenty-fourth section 108, the first pixel group 52, the second pixel group 53, the third pixel group 54 and the fourth pixel group 102 reach a white balance. Further, the second pixel group 53 and the fourth pixel group 102 in the twenty-first section 101 and the first pixel group 52 and the third pixel group 54 in the adjacent twenty-fourth section 108 arranged in a 2×2 matrix also can reach a white balance.

Figure 39:
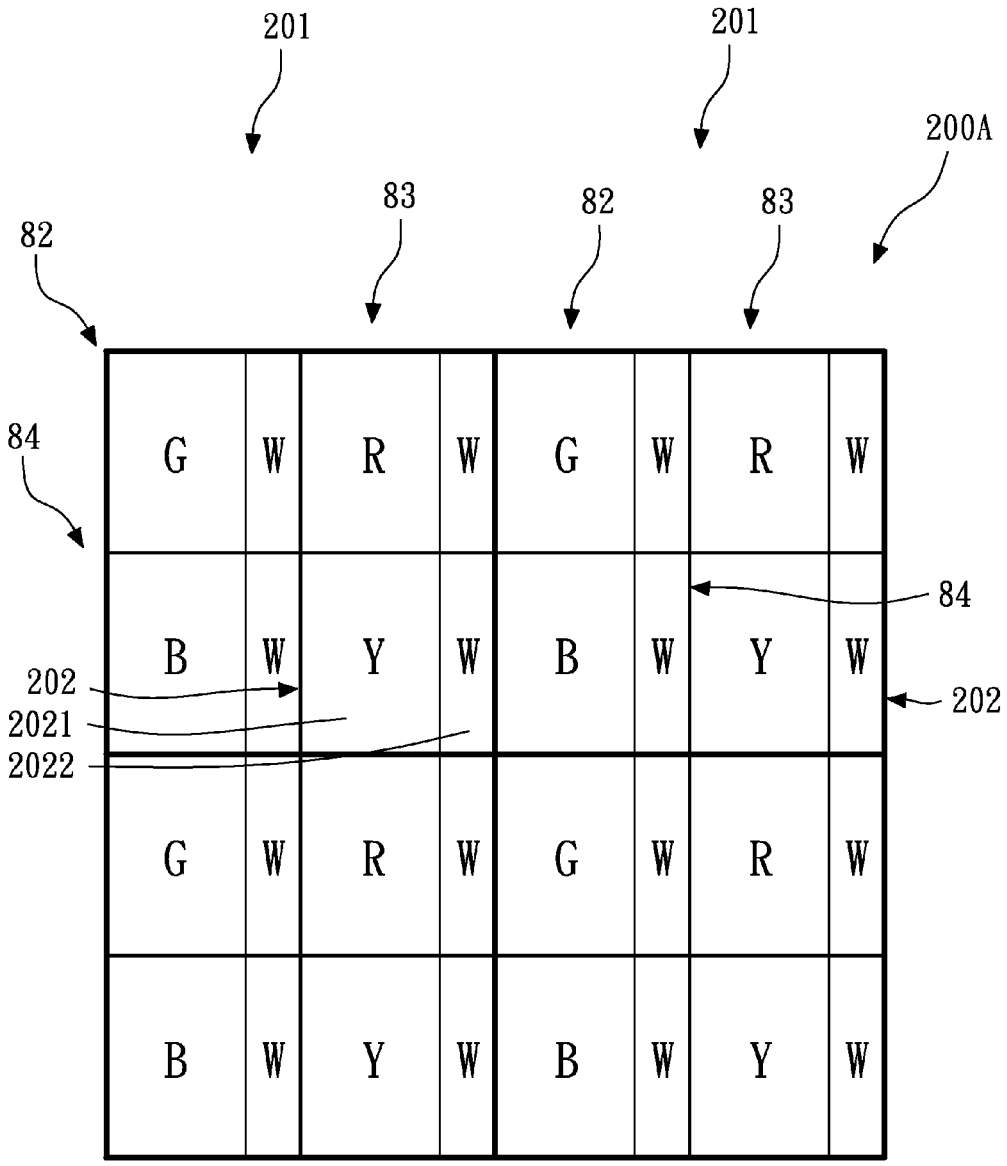
FIG. 39 shows the image device according to a thirty-seventh embodiment of the invention.

Referring to FIG. 39, it shows the image device according to a thirty-seventh embodiment of the invention. In this embodiment, the image device 200A comprises a plurality of twenty-fifth sections 201. The twenty-fifth section 201 includes a first pixel group 82, a second pixel group 83, a third pixel group 84 and a fourth pixel group 202. In this embodiment, the first pixel group 82, the second pixel group 83, the third pixel group 84 are the same as those in the twenty-fifth embodiment. The fourth pixel group 202 comprises one fifth color dot (Y) 2021 and one second color dot (W) 2022, an area of the fifth color dots (Y) 2021 is bigger than that of the second color dot (W) 2022.

The first pixel group 82 is disposed on a first column and first row position of the twenty-fifth section 201, the second pixel group 83 is disposed on a second column and first row position of the twenty-fifth section 201, the third pixel group 84 is disposed on a first column and second row position of the twenty-fifth section 201, the fourth pixel group 202 is disposed on a second column and second row position of the twenty-fifth section 201.

In this embodiment, in the twenty-fifth section 201, the first pixel group 82, the second pixel group 83, the third pixel group 84 and the fourth pixel group 202 reach a white balance. Further, the second pixel group 83 and the fourth pixel group 202 in the twenty-fifth section 201 and the first pixel group 82 and the third pixel group 84 in the adjacent twenty-fifth section 201 arranged in a 2×2 matrix also can reach a white balance.

Figure 40:
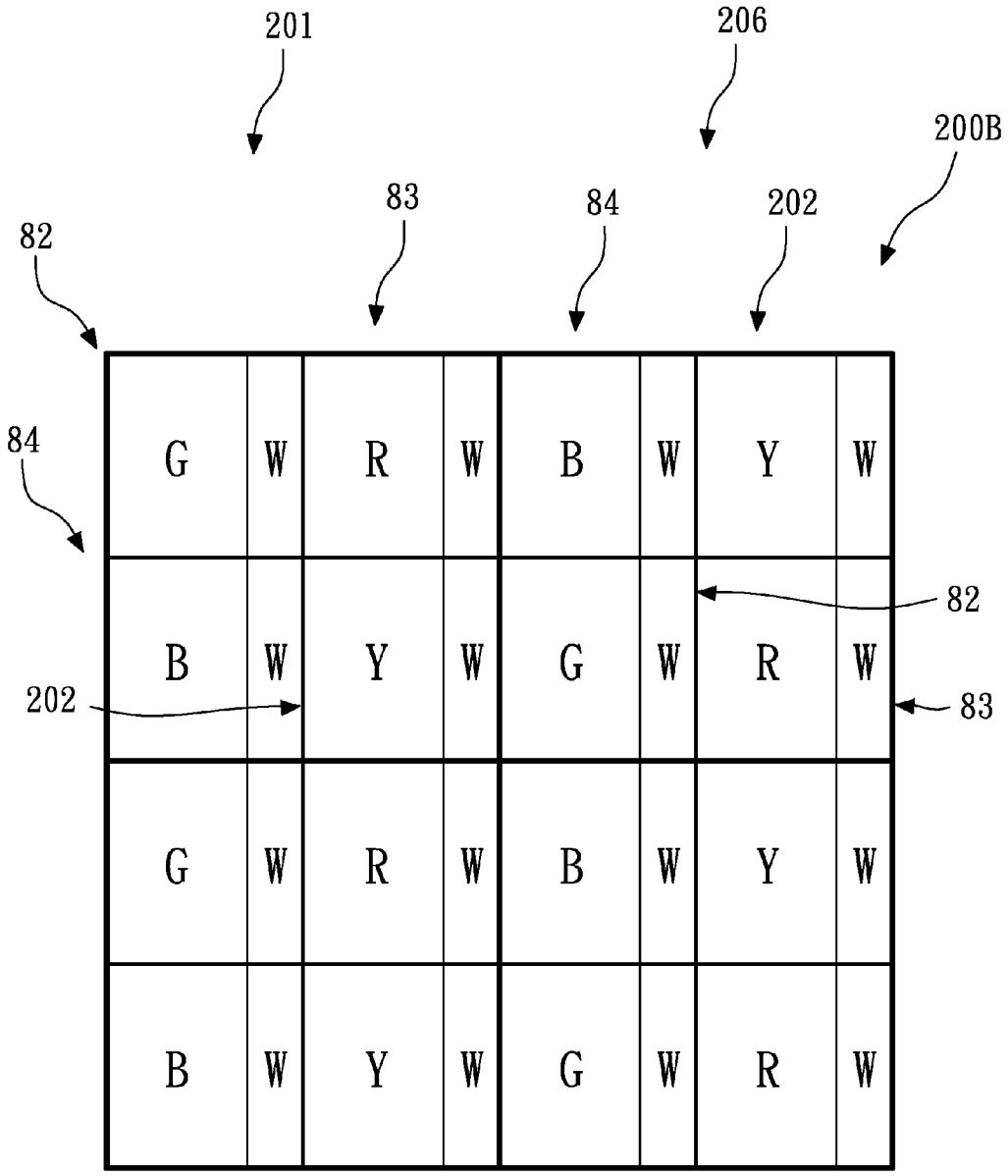
FIG. 40 shows the image device according to a thirty-eighth embodiment of the invention.

Referring to FIG. 40, it shows the image device according to a thirty-eighth embodiment of the invention. In this embodiment, the image device 200B comprises a plurality of twenty-fifth sections 201 and a plurality of twenty-sixth sections 206. Each twenty-sixth section 206 comprises the first pixel group 82, the second pixel group 83, the third pixel group 84 and the fourth pixel group 202. The third pixel group 84 is disposed on a first column and first row position of the twenty-sixth section 206, the fourth pixel group 202 is disposed on a second column and first row position of the twenty-sixth section 206, the first pixel group 82 is disposed on a first column and second row position of the twenty-sixth section 206, the second pixel group 83 is disposed on a second column and second row position of the twenty-sixth section 206.

In the twenty-sixth section 206, the first pixel group 82, the second pixel group 83, the third pixel group 84 and the fourth pixel group 202 reach a white balance. Further, the second pixel group 83 and the fourth pixel group 202 in the twenty-fifth section 201 and the first pixel group 82 and the third pixel group 84 in the adjacent twenty-sixth section 206 arranged in a 2×2 matrix also can reach a white balance.

Figure 41:
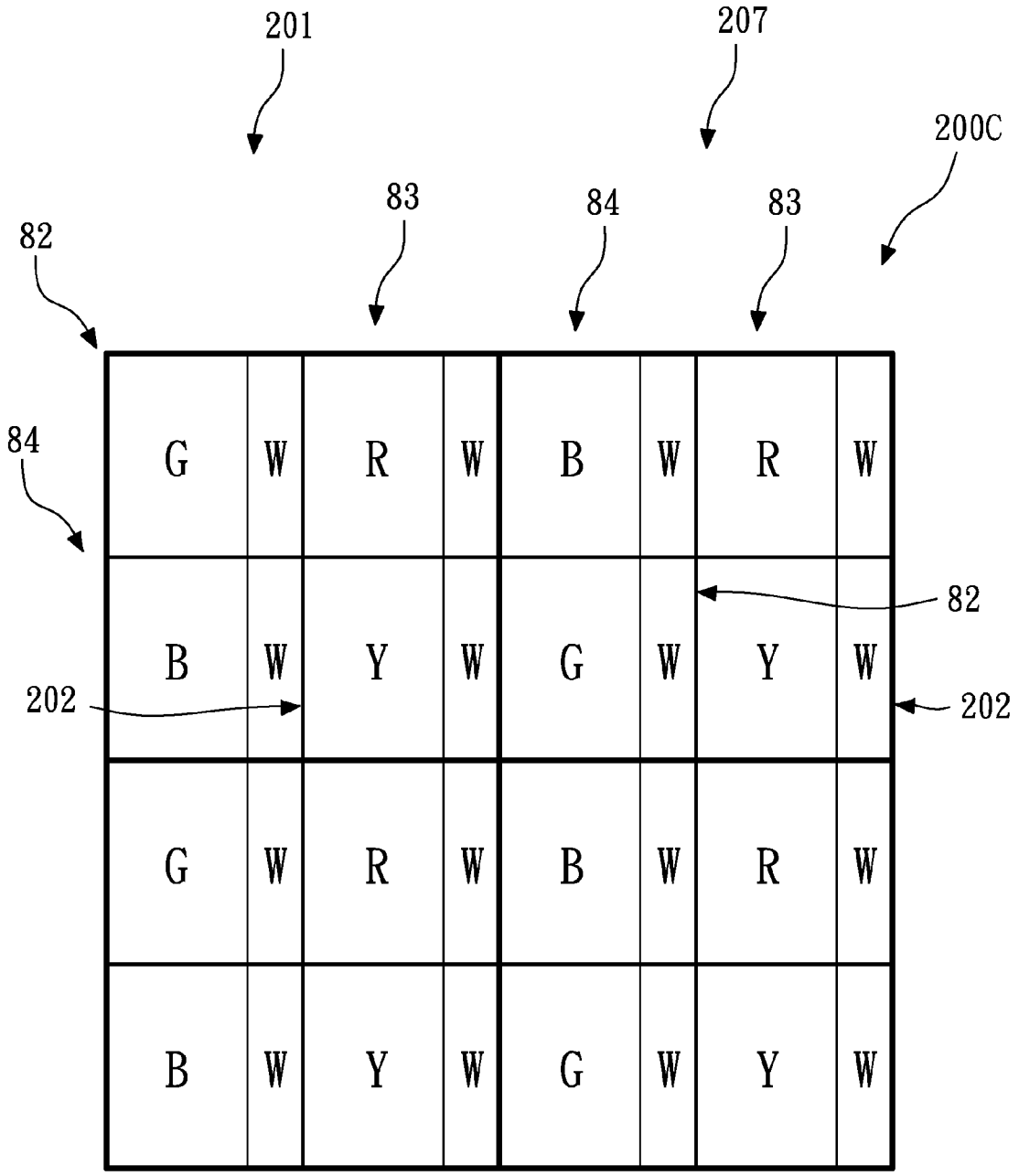
FIG. 41 shows the image device according to a thirty-ninth embodiment of the invention.

Referring to FIG. 41, it shows the image device according to a thirty-ninth embodiment of the invention. In this embodiment, the image device 200C comprises a plurality of twenty-fifth sections 201 and a plurality of twenty-seventh section 207. Each twenty-seventh section 207 comprises the first pixel group 82, the second pixel group 83, the third pixel group 84 and the fourth pixel group 202. The third pixel group 84 is disposed on a first column and first row position of the twenty-seventh section 207, the second pixel group 83 is disposed on a second column and first row position of the twenty-seventh section 207, the first pixel group 82 is disposed on a first column and second row position of the twenty-seventh section 207, the fourth pixel group 202 is disposed on a second column and second row position of the twenty-seventh section 207.

In the twenty-seventh section 207, the first pixel group 82, the second pixel group 83, the third pixel group 84 and the fourth pixel group 202 reach a white balance. Further, the second pixel group 83 and the fourth pixel group 202 in the twenty-fifth section 201 and the first pixel group 82 and the third pixel group 84 in the adjacent twenty-seventh section 207 arranged in a 2×2 matrix also can reach a white balance.

Figure 42:
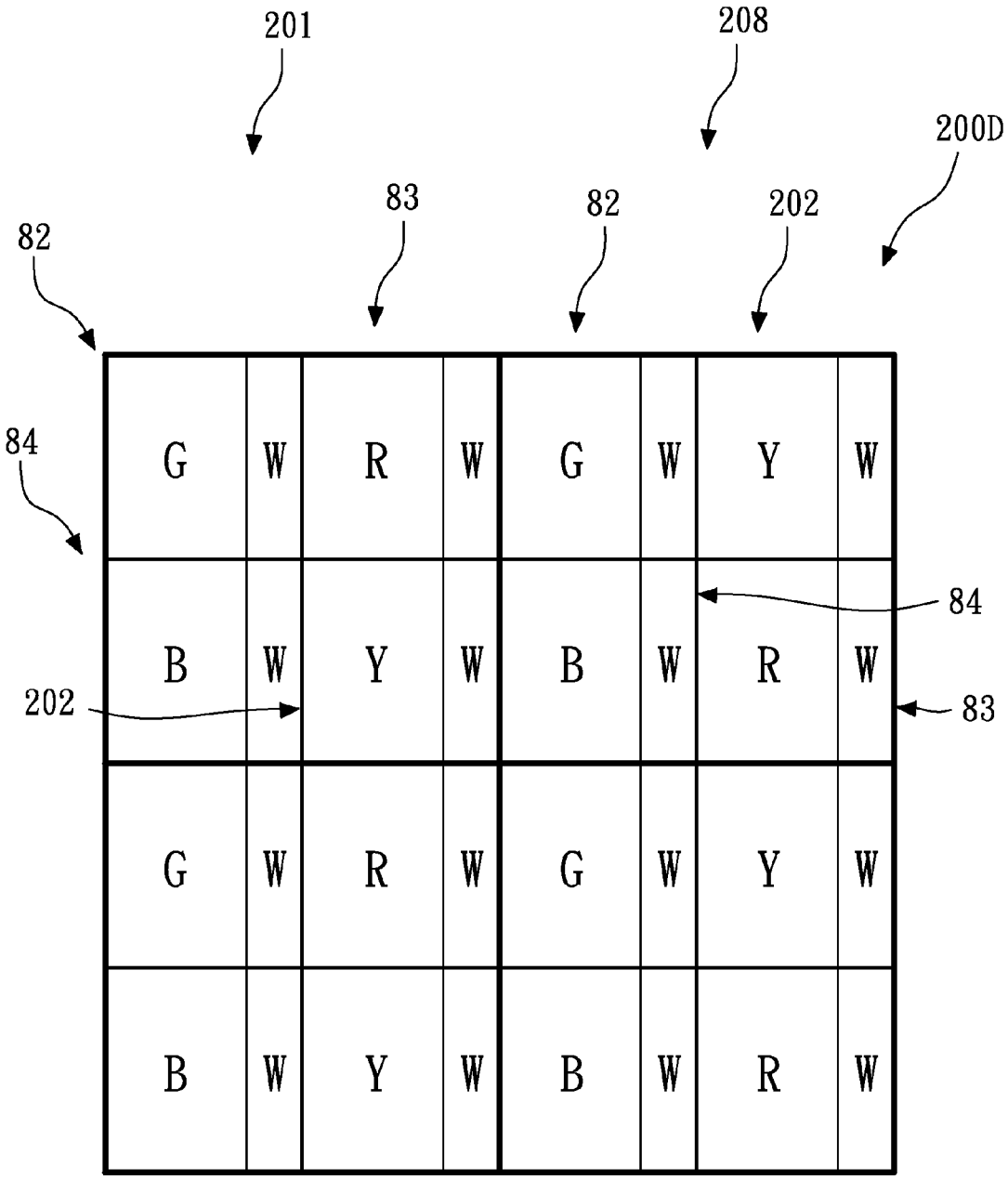
FIG. 42 shows the image device according to a fortieth embodiment of the invention.

Referring to FIG. 42, it shows the image device according to a fortieth embodiment of the invention. In this embodiment, the image device 200D comprises a plurality of twenty-fifth sections 201 and a plurality of twenty-eighth sections 208. Each twenty-eighth section 208 comprises the first pixel group 82, the second pixel group 83, the third pixel group 84 and the fourth pixel group 202. The first pixel group 82 is disposed on a first column and first row position of the twenty-eighth section 208, the fourth pixel group 202 is disposed on a second column and first row position of the twenty-eighth section 208, the third pixel group 84 is disposed on a first column and second row position of the twenty-eighth section 208, the second pixel group 83 is disposed on a second column and second row position of the twenty-eighth section 208.

In the twenty-eighth section 208, the first pixel group 82, the second pixel group 83, the third pixel group 84 and the fourth pixel group 202 reach a white balance. Further, the second pixel group 83 and the fourth pixel group 202 in the twenty-fifth section 201 and the first pixel group 82 and the third pixel group 84 in the adjacent twenty-eighth section 208 arranged in a 2×2 matrix also can reach a white balance.

Figure 43:
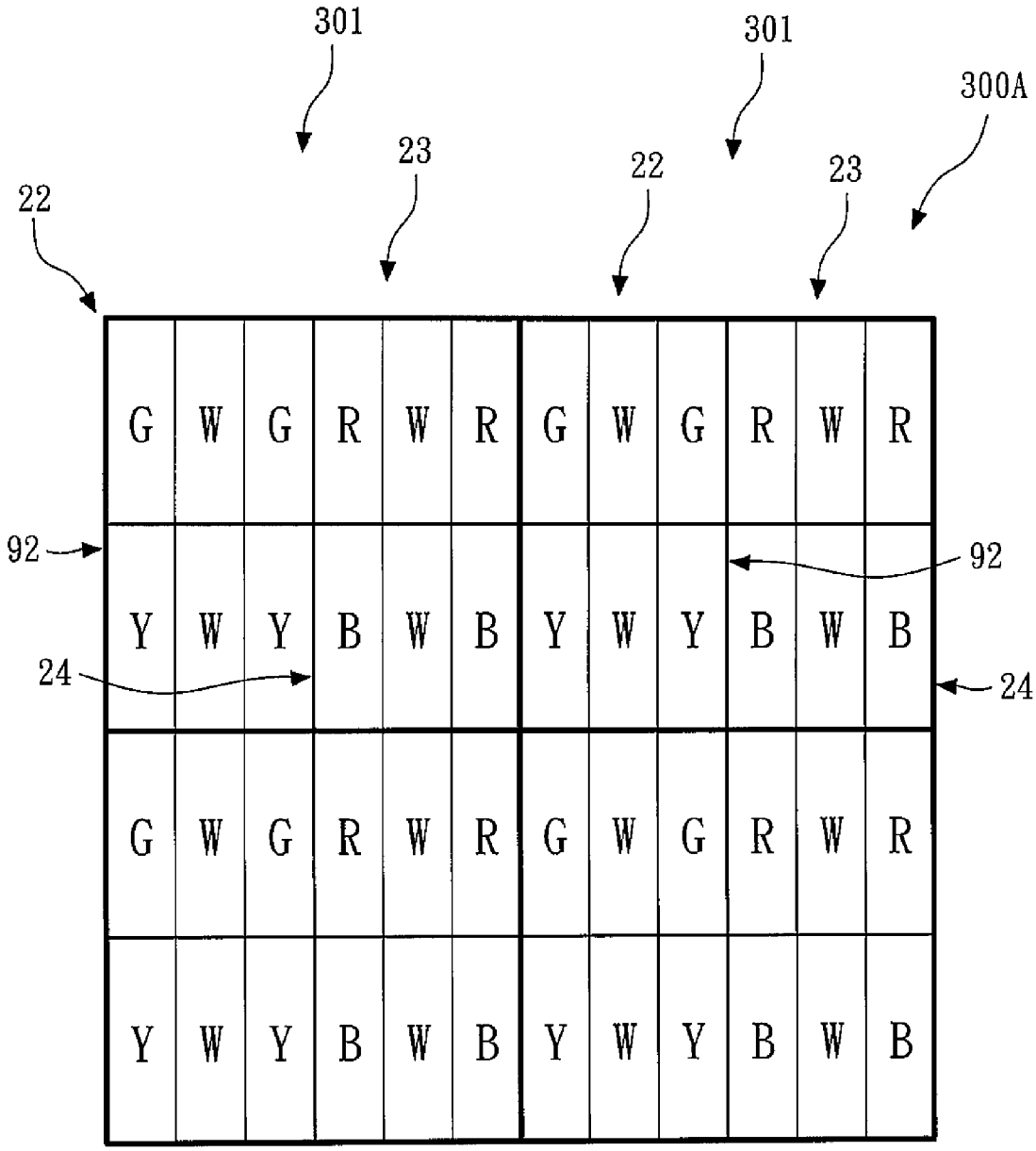
FIG. 43 shows the image device according to a forty-first embodiment of the invention.

Referring to FIG. 43, it shows the image device according to a forty-first embodiment of the invention. In this embodiment, the image device 300A comprises a plurality of twenty-ninth sections 301. Each twenty-ninth section 301 comprises the first pixel group 22, the second pixel group 23, the third pixel group 24 and the fourth pixel group 92. In this embodiment, the first pixel group 22, the second pixel group 23, the third pixel group 24 and the fourth pixel group 92 are the same as those in the twenty-ninth embodiment.

In this embodiment, the first pixel group 22 is disposed on a first column and first row position of the twenty-ninth section 301, the second pixel group 23 is disposed on a second column and first row position of the twenty-ninth section 301, the fourth pixel group 92 is disposed on a first column and second row position of the twenty-ninth section 301, the third pixel group 24 is disposed on a second column and second row position of the twenty-ninth section 301. In the twenty-ninth section 301, the first pixel group 22, the second pixel group 23, the third pixel group 24 and the fourth pixel group 92 reach a white balance. Further, the second pixel group 23 and the third pixel group 24 in the twenty-ninth section 301 and the first pixel group 22 and the fourth pixel group 92 in the adjacent twenty-ninth section 301 arranged in a 2×2 matrix also can reach a white balance.

Figure 44:
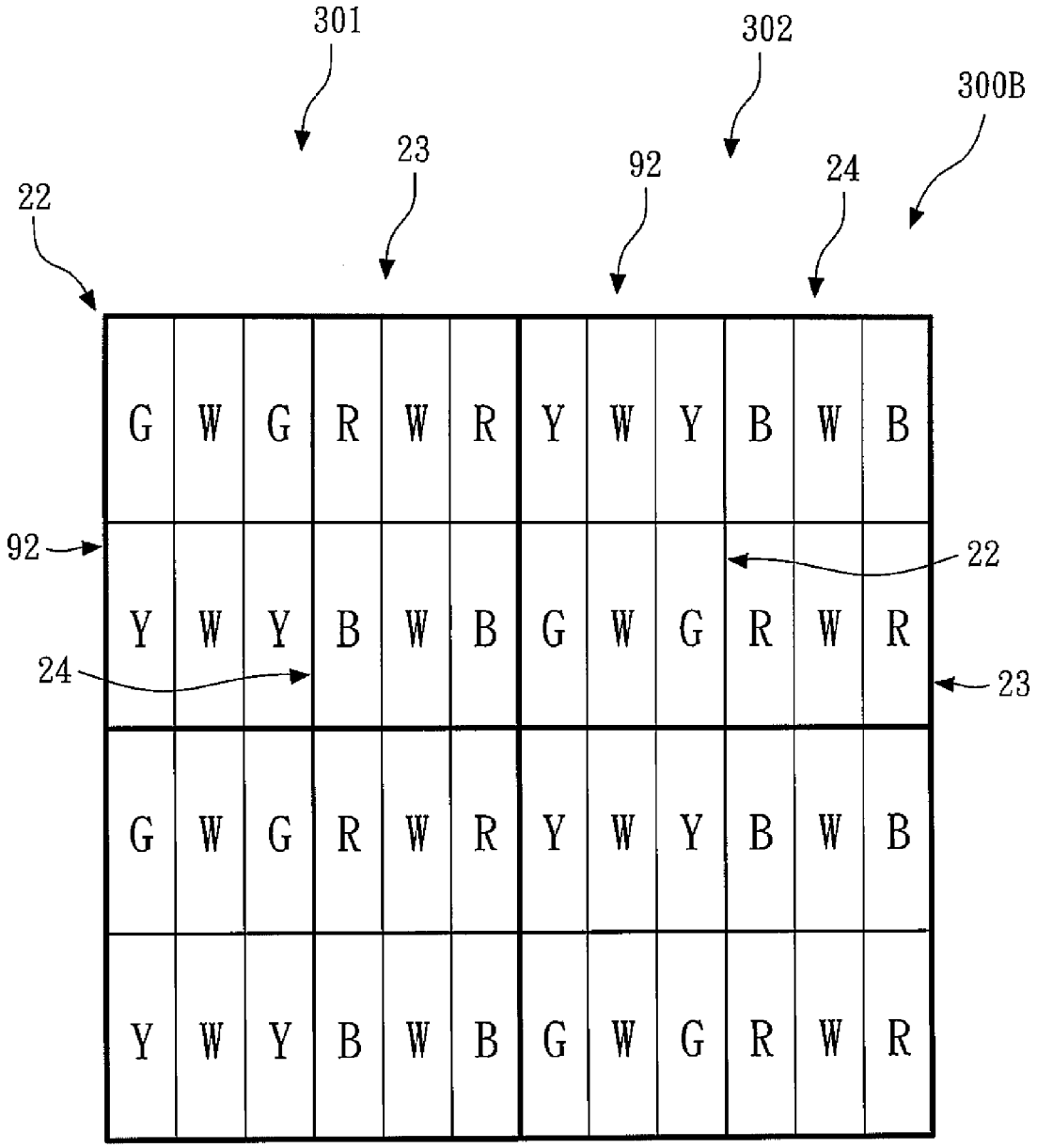
FIG. 44 shows the image device according to a forty-second embodiment of the invention.

Referring to FIG. 44, it shows the image device according to a forty-second embodiment of the invention. In this embodiment, the image device 300B comprises a plurality of twenty-ninth sections 301 and a plurality of thirtieth sections 302. Each thirtieth section 302 comprises the first pixel group 22, the second pixel group 23, the third pixel group 24 and the fourth pixel group 92. The fourth pixel group 92 is disposed on a first column and first row position of the thirtieth section 302, the third pixel group 24 is disposed on a second column and first row position of the thirtieth section 302, the first pixel group 22 is disposed on a first column and second row position of the thirtieth section 302, the second pixel group 23 is disposed on a second column and second row position of the thirtieth section 302.

In the thirtieth sections 302, the first pixel group 22, the second pixel group 23, the third pixel group 24 and the fourth pixel group 92 reach a white balance. Further, the second pixel group 23 and the third pixel group 24 in the twenty-ninth section 301 and the first pixel group 22 and the fourth pixel group 92 in the adjacent thirtieth section 302 arranged in a 2×2 matrix also can reach a white balance.

Figure 45:
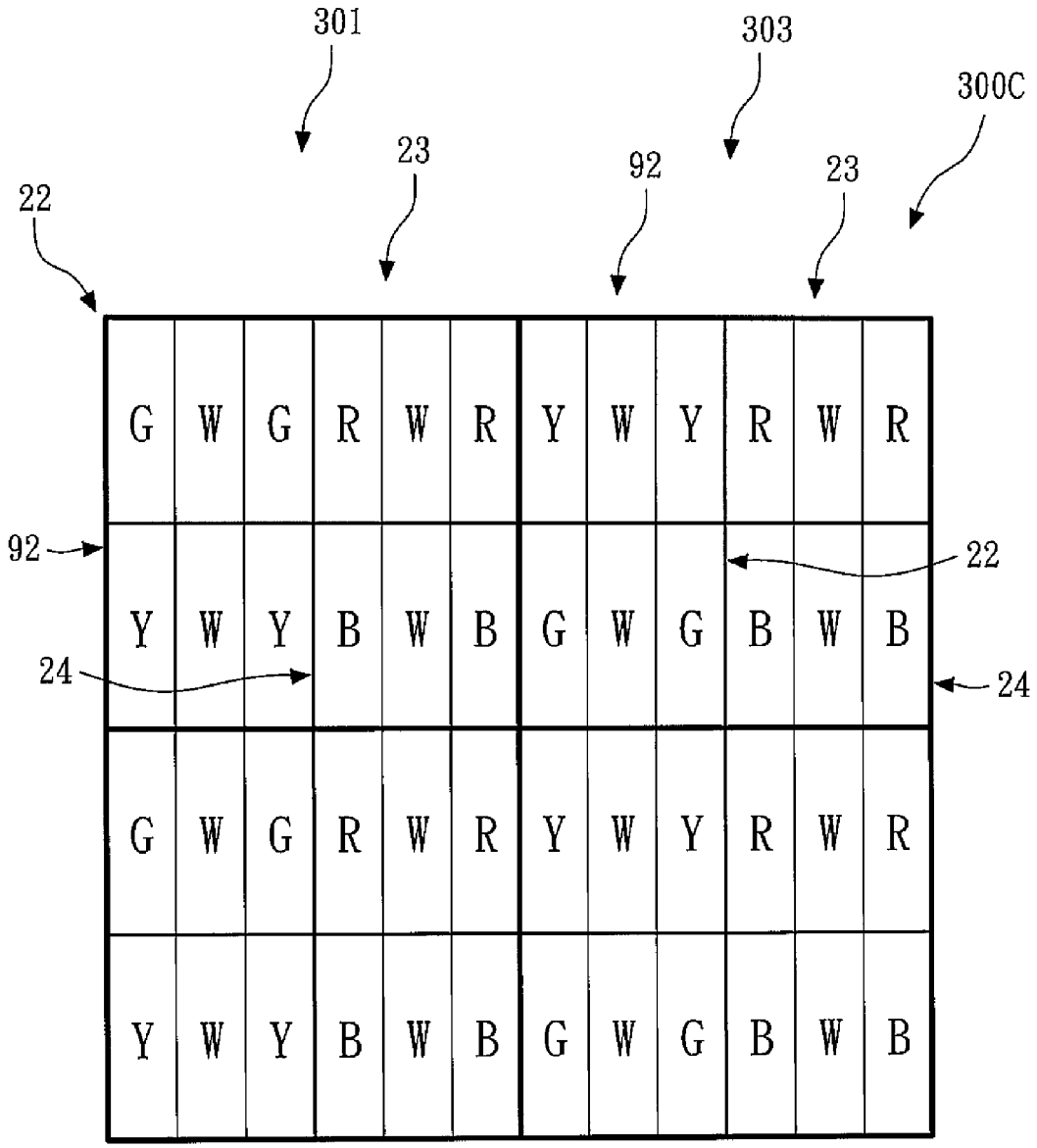
FIG. 45 shows the image device according to a forty-third embodiment of the invention.

Referring to FIG. 45, it shows the image device according to a forty-third embodiment of the invention. In this embodiment, the image device 300C comprises a plurality of twenty-ninth sections 301 and a plurality of thirty-first sections 303. Each thirty-first section 303 comprises the first pixel group 22, the second pixel group 23, the third pixel group 24 and the fourth pixel group 92. The fourth pixel group 92 is disposed on a first column and first row position of the thirty-first section 303, the second pixel group 23 is disposed on a second column and first row position of the thirty-first section 303, the first pixel group 22 is disposed on a first column and second row position of the thirty-first section 303, the third pixel group 24 is disposed on a second column and second row position of the thirty-first section 303.

In the thirty-first section 303, the first pixel group 22, the second pixel group 23, the third pixel group 24 and the fourth pixel group 92 reach a white balance. Further, the second pixel group 23 and the third pixel group 24 in the twenty-ninth section 301 and the first pixel group 22 and the fourth pixel group 92 in the adjacent thirty-first section 303 arranged in a 2×2 matrix also can reach a white balance.

Figure 46:
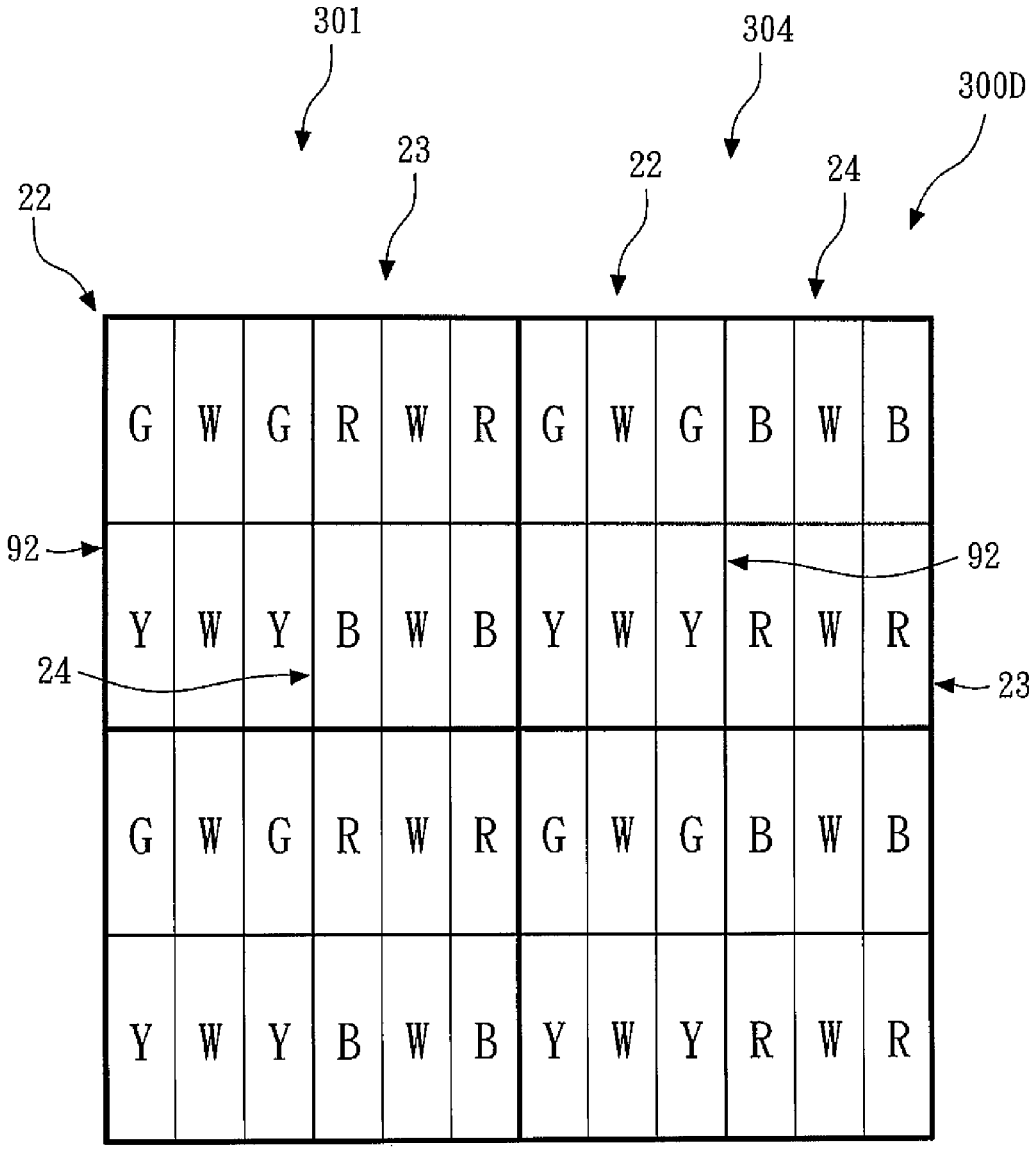
FIG. 46 shows the image device according to a forty-fourth embodiment of the invention.

Referring to FIG. 46, it shows the image device according to a forty-fourth embodiment of the invention. In this embodiment, the image device 300D comprises a plurality of twenty-ninth sections 301 and a plurality of thirty-second sections 304. Each thirty-second section 304 comprises the first pixel group 22, the second pixel group 23, the third pixel group 24 and the fourth pixel group 92. The first pixel group 22 is disposed on a first column and first row position of the thirty-second section 304, the third pixel group 24 is disposed on a second column and first row position of the thirty-second section 304, the fourth pixel group 92 is disposed on a first column and second row position of the thirty-second section 304, the second pixel group 23 is disposed on a second column and second row position of the thirty-second section 304.

In the thirty-second section 304, the first pixel group 22, the second pixel group 23, the third pixel group 24 and the fourth pixel group 92 reach a white balance. Further, the second pixel group 23 and the third pixel group 24 in the twenty-ninth section 301 and the first pixel group 22 and the fourth pixel group 92 in the adjacent thirty-second section 304 arranged in a 2×2 matrix also can reach a white balance.

Figure 47:
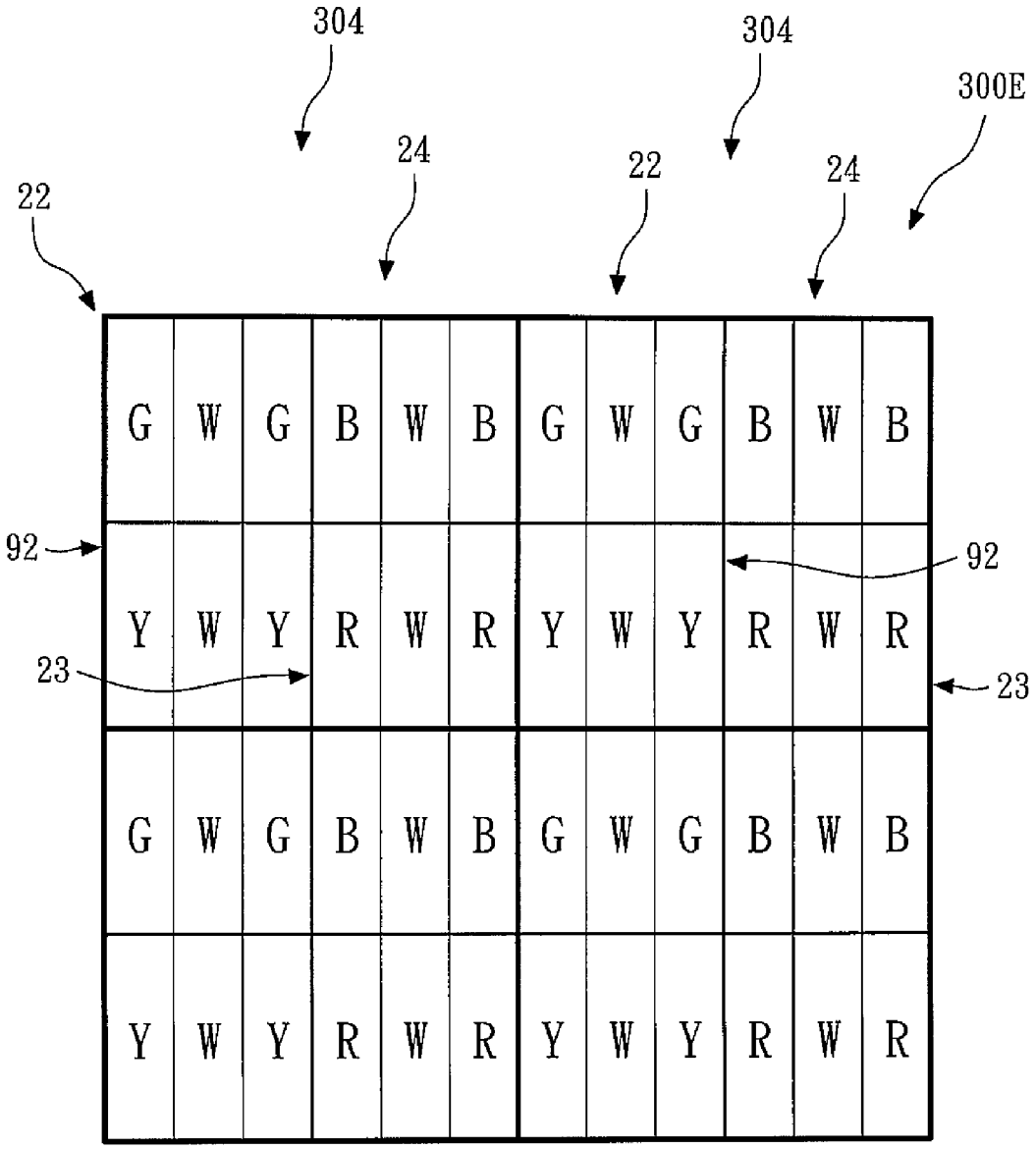
FIG. 47 shows the image device according to a forty-fifth embodiment of the invention.

Referring to FIG. 47, it shows the image device according to a forty-fifth embodiment of the invention. In this embodiment, the image device 300E comprises a plurality of thirty-second sections 304. In the thirty-second section 304, the first pixel group 22, the second pixel group 23, the third pixel group 24 and the fourth pixel group 92 reach a white balance. Further, the second pixel group 23 and the third pixel group 24 in the thirty-second section 304 and the first pixel group 22 and the fourth pixel group 92 in the adjacent thirty-second section 304 arranged in a 2×2 matrix also can reach a white balance.

Figure 48:
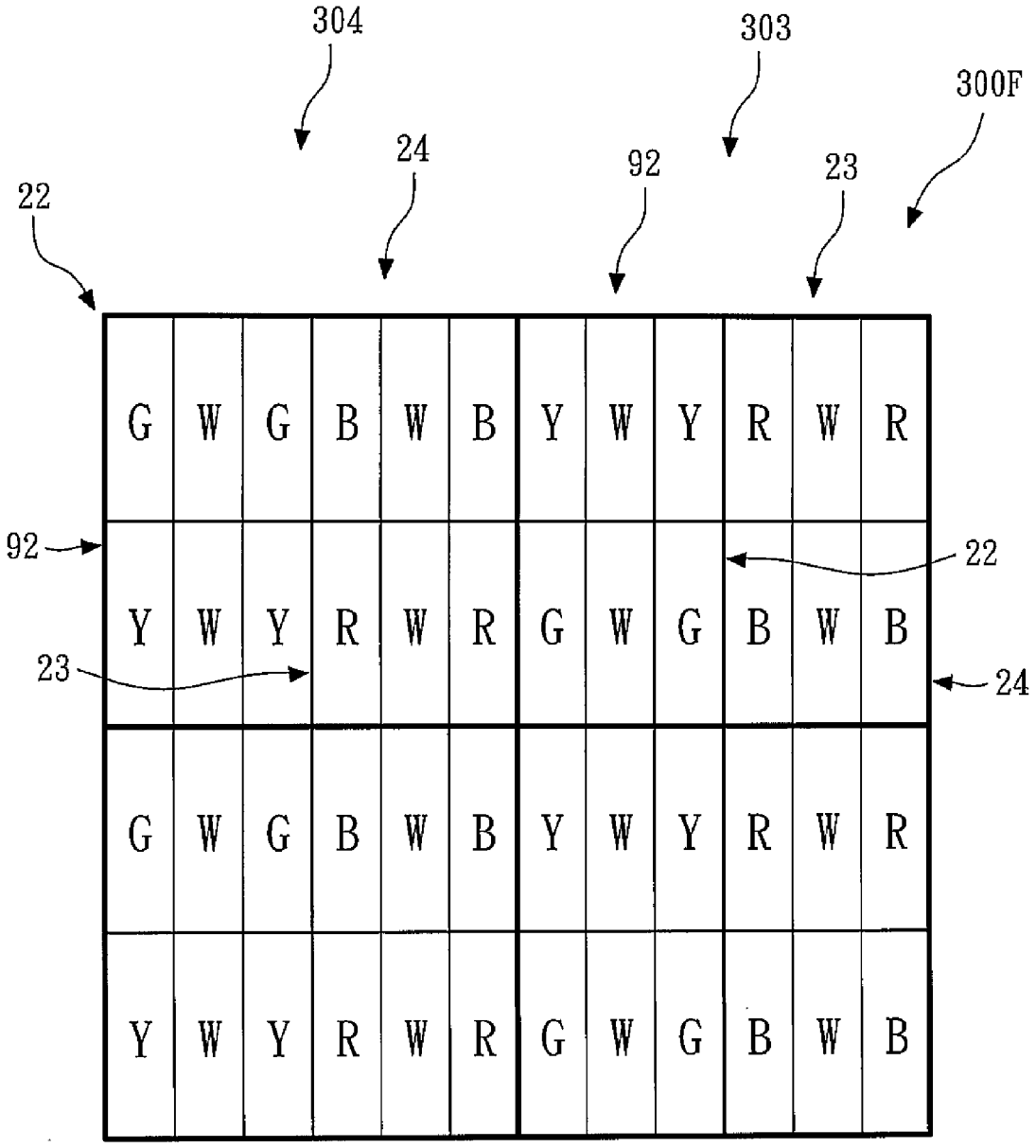
FIG. 48 shows the image device according to a forty-sixth embodiment of the invention.

Referring to FIG. 48, it shows the image device according to a forty-sixth embodiment of the invention. In this embodiment, the image device 300F comprises a plurality of thirty-second sections 304 and a plurality of thirty-first sections 303. The second pixel group 23 and the third pixel group 24 in the thirty-second section 304 and the first pixel group 22 and the fourth pixel group 92 in the adjacent thirty-first section 303 arranged in a 2×2 matrix also can reach a white balance.

Figure 49:
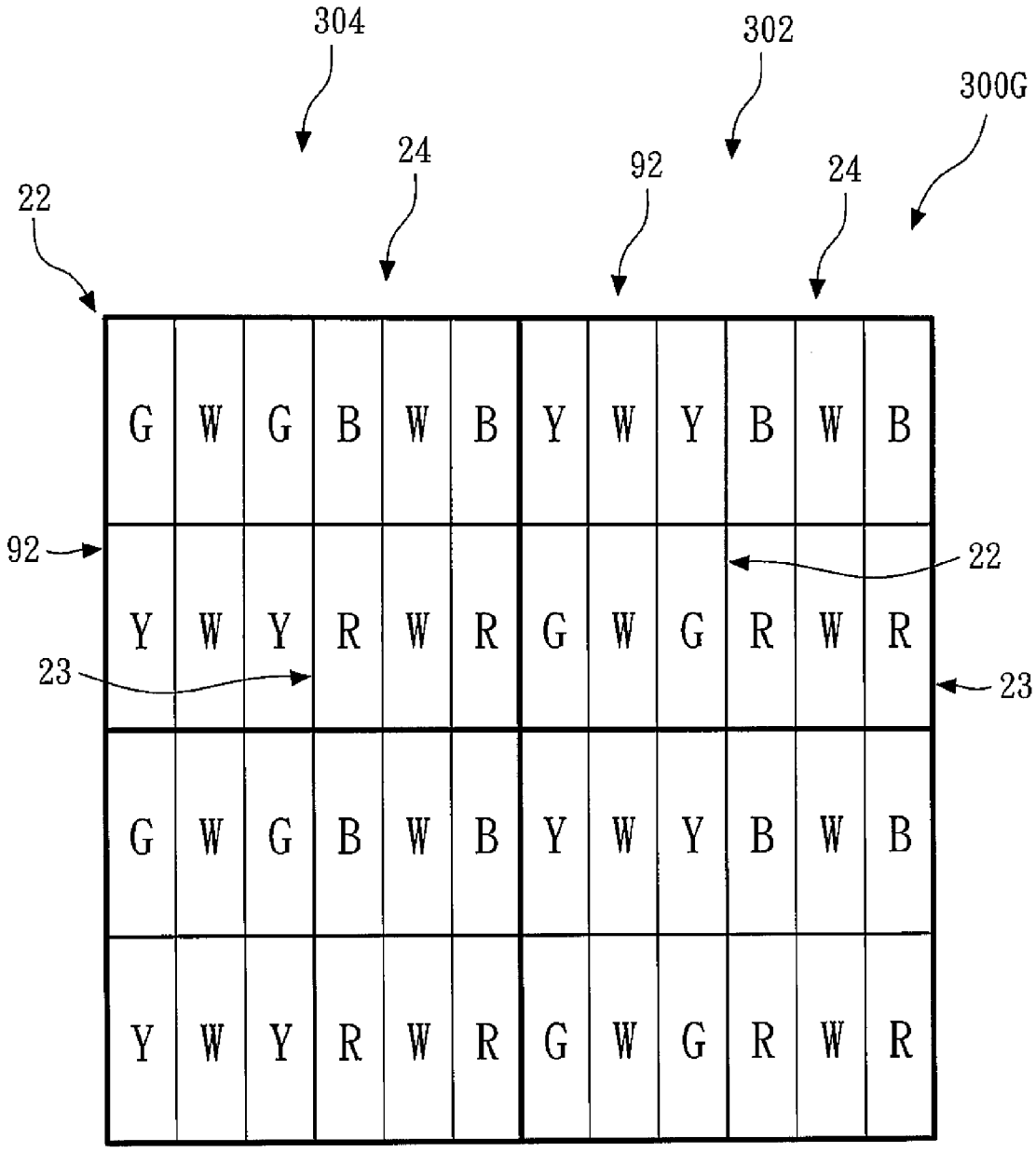
FIG. 49 shows the image device according to a forty-seventh embodiment of the invention.

Referring to FIG. 49, it shows the image device according to a forty-seventh embodiment of the invention. In this embodiment, the image device 300G comprises a plurality of thirty-second sections 304 and a plurality of thirtieth sections 302. The second pixel group 23 and the third pixel group 24 in the thirty-second section 304 and the first pixel group 22 and the fourth pixel group 92 in the adjacent thirtieth section 302 arranged in a 2×2 matrix also can reach a white balance.

Figure 50:
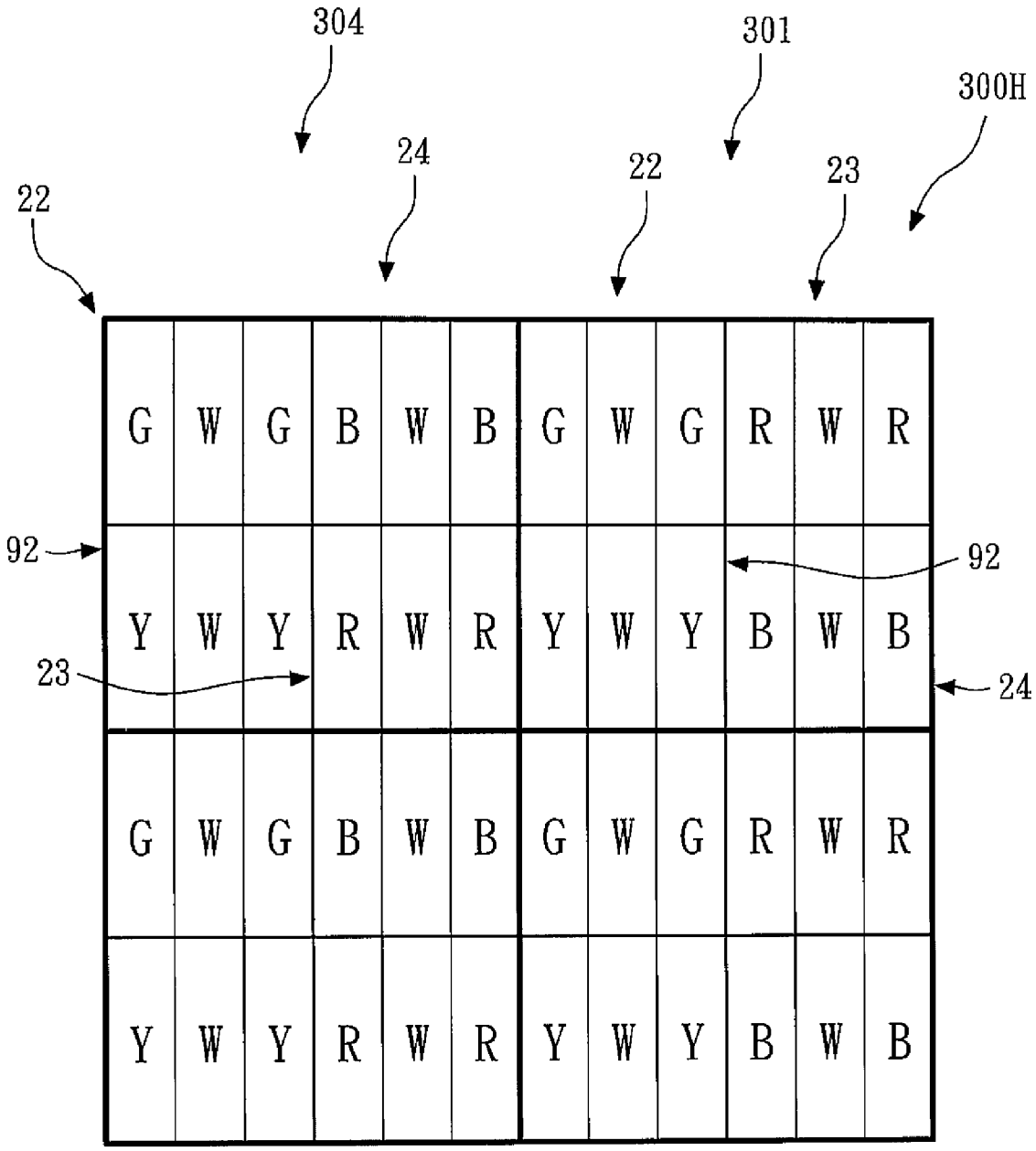
FIG. 50 shows the image device according to a forty-eighth embodiment of the invention.

Referring to FIG. 50, it shows the image device according to a forty-eighth embodiment of the invention. In this embodiment, the image device 300H comprises a plurality of thirty-second sections 304 and a plurality of twenty-ninth sections 301. The second pixel group 23 and the third pixel group 24 in the thirty-second section 304 and the first pixel group 22 and the fourth pixel group 92 in the adjacent twenty-ninth section 301 arranged in a 2×2 matrix also can reach a white balance.

Figure 51:
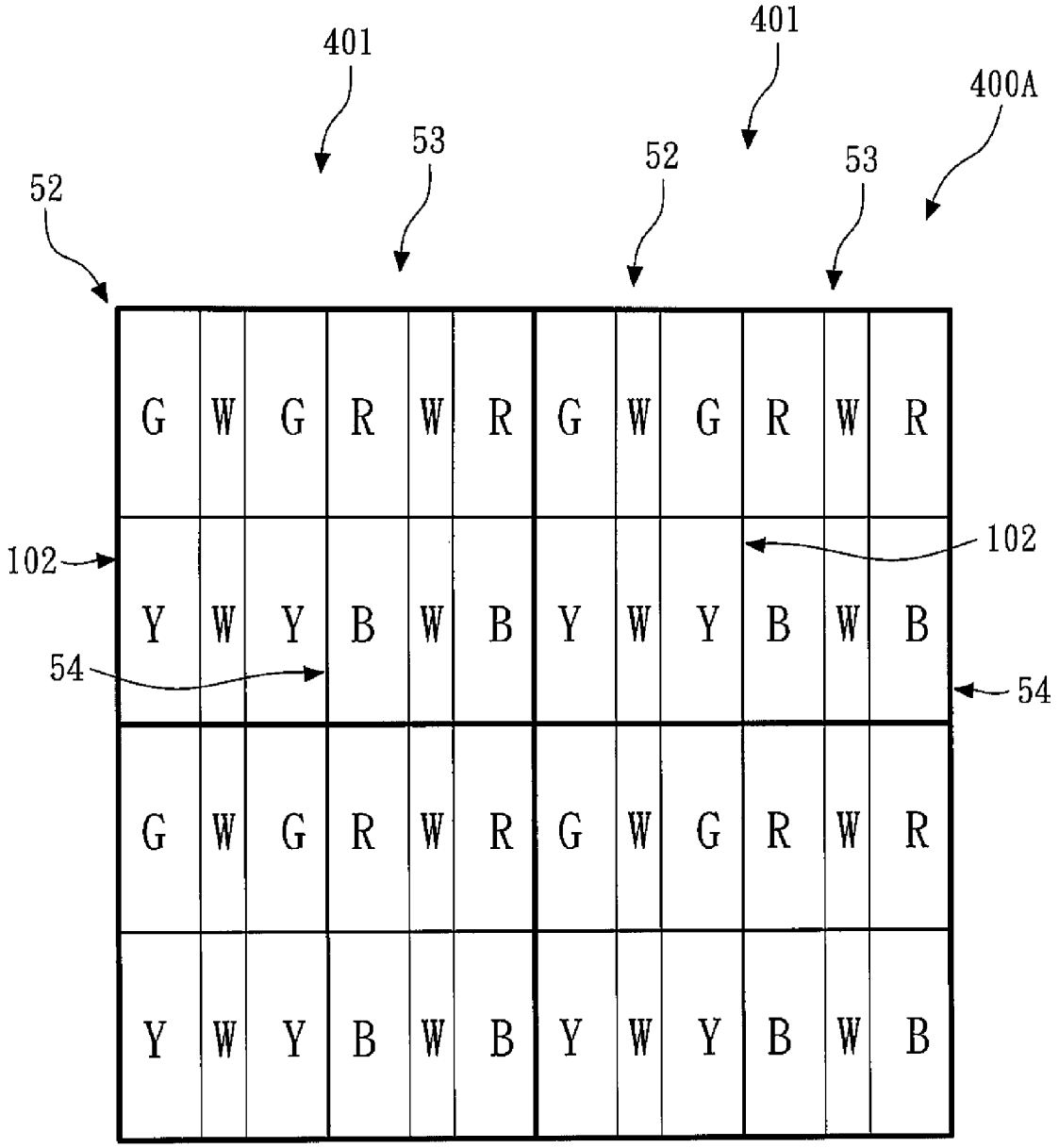
FIG. 51 shows the image device according to a forty-ninth embodiment of the invention.

Referring to FIG. 51, it shows the image device according to a forty-ninth embodiment of the invention. In this embodiment, the image device 400A comprises a plurality of twenty-ninth sections 401. The twenty-ninth section 401 includes a first pixel group 52, a second pixel group 53, a third pixel group 54 and a fourth pixel group 102. In this embodiment, the first pixel group 52, the second pixel group 53, the third pixel group 54 and the fourth pixel group 102 are the same as those in the thirty-third embodiment.

In this embodiment, the first pixel group 52 is disposed on a first column and first row position of the twenty-ninth section 401, the second pixel group 53 is disposed on a second column and first row position of the twenty-ninth section 401, the fourth pixel group 102 is disposed on a first column and second row position of the twenty-ninth section 401, the third pixel group 54 is disposed on a second column and second row position of the twenty-ninth section 401. In the twenty-ninth section 401, the first pixel group 52, the second pixel group 53, the third pixel group 54 and the fourth pixel group 102 reach a white balance. Further, the second pixel group 53 and the third pixel group 54 in the twenty-ninth section 401 and the first pixel group 52 and the fourth pixel group 102 in the adjacent twenty-ninth section 401 arranged in a 2×2 matrix also can reach a white balance.

Figure 52:
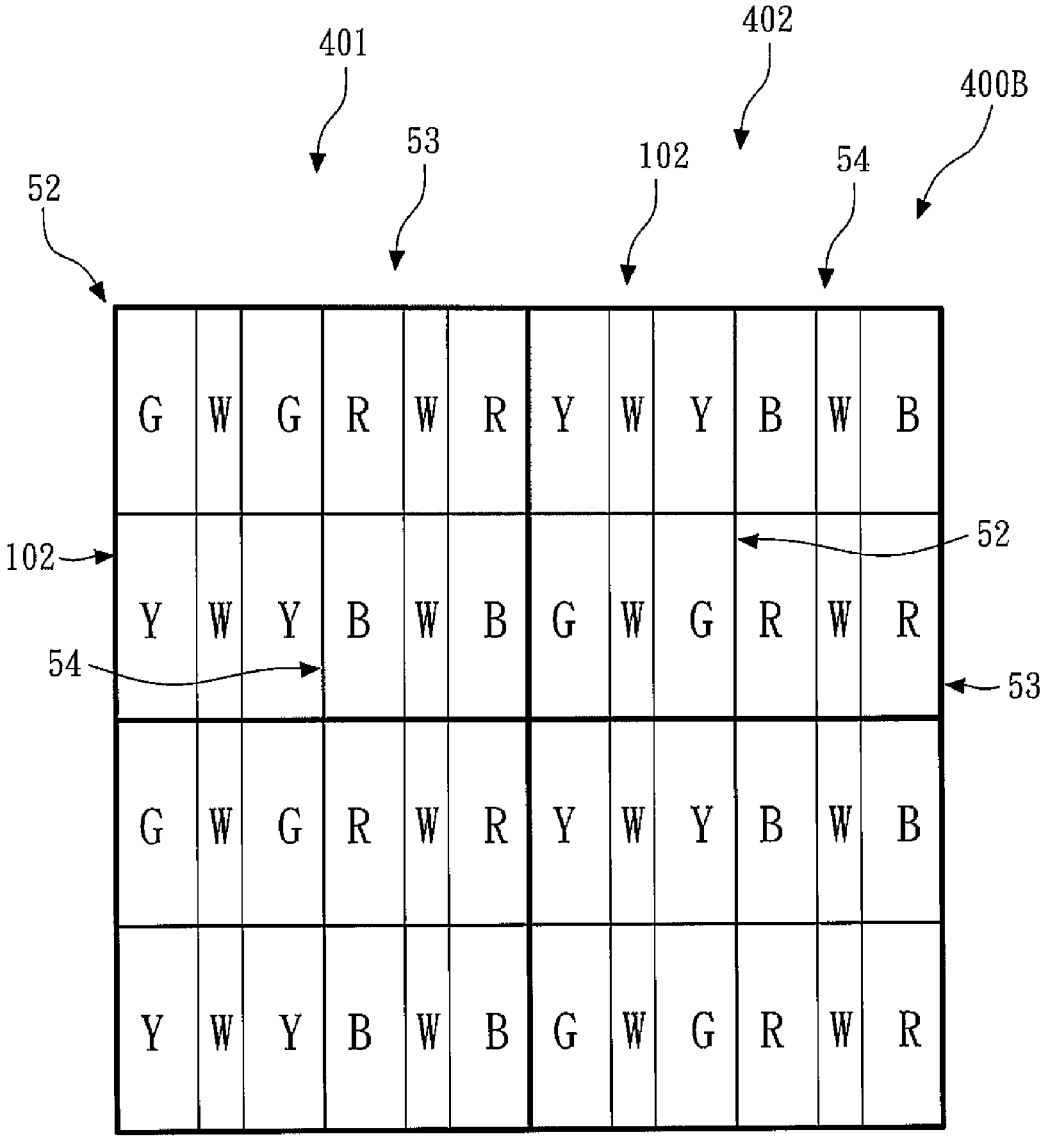
FIG. 52 shows the image device according to a fiftieth embodiment of the invention.

Referring to FIG. 52, it shows the image device according to a fiftieth embodiment of the invention. In this embodiment, the image device 400B comprises a plurality of twenty-ninth sections 401 and a plurality of thirtieth sections 402. Each thirtieth section 402 comprises the first pixel group 52, the second pixel group 53, the third pixel group 54 and the fourth pixel group 102. The fourth pixel group 102 is disposed on a first column and first row position of the thirtieth section 402, the third pixel group 54 is disposed on a second column and first row position of the thirtieth section 402, the first pixel group 52 is disposed on a first column and second row position of the thirtieth section 402, the second pixel group 53 is disposed on a second column and second row position of the thirtieth section 402.

In the thirtieth section 402, the first pixel group 52, the second pixel group 53, the third pixel group 54 and the fourth pixel group 102 reach a white balance. Further, the second pixel group 53 and the third pixel group 54 in the twenty-ninth section 401 and the first pixel group 52 and the fourth pixel group 102 in the adjacent thirtieth section 402 arranged in a 2×2 matrix also can reach a white balance.

Figure 53:
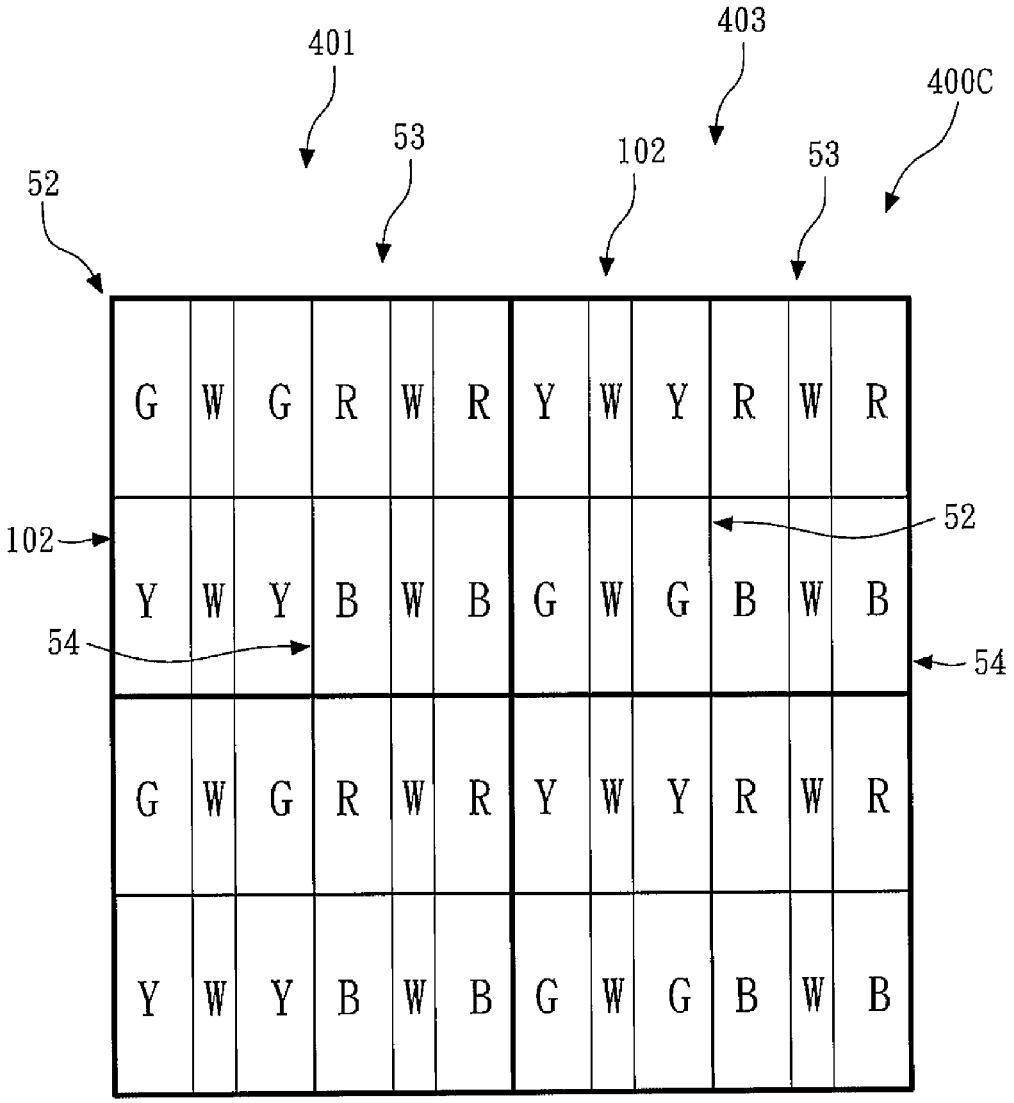
FIG. 53 shows the image device according to a fifty-first embodiment of the invention.

Referring to FIG. 53, it shows the image device according to a fifty-first embodiment of the invention. In this embodiment, the image device 400C comprises a plurality of twenty-ninth sections 101 and a plurality of thirty-first sections 403. Each thirty-first section 403 comprises the first pixel group 52, the second pixel group 53, the third pixel group 54 and the fourth pixel group 102. The fourth pixel group 102 is disposed on a first column and first row position of the thirty-first section 403, the second pixel group 53 is disposed on a second column and first row position of the thirty-first section 403, the first pixel group 52 is disposed on a first column and second row position of the thirty-first section 403, the third pixel group 54 is disposed on a second column and second row position of the thirty-first section 403.

In the thirty-first section 403, the first pixel group 52, the second pixel group 53, the third pixel group 54 and the fourth pixel group 102 reach a white balance. Further, the second pixel group 53 and the third pixel group 54 in the twenty-ninth section 401 and the first pixel group 52 and the fourth pixel group 102 in the adjacent thirty-first section 403 arranged in a 2×2 matrix also can reach a white balance.

Figure 54:
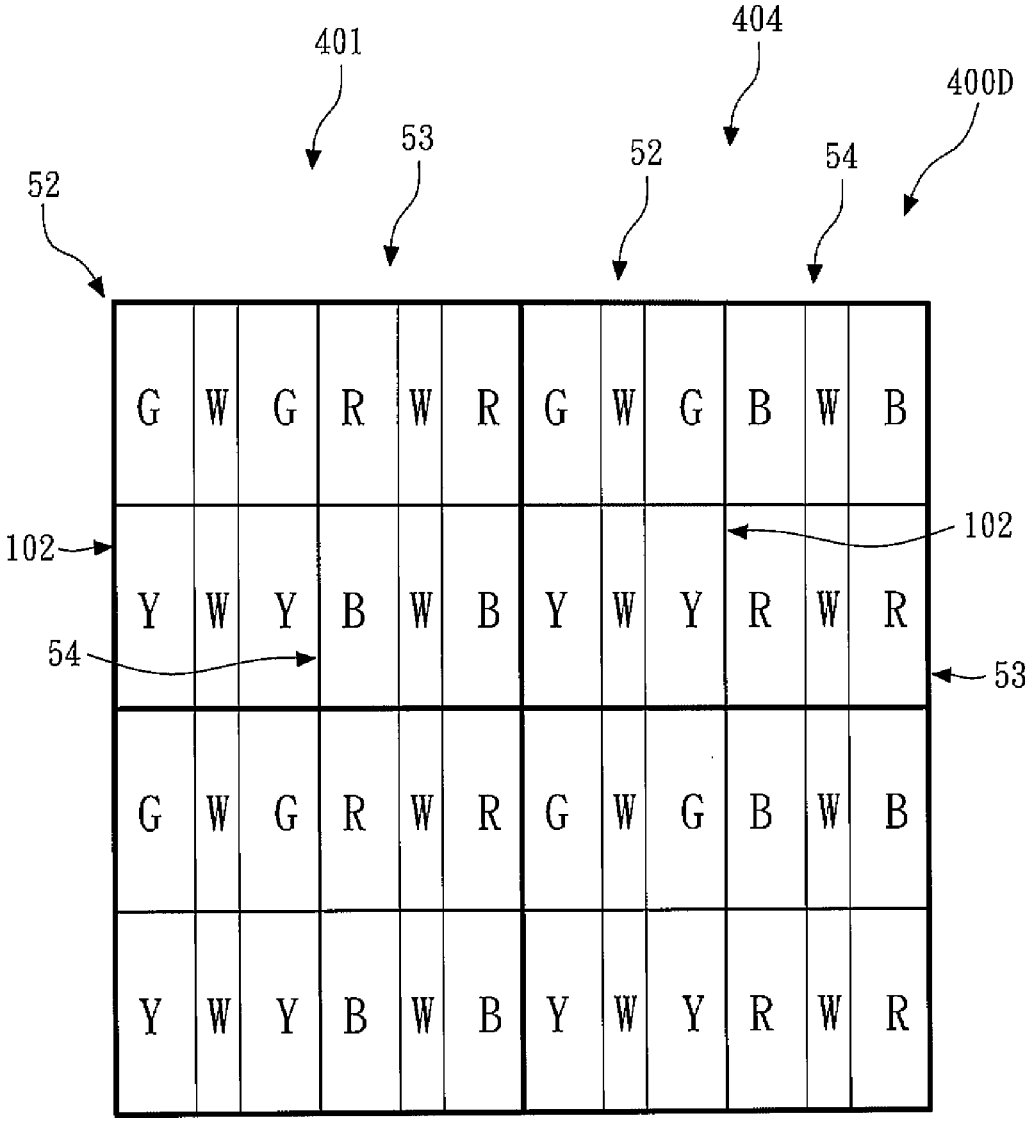
FIG. 54 shows the image device according to a fifty-second embodiment of the invention.

Referring to FIG. 54, it shows the image device according to a fifty-second embodiment of the invention. In this embodiment, the image device 400D comprises a plurality of twenty-ninth sections 401 and a plurality of thirty-second sections 404. Each thirty-second section 404 comprises the first pixel group 52, the second pixel group 53, the third pixel group 54 and the fourth pixel group 102. The first pixel group 52 is disposed on a first column and first row position of the thirty-second section 404, the third pixel group 54 is disposed on a second column and first row position of the thirty-second section 404, the fourth pixel group 102 is disposed on a first column and second row position of the thirty-second section 404, the second pixel group 53 is disposed on a second column and second row position of the thirty-second section 404.

In the thirty-second section 404, the first pixel group 52, the second pixel group 53, the third pixel group 54 and the fourth pixel group 102 reach a white balance. Further, the second pixel group 53 and the fourth pixel group 102 in the twenty-ninth section 401 and the first pixel group 52 and the third pixel group 54 in the adjacent thirty-second section 404 arranged in a 2×2 matrix also can reach a white balance.

Figure 55:
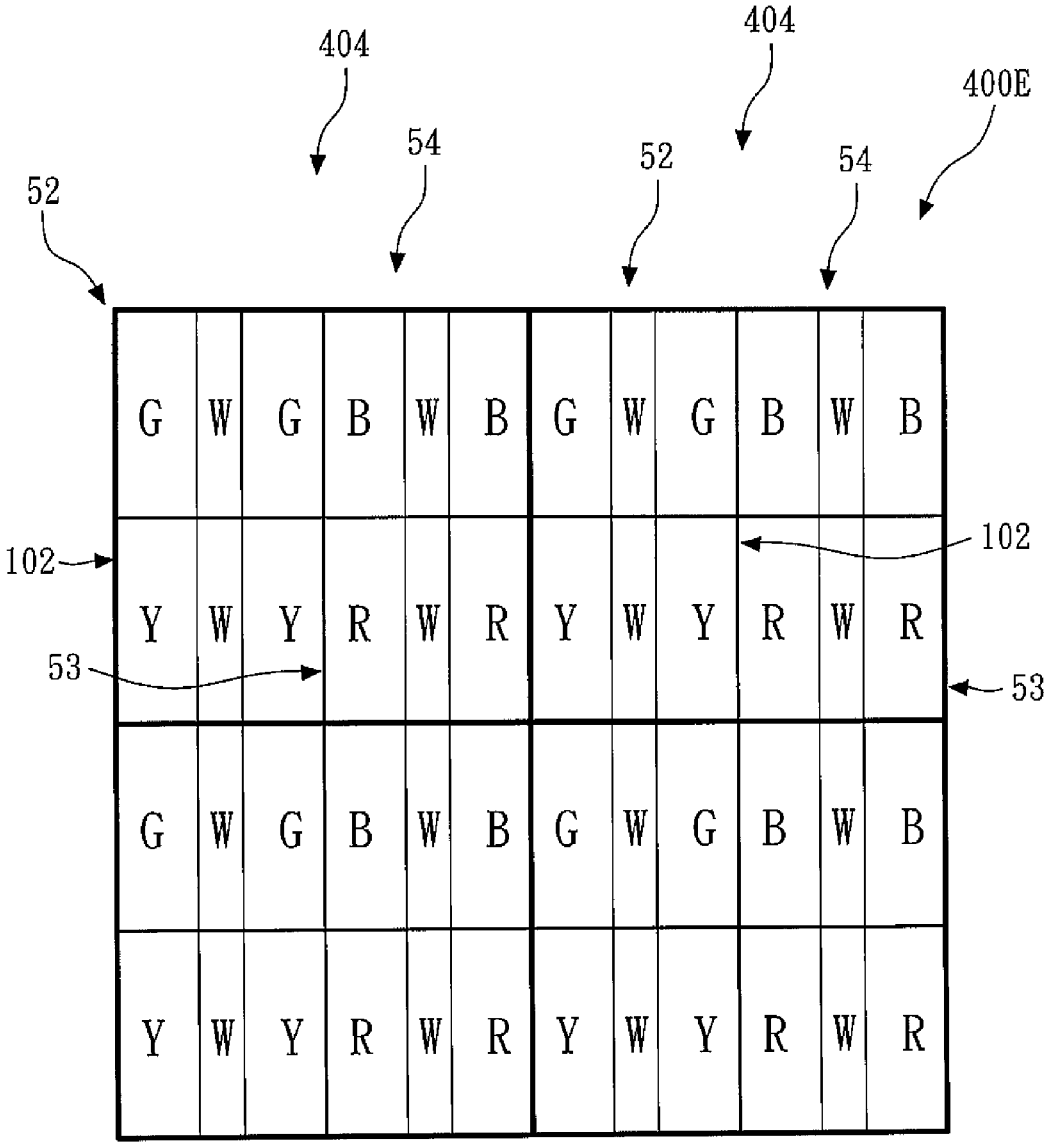
FIG. 55 shows the image device according to a fifty-third embodiment of the invention.

Referring to FIG. 55, it shows the image device according to a fifty-third embodiment of the invention. In this embodiment, the image device 400E comprises a plurality of thirty-second sections 404. In the thirty-second section 404, the first pixel group 52, the second pixel group 53, the third pixel group 54 and the fourth pixel group 102 reach a white balance. Further, the second pixel group 53 and the third pixel group 54 in the thirty-second section 404 and the first pixel group 52 and the fourth pixel group 102 in the adjacent thirty-second section 404 arranged in a 2×2 matrix also can reach a white balance.

Figure 56:
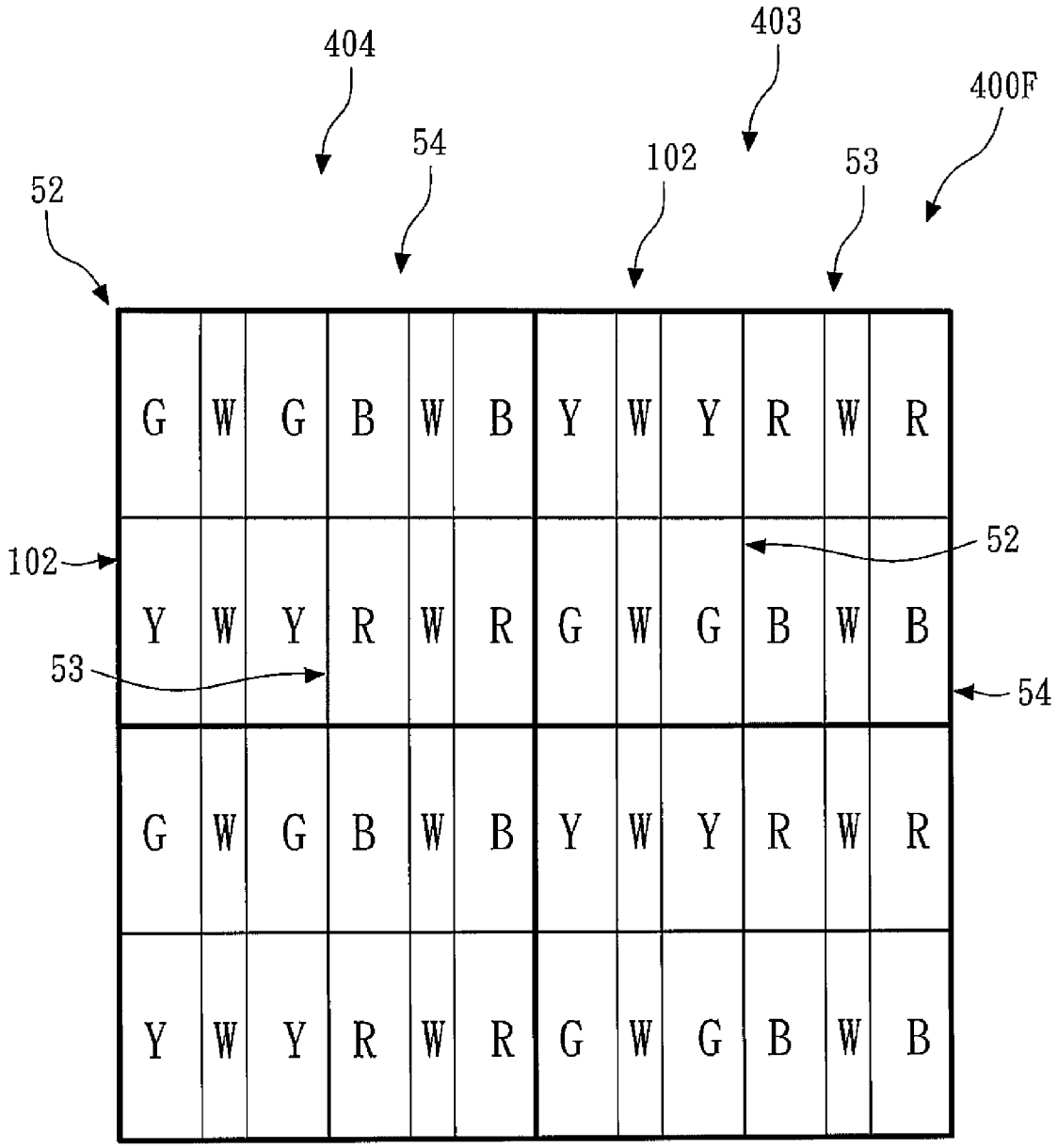
FIG. 56 shows the image device according to a fifty-fourth embodiment of the invention.

Referring to FIG. 56, it shows the image device according to a fifty-fourth embodiment of the invention. In this embodiment, the image device 400F comprises a plurality of thirty-second sections 404 and a plurality of thirty-first sections 403. The second pixel group 53 and the third pixel group 54 in the thirty-second section 404 and the first pixel group 52 and the fourth pixel group 102 in the adjacent thirty-first section 403 arranged in a 2×2 matrix also can reach a white balance.

Figure 57:
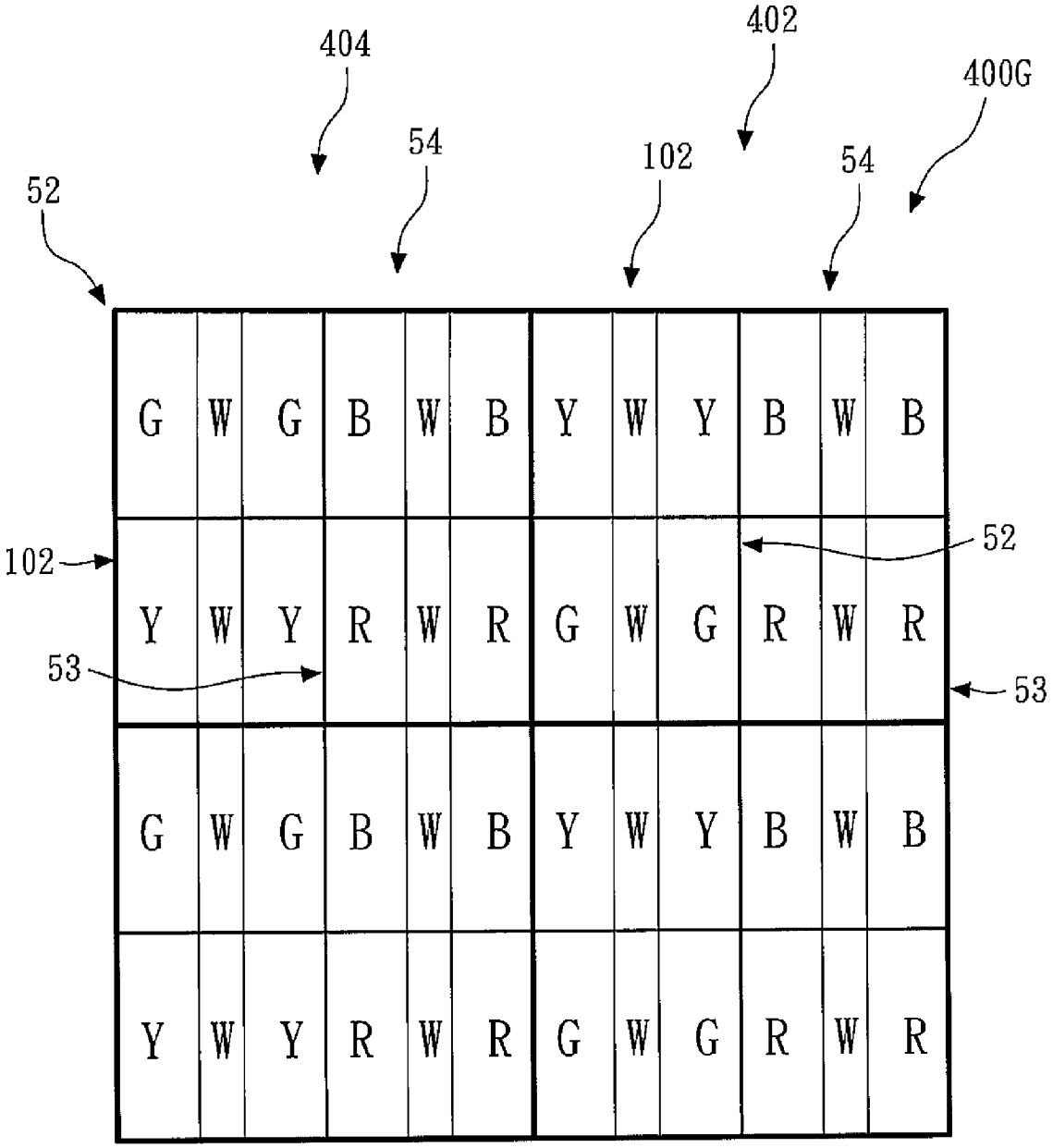
FIG. 57 shows the image device according to a fifty-fifth embodiment of the invention.

Referring to FIG. 57, it shows the image device according to a fifty-fifth embodiment of the invention. In this embodiment, the image device 400G comprises a plurality of thirty-second sections 404 and a plurality of thirtieth sections 402. The second pixel group 53 and the third pixel group 54 in the thirty-second section 404 and the first pixel group 52 and the fourth pixel group 102 in the adjacent thirtieth section 402 arranged in a 2×2 matrix also can reach a white balance.

Figure 58:
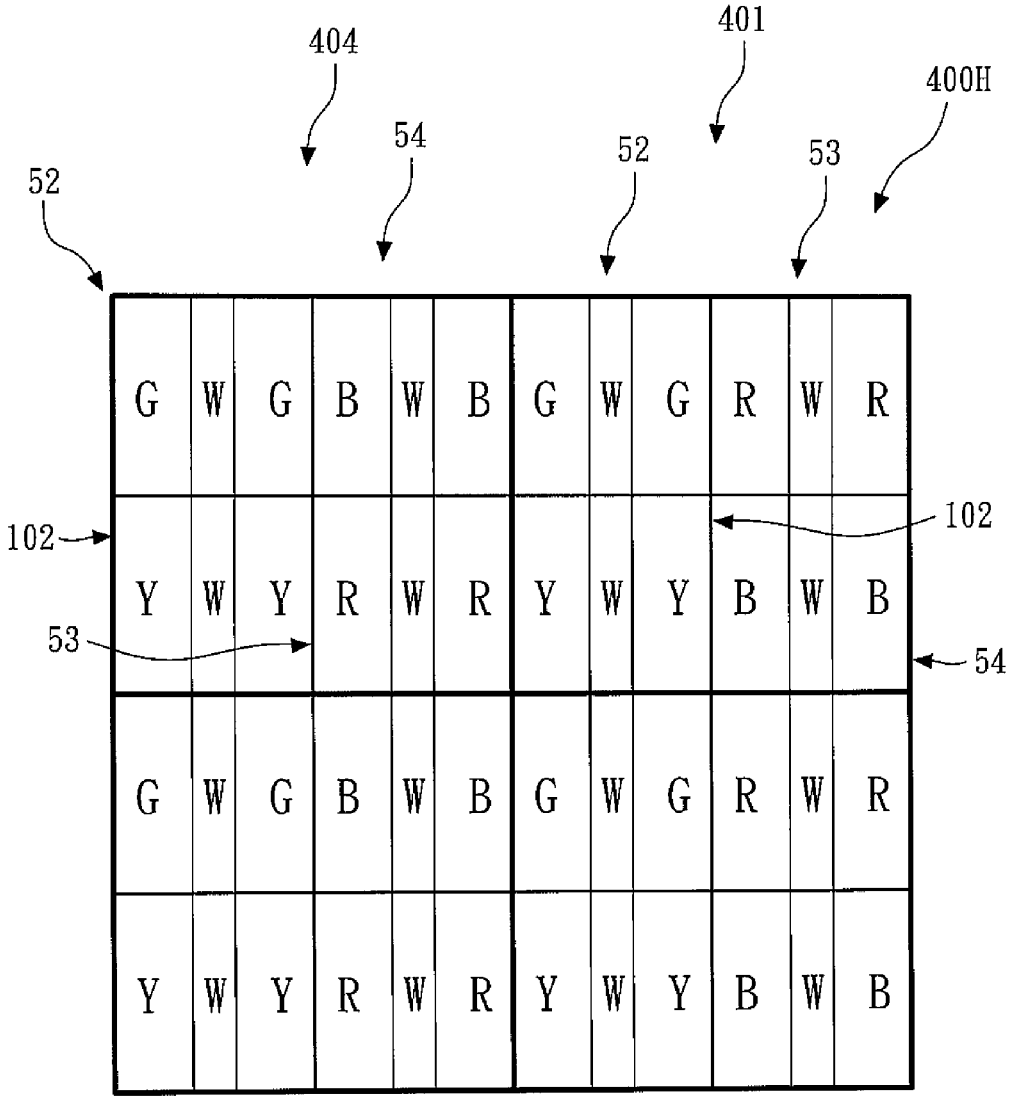
FIG. 58 shows the image device according to a fifty-sixth embodiment of the invention.

Referring to FIG. 58, it shows the image device according to a fifty-sixth embodiment of the invention. In this embodiment, the image device 400H comprises a plurality of thirty-second sections 404 and a plurality of twenty-ninth sections 401. The second pixel group 53 and the third pixel group 54 in the thirty-second section 404 and the first pixel group 52 and the fourth pixel group 102 in the adjacent twenty-ninth section 401 arranged in a 2×2 matrix also can reach a white balance.

Figure 59:
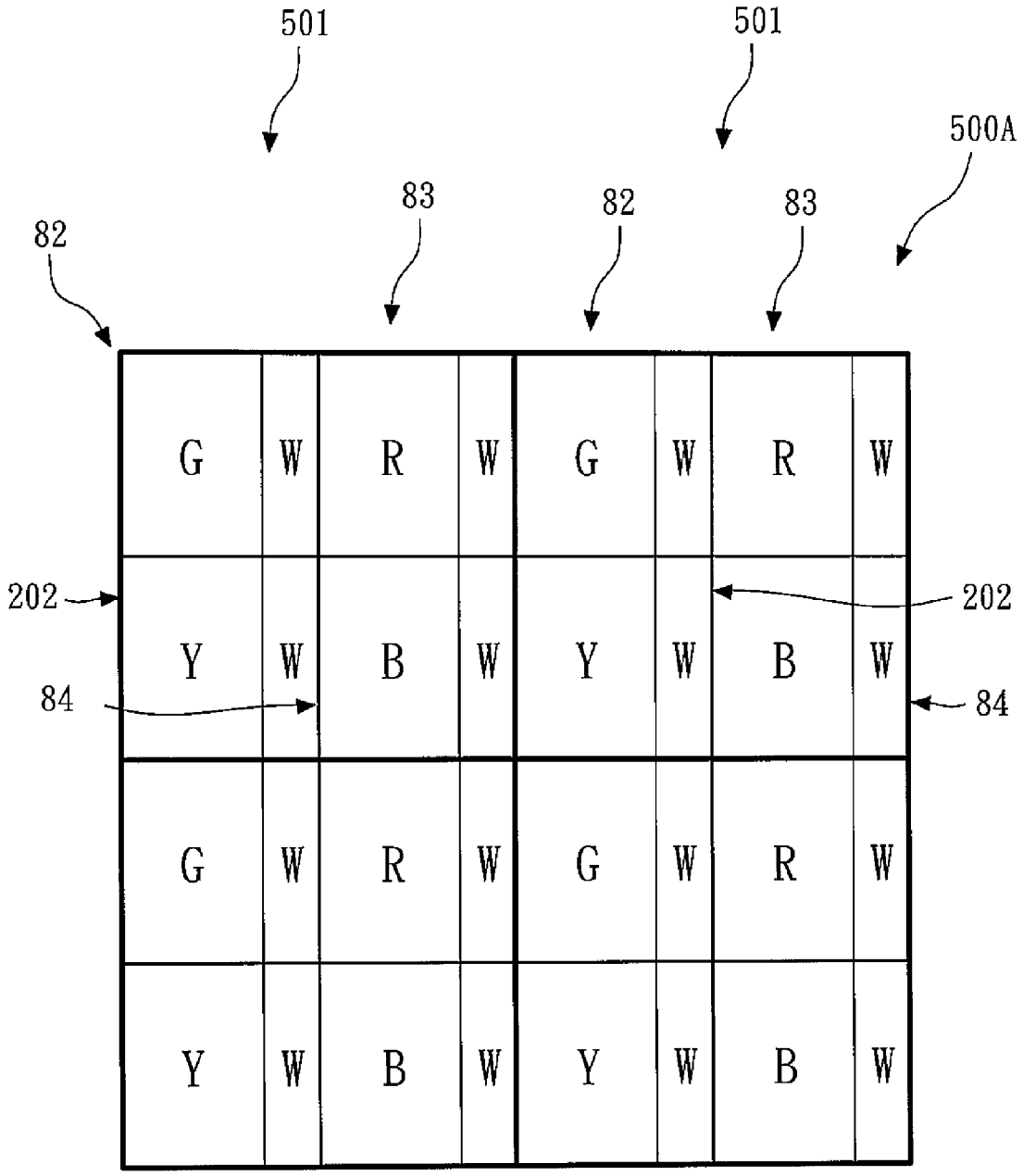
FIG. 59 shows the image device according to a fifty-seventh embodiment of the invention.

Referring to FIG. 59, it shows the image device according to a fifty-seventh embodiment of the invention. In this embodiment, the image device 500A comprises a plurality of thirty-third sections 501. The thirty-third section 501 includes a first pixel group 82, a second pixel group 83, a third pixel group 84 and a fourth pixel group 202. In this embodiment, the first pixel group 82, the second pixel group 83, the third pixel group 84, and the fourth pixel group 202 are the same as those in the thirty-seventh embodiment.

The first pixel group 82 is disposed on a first column and first row position of the thirty-third section 501, the second pixel group 83 is disposed on a second column and first row position of the thirty-third section 501, the fourth pixel group 202 is disposed on a first column and second row position of the thirty-third section 501, the third pixel group 84 is disposed on a second column and second row position of the thirty-third section 501.

In this embodiment, in the thirty-third section 501, the first pixel group 82, the second pixel group 83, the third pixel group 84 and the fourth pixel group 202 reach a white balance. Further, the second pixel group 83 and the third pixel group 84 in the thirty-third section 501 and the first pixel group 82 and the fourth pixel group 202 in the adjacent thirty-third section 501 arranged in a 2×2 matrix also can reach a white balance.

Figure 60:
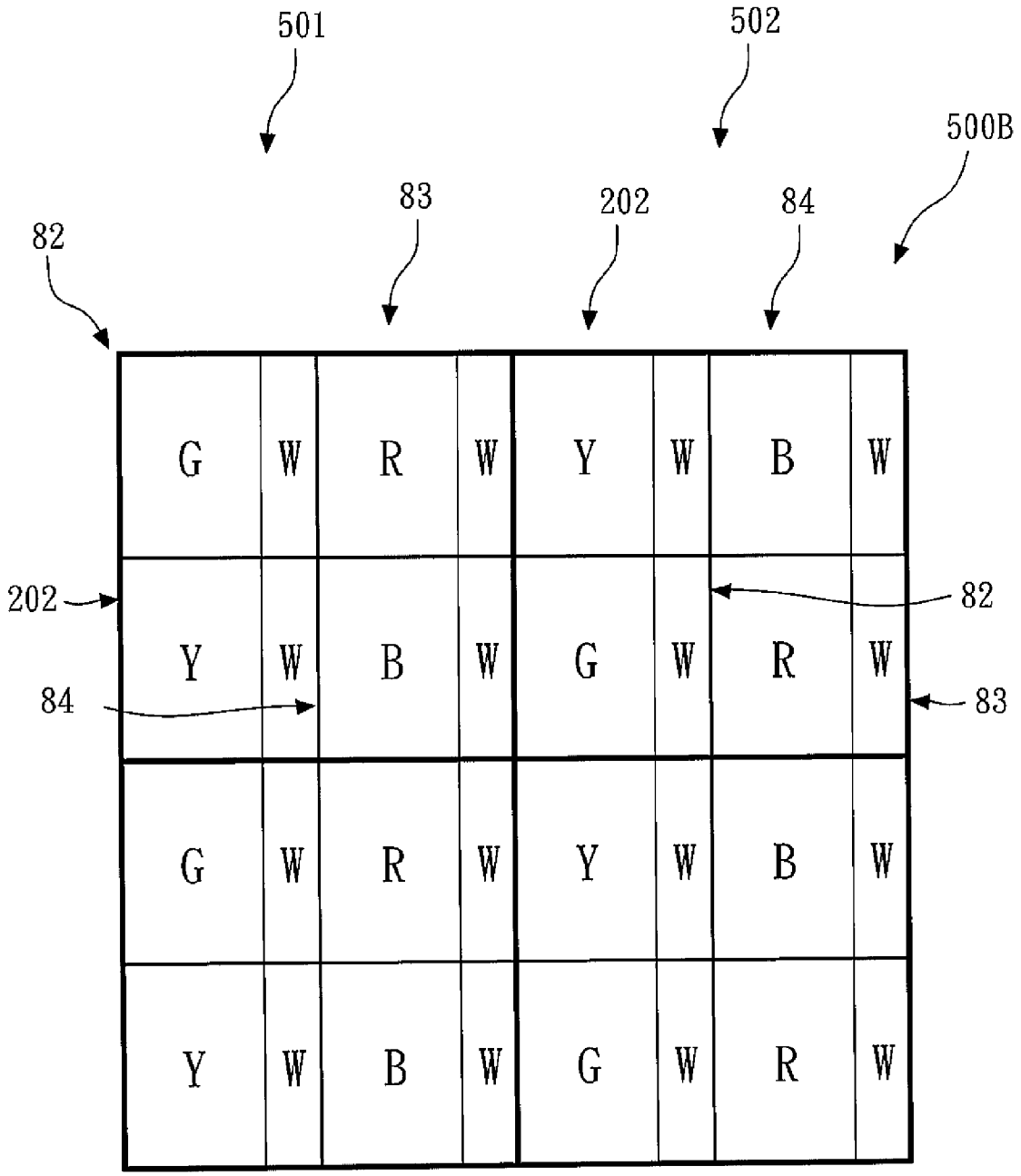
FIG. 60 shows the image device according to a fifty-eighth embodiment of the invention.

Referring to FIG. 60, it shows the image device according to a fifty-eighth embodiment of the invention. In this embodiment, the image device 500B comprises a plurality of thirty-third sections 501 and a plurality of thirty-fourth sections 502. Each thirty-fourth section 502 comprises the first pixel group 82, the second pixel group 83, the third pixel group 84 and the fourth pixel group 202. The fourth pixel group 202 is disposed on a first column and first row position of the thirty-fourth section 502, the third pixel group 84 is disposed on a second column and first row position of the thirty-fourth section 502, the first pixel group 82 is disposed on a first column and second row position of the thirty-fourth section 502, the second pixel group 83 is disposed on a second column and second row position of the thirty-fourth section 502.

In the thirty-fourth section 502, the first pixel group 82, the second pixel group 83, the third pixel group 84 and the fourth pixel group 202 reach a white balance. Further, the second pixel group 83 and the third pixel group 84 in the thirty-third section 501 and the first pixel group 82 and the fourth pixel group 202 in the adjacent thirty-fourth section 502 arranged in a 2×2 matrix also can reach a white balance.

Figure 61:
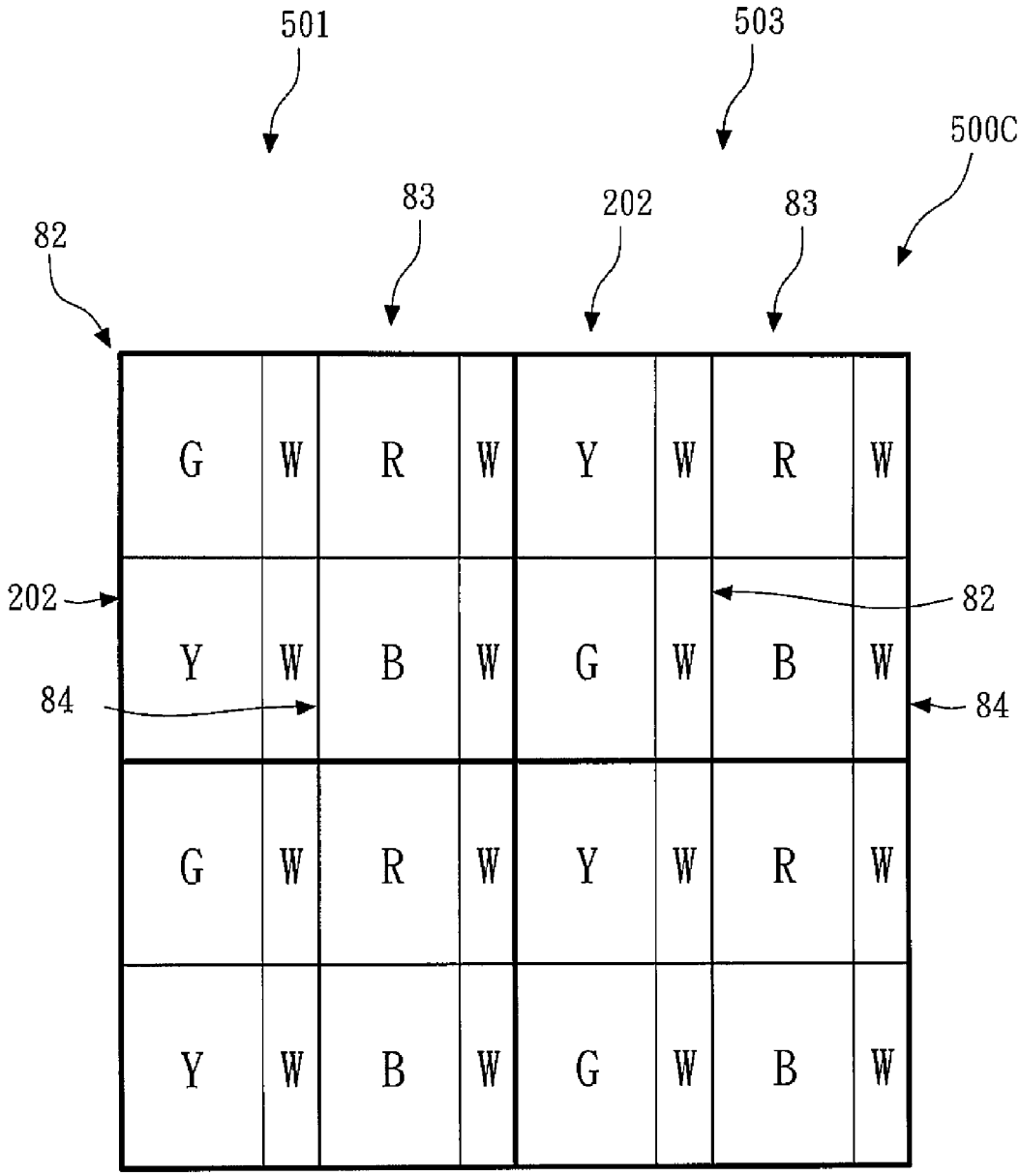
FIG. 61 shows the image device according to a fifty-ninth embodiment of the invention.

Referring to FIG. 61, it shows the image device according to a fifty-ninth embodiment of the invention. In this embodiment, the image device 500C comprises a plurality of thirty-third sections 501 and a plurality of thirty-fifth sections 503. Each thirty-fifth section 503 comprises the first pixel group 82, the second pixel group 83, the third pixel group 84 and the fourth pixel group 202. The fourth pixel group 202 is disposed on a first column and first row position of the thirty-fifth section 503, the second pixel group 83 is disposed on a second column and first row position of the thirty-fifth section 503, the first pixel group 82 is disposed on a first column and second row position of the thirty-fifth section 503, the third pixel group 84 is disposed on a second column and second row position of the thirty-fifth section 503.

In the thirty-fifth section 503, the first pixel group 82, the second pixel group 83, the third pixel group 84 and the fourth pixel group 202 reach a white balance. Further, the second pixel group 83 and the third pixel group 84 in the thirty-third section 501 and the first pixel group 82 and the fourth pixel group 202 in the adjacent thirty-fifth section 503 arranged in a 2×2 matrix also can reach a white balance.

Figure 62:
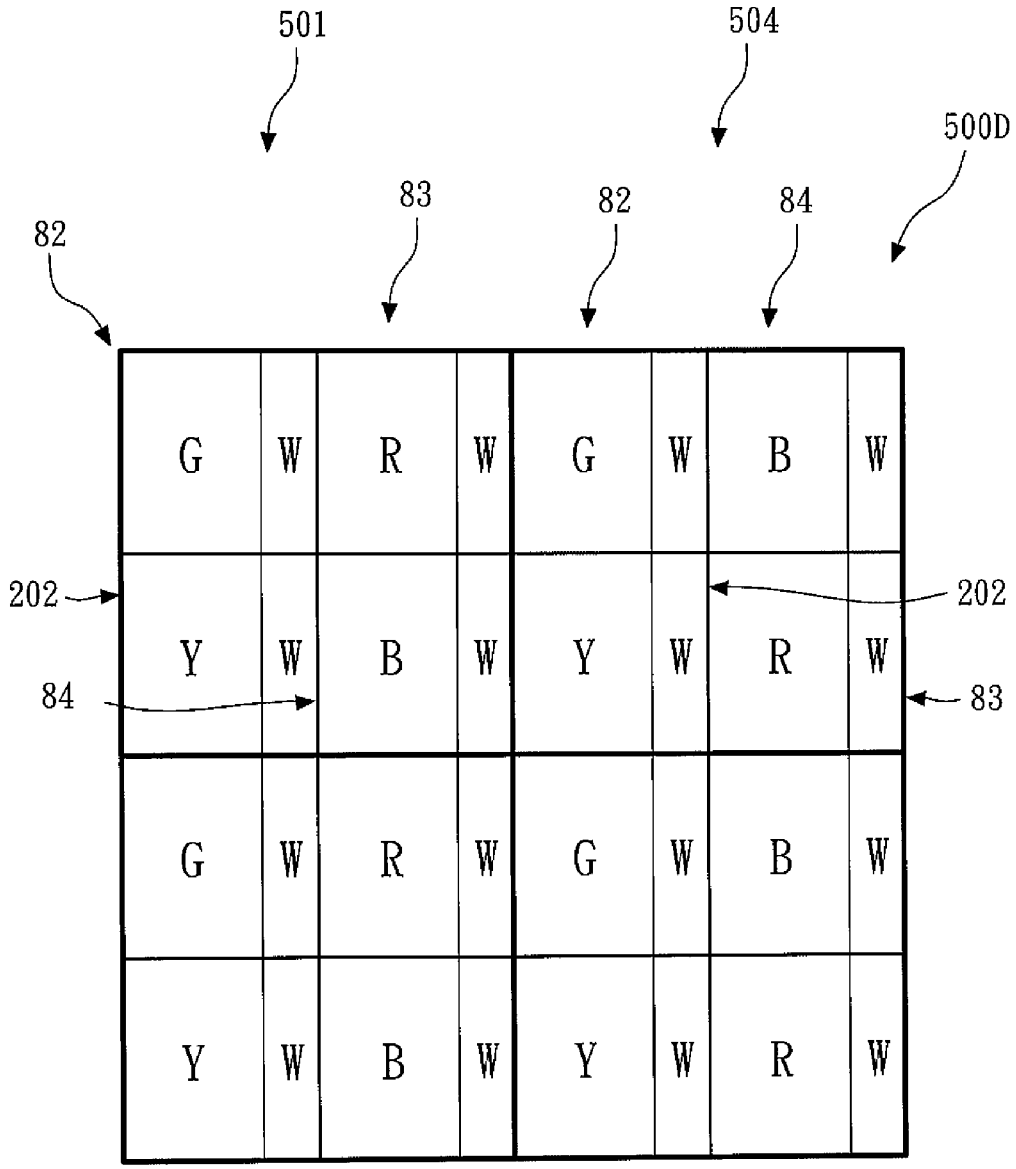
FIG. 62 shows the image device according to a sixtieth embodiment of the invention.

Referring to FIG. 62, it shows the image device according to a sixtieth embodiment of the invention. In this embodiment, the image device 500D comprises a plurality of thirty-third sections 501 and a plurality of thirty-sixth sections 504. Each thirty-sixth section 504 comprises the first pixel group 82, the second pixel group 83, the third pixel group 84 and the fourth pixel group 202. The first pixel group 82 is disposed on a first column and first row position of the thirty-sixth section 504, the third pixel group 84 is disposed on a second column and first row position of the thirty-sixth section 504, the fourth pixel group 202 is disposed on a first column and second row position of the thirty-sixth section 504, the second pixel group 83 is disposed on a second column and second row position of the thirty-sixth section 504.

In the thirty-sixth section 504, the first pixel group 82, the second pixel group 83, the third pixel group 84 and the fourth pixel group 202 reach a white balance. Further, the second pixel group 83 and the third pixel group 84 in the thirty-third section 501 and the first pixel group 82 and the fourth pixel group 202 in the adjacent thirty-sixth section 504 arranged in a 2×2 matrix also can reach a white balance.

Figure 63:
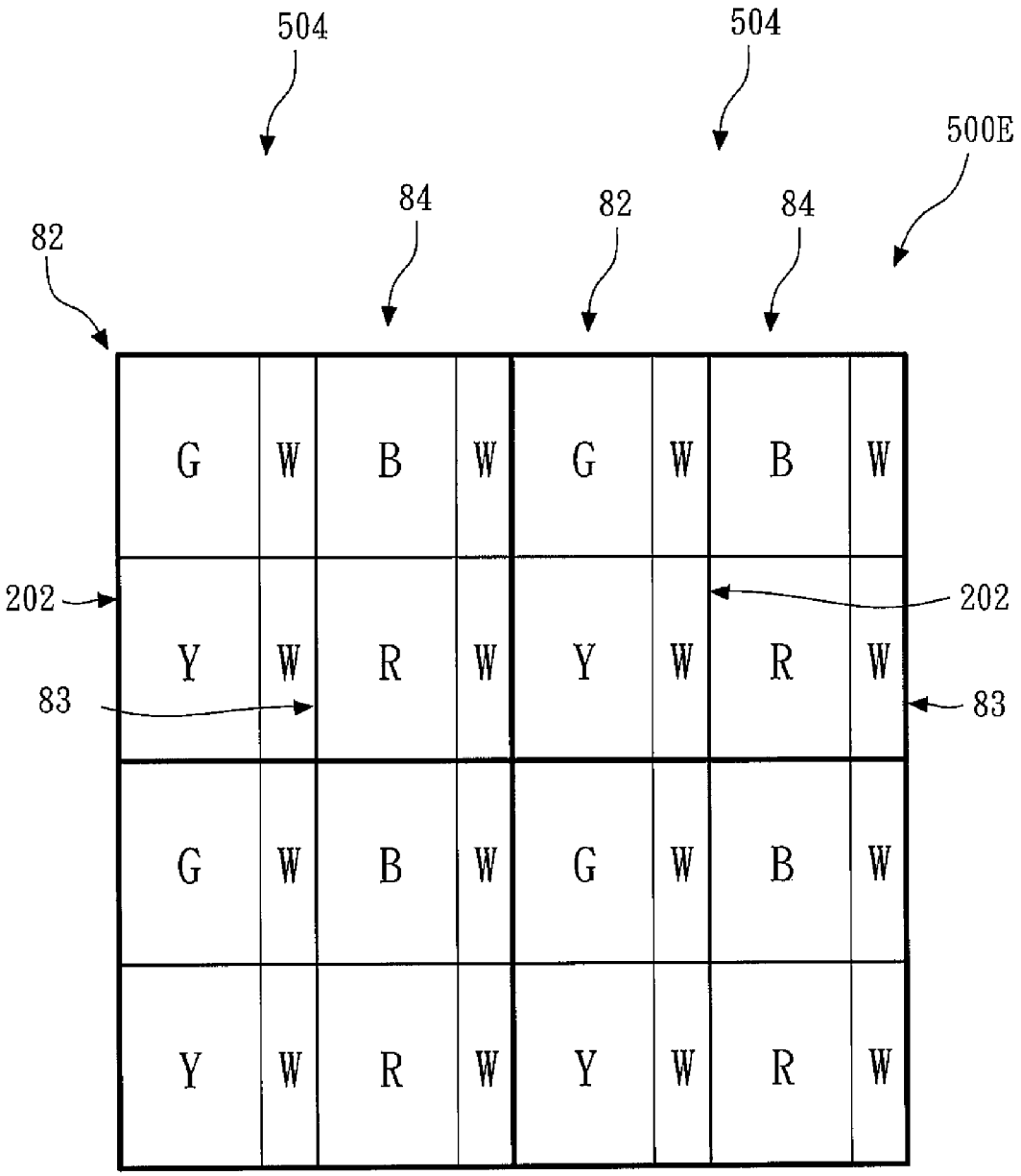
FIG. 63 shows the image device according to a sixty-first embodiment of the invention.

Referring to FIG. 63, it shows the image device according to a sixty-first embodiment of the invention. In this embodiment, the image device 500E comprises a plurality of thirty-sixth sections 504. In the thirty-sixth section 504, the first pixel group 82, the second pixel group 83, the third pixel group 84 and the fourth pixel group 202 reach a white balance. Further, the second pixel group 83 and the third pixel group 84 in the thirty-sixth section 504 and the first pixel group 82 and the fourth pixel group 202 in the adjacent thirty-sixth section 504 arranged in a 2×2 matrix also can reach a white balance.

Figure 64:
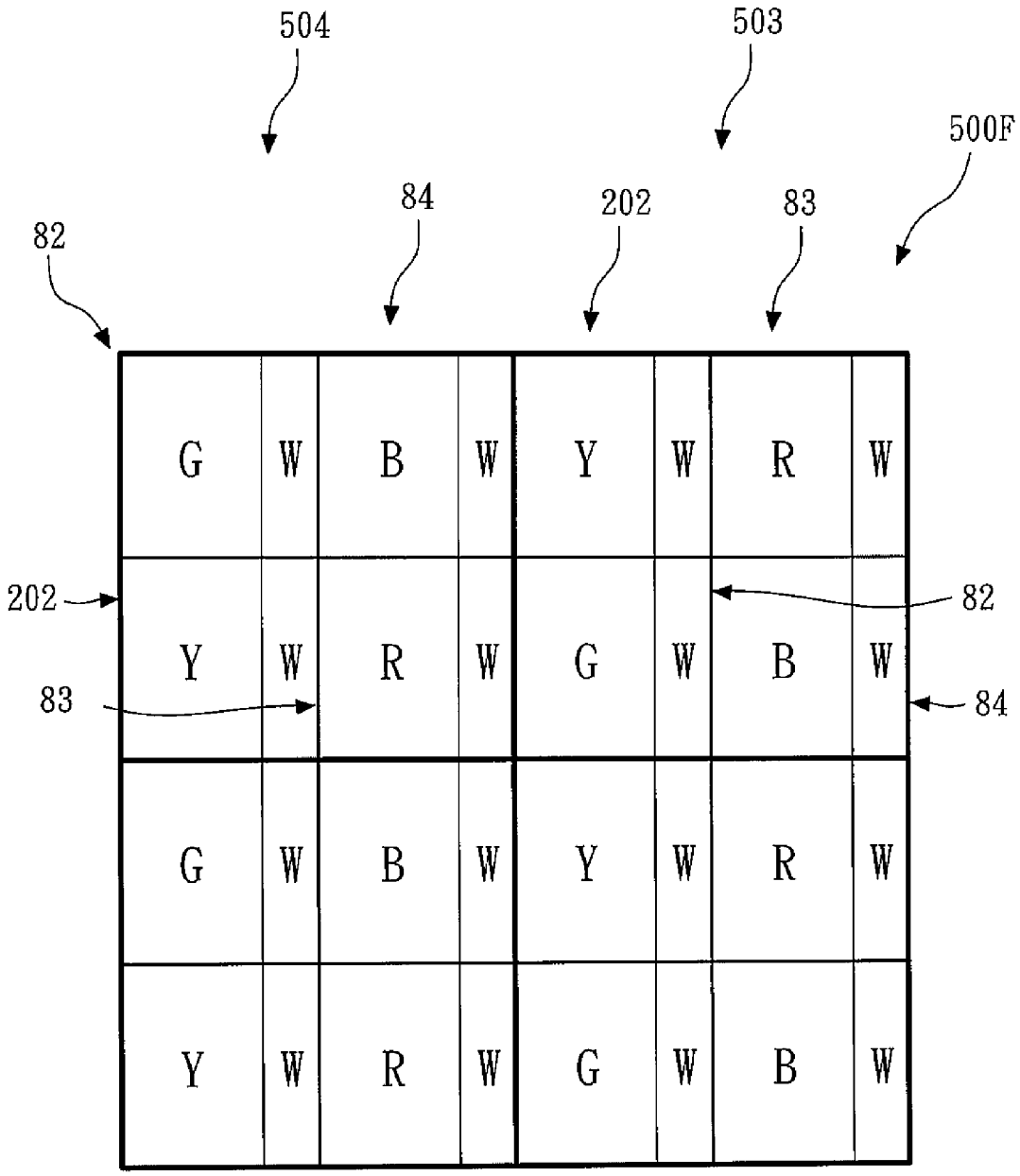
FIG. 64 shows the image device according to a sixty-second embodiment of the invention.

Referring to FIG. 64, it shows the image device according to a sixty-second embodiment of the invention. In this embodiment, the image device 500F comprises a plurality of thirty-sixth sections 504 and a plurality of thirty-fifth sections 503. The second pixel group 83 and the third pixel group 84 in the thirty-sixth section 504 and the first pixel group 82 and the fourth pixel group 202 in the adjacent thirty-fifth section 503 arranged in a 2×2 matrix also can reach a white balance.

Figure 65:
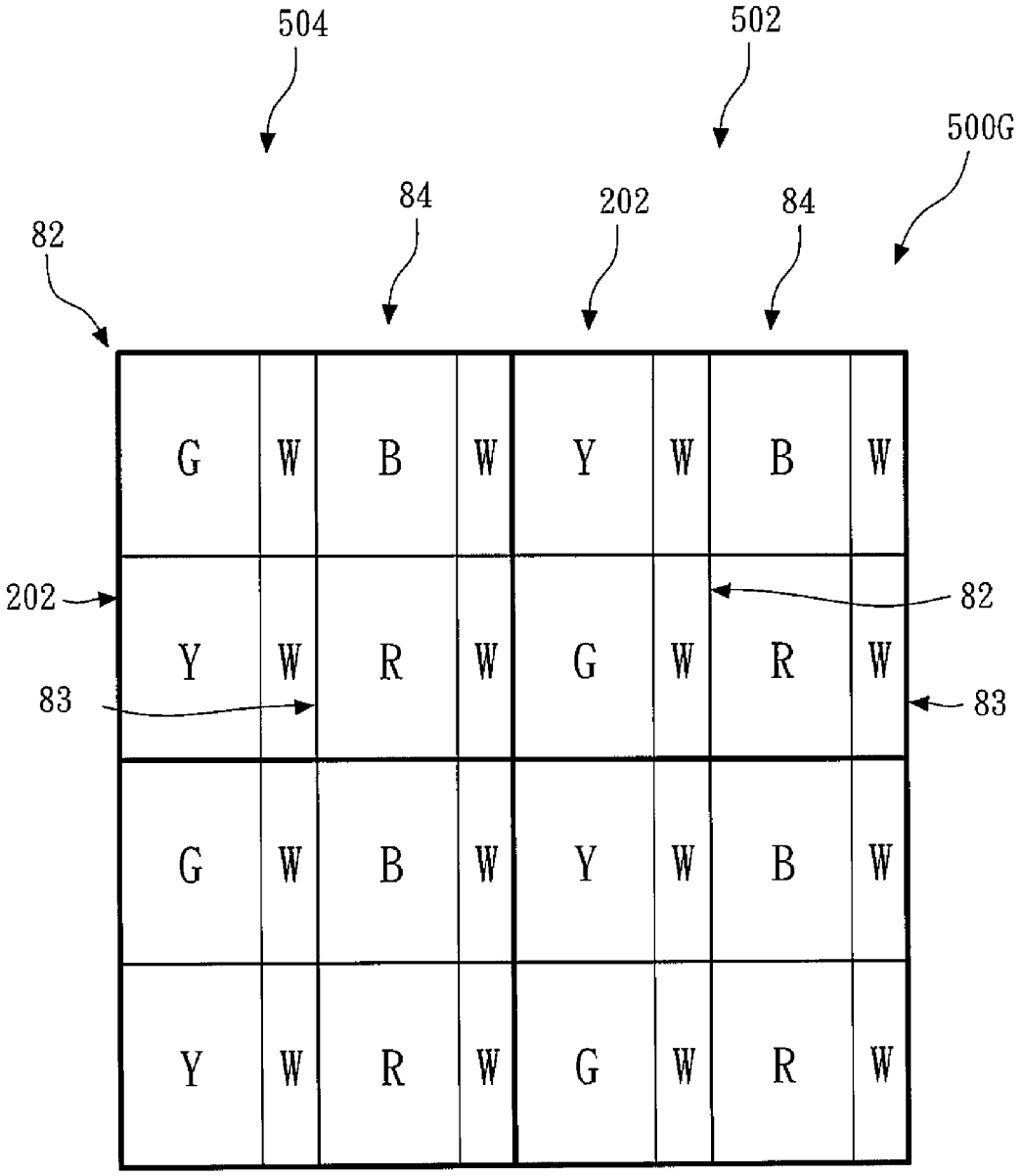
FIG. 65 shows the image device according to a sixty-third embodiment of the invention.

Referring to FIG. 65, it shows the image device according to a sixty-third embodiment of the invention. In this embodiment, the image device 500G comprises a plurality of thirty-sixth sections 504 and a plurality of thirty-fourth sections 502. The second pixel group 83 and the third pixel group 84 in the thirty-sixth section 504 and the first pixel group 82 and the fourth pixel group 202 in the adjacent thirty-fourth section 502 arranged in a 2×2 matrix also can reach a white balance.

Figure 66:
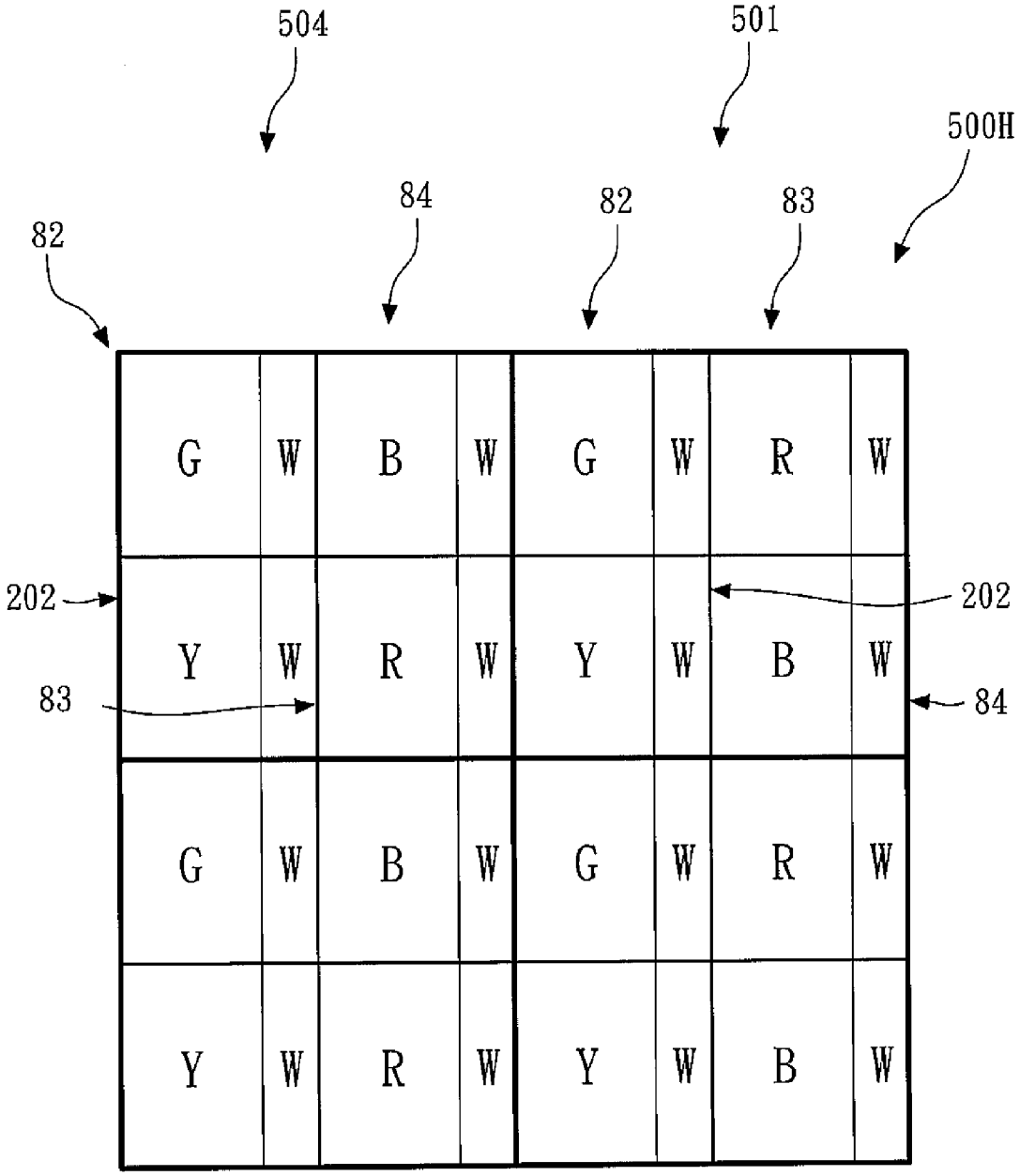
FIG. 66 shows the image device according to a sixty-fourth embodiment of the invention.

Referring to FIG. 66, it shows the image device according to a sixty-fourth embodiment of the invention. In this embodiment, the image device 500H comprises a plurality of thirty-sixth sections 504 and a plurality of thirty-third sections 501. The second pixel group 83 and the third pixel group 84 in the thirty-sixth section 504 and the first pixel group 82 and the fourth pixel group 202 in the adjacent thirty-third section 501 arranged in a 2×2 matrix also can reach a white balance.

Given the above, the second color dot (W) can be disposed between the two first color dots (G) in the first pixel group, the second color dot (W) can be disposed between the two third color dots (R) in the second pixel group, and the second color dot (W) can be disposed between the two fourth color dots (B) in the third pixel group in the first embodiment. However, in the invention the second color dot (W) can be disposed on the left side or the right side of the first pixel group, the second pixel group, and the third pixel group. For example, in FIG. 27, the second color dot (W) is disposed on the left side or the right side of the first pixel group, the second pixel group, and the third pixel group. Therefore, the second color dot (W) can be flexibly disposed on any position of the first pixel group, the second pixel group, and the third pixel group to adjust to reach a white balance.

Furthermore, the area of the second color dot (W) in the first pixel group, the second pixel group, and the third pixel group can be adjusted to reach a white balance. In the invention, the fifth color dot (Y) in the fourth pixel group can be further used to reach a white balance. In addition, black and white lines can be formed in rows or columns of the image device of the invention.

While embodiments of the present invention has been illustrated and described, various modifications and improvements can be made by those skilled in the art. The embodiments of the present invention are therefore described in an illustrative, but not restrictive, sense. It is intended that the present invention may not be limited to the particular forms as illustrated, and that all modifications which maintain the spirit and scope of the present invention are within the scope as defined in the appended claims.

What is claimed is:

1. An image device, comprising:

a plurality of sections, each of the sections comprising:

a plurality of pixel groups arranged in a first predetermined identical matrix form, each of the pixel groups comprising a plurality of dots arranged in a second predetermined identical matrix form, each of the sections having a first pixel group, a second pixel group, a third pixel group and a fourth pixel group, wherein the first pixel group comprises at least one first color dot and a second color dot or a fourth color dot, the second pixel group comprises at least one third color dot and the second color dot, the third pixel group comprises at least one fourth color dot and the second color dot, and the fourth pixel group comprises at least one fifth color dot or at least one second color dot; and any four of the first pixel group, the second pixel group, the third pixel group and the fourth pixel group are arranged adjacent to each other in a 2×2 matrix in order to reach a white balance, wherein the first predetermined identical matrix is different from the second predetermined identical matrix.

2. The image device according to claim 1, wherein the first color dot is a green color dot, the second color dot is a white color dot, the third color dot is a red color dot and the fourth color dot is a blue color dot.

3. The image device according to claim 2, wherein the first pixel group comprises two first color dots and one second color dot, the second color dot is disposed between the two first color dots; the second pixel group comprises two third color dot and one second color dot, the second color dot is disposed between the two third color dots; the third pixel group comprises two fourth color dots and one second color dot, the second color dot is disposed between the two fourth color dots.

4. The image device according to claim 3, wherein the fourth pixel group comprises two fifth color dots and one fourth color dot, the fourth color dot is disposed between the two fifth color dots in the fourth pixel group and the fifth color dot is a yellow color dot.

5. The image device according to claim 4, wherein the image device comprises a plurality of first sections, each first section comprises the first pixel group, the second pixel group, the third pixel group and the fourth pixel group, the first pixel group is disposed on a first column and first row position of the first section, the second pixel group is disposed on a second column and first row position of the first section, the third pixel group is disposed on a first column and second row position of the first section, the fourth pixel group is disposed on a second column and second row position of the first section.

6. The image device according to claim 5, wherein an area of the second color dot is smaller than that of the first color dot in the first pixel group, an area of the second color dot is smaller than that of the third color dots in the second pixel group, and an area of the second color dot is smaller than that of the fourth color dots in the third pixel group; an area of the fourth color dot is smaller than that of the fifth color dot in the fourth pixel group.

7. The image device according to claim 4, wherein the image device comprises a plurality of second sections, each second section comprises the first pixel group, the second pixel group, the third pixel group and the fourth pixel group, the third pixel group is disposed on a first column and first row position of the second section, the fourth pixel group is disposed on a second column and first row position of the second section, the first pixel group is disposed on a first column and second row position of the second section, the second pixel group is disposed on a second column and second row position of the second section.

8. The image device according to claim 7, wherein an area of the second color dot is smaller than that of the first color dot in the first pixel group, an area of the second color dot is smaller than that of the third color dots in the second pixel group, and an area of the second color dot is smaller than that of the fourth color dots in the third pixel group; an area of the fourth color dot is smaller than that of the fifth color dot in the fourth pixel group.

9. The image device according to claim 4, wherein the image device comprises a plurality of third sections, each third section comprises the first pixel group, the second pixel group, the third pixel group and the fourth pixel group, the third pixel group is disposed on a first column and first row position of the third section, the second pixel group is disposed on a second column and first row position of the third section, the first pixel group is disposed on a first column and second row position of the third section, the fourth pixel group is disposed on a second column and second row position of the third section.

10. The image device according to claim 9, wherein an area of the second color dot is smaller than that of the first color dot in the first pixel group, an area of the second color dot is smaller than that of the third color dots in the second pixel group, and an area of the second color dot is smaller than that of the fourth color dots in the third pixel group; an area of the fourth color dot is smaller than that of the fifth color dot in the fourth pixel group.

11. The image device according to claim 4, wherein the image device comprises a plurality of fourth sections, each fourth section comprises the first pixel group, the second pixel group, the third pixel group and the fourth pixel group, the first pixel group is disposed on a first column and first row position of the fourth section, the fourth pixel group is disposed on a second column and first row position of the fourth section, the third pixel group is disposed on a first column and second row position of the fourth section, the second pixel group is disposed on a second column and second row position of the fourth section.

12. The image device according to claim 11, wherein an area of the second color dot is smaller than that of the first color dot in the first pixel group, an area of the second color dot is smaller than that of the third color dots in the second pixel group, and an area of the second color dot is smaller than that of the fourth color dots in the third pixel group; an area of the fourth color dot is smaller than that of the fifth color dot in the fourth pixel group.

13. The image device according to claim 3, wherein the fourth pixel group comprises one fifth color dot, one second color dot and one fourth color dot, the fourth color dot is disposed between the fifth color dot and the second color dot in the fourth pixel group, and the fifth color dot is a yellow color dot.

14. The image device according to claim 13, wherein the image device comprises a plurality of fifth sections, each fifth section comprises the first pixel group, the second pixel group, the third pixel group and the fourth pixel group, the first pixel group is disposed on a first column and first row position of the fifth section, the second pixel group is disposed on a second column and first row position of the fifth section, the third pixel group is disposed on a first column and second row position of the fifth section, the fourth pixel group is disposed on a second column and second row position of the fifth section.

15. The image device according to claim 13, wherein the image device comprises a plurality of sixth sections, each sixth section comprises the first pixel group, the second pixel group, the third pixel group and the fourth pixel group, the first pixel group is disposed on a first column and first row position of the sixth section, the fourth pixel group is disposed on a second column and first row position of the sixth section, the third pixel group is disposed on a first column and second row position of the sixth section, the second pixel group is disposed on a second column and second row position of the sixth section.

16. The image device according to claim 13, wherein the image device comprises a plurality of seventh sections, each seventh section comprises the first pixel group, the second pixel group, the third pixel group and the fourth pixel group, the third pixel group is disposed on a first column and first row position of the seventh section, the second pixel group is disposed on a second column and first row position of the seventh section, the first pixel group is disposed on a first column and second row position of the seventh section, the fourth pixel group is disposed on a second column and second row position of the seventh section.

17. The image device according to claim 13, wherein the image device comprises a plurality of eighth sections, each eighth section comprises the first pixel group, the second pixel group, the third pixel group and the fourth pixel group, the third pixel group is disposed on a first column and first row position of the eighth section, the fourth pixel group is disposed on a second column and first row position of the eighth section, the first pixel group is disposed on a first column and second row position of the eighth section, the second pixel group is disposed on a second column and second row position of the eighth section.

18. The image device according to claim 3, wherein the fourth pixel group comprises three second color dots.

19. The image device according to claim 18, wherein the image device comprises a plurality of ninth sections, each ninth section comprises the first pixel group, the second pixel group, the third pixel group and the fourth pixel group, the first pixel group is disposed on a first column and first row position of the ninth section, the second pixel group is disposed on a second column and first row position of the ninth section, the third pixel group is disposed on a first column and second row position of the ninth section, the fourth pixel group is disposed on a second column and second row position of the ninth section.

20. The image device according to claim 18, wherein the image device comprises a plurality of tenth sections, each tenth section comprises the first pixel group, the second pixel group, the third pixel group and the fourth pixel group, the first pixel group is disposed on a first column and first row position of the tenth section, the fourth pixel group is disposed on a second column and first row position of the tenth section, the third pixel group is disposed on a first column and second row position of the tenth section, the second pixel group is disposed on a second column and second row position of the tenth section.

21. The image device according to claim 18, wherein the image device comprises a plurality of eleventh sections, each eleventh section comprises the first pixel group, the second pixel group, the third pixel group and the fourth pixel group, the third pixel group is disposed on a first column and first row position of the eleventh section, the second pixel group is disposed on a second column and first row position of the eleventh section, the first pixel group is disposed on a first column and second row position of the eleventh section, the fourth pixel group is disposed on a second column and second row position of the eleventh section.

22. The image device according to claim 18, wherein the image device comprises a plurality of twelfth sections, each twelfth section comprises the first pixel group, the second pixel group, the third pixel group and the fourth pixel group, the third pixel group is disposed on a first column and first row position of the twelfth section, the fourth pixel group is disposed on a second column and first row position of the twelfth section, the first pixel group is disposed on a first column and second row position of the twelfth section, the second pixel group is disposed on a second column and second row position of the twelfth section.

23. The image device according to claim 2, wherein the first pixel group comprises two first color dots and one fourth color dot, the fourth color dot is disposed between the two first color dots; the second pixel group comprises two third color dot and one second color dot, the second color dot is disposed between the two third color dots; the third pixel group comprises two fourth color dots and one second color dot, the second color dot is disposed between the two fourth color dots; and the fourth pixel group comprises two fifth color dots and one fourth color dot, the fourth color dot is disposed between the two fifth color dots and the fifth color dot is a yellow color dot.

24. The image device according to claim 23, wherein the image device comprises a plurality of thirteenth sections, each thirteenth section comprises the first pixel group, the second pixel group, the third pixel group and the fourth pixel group, the first pixel group is disposed on a first column and first row position of the thirteenth section, the second pixel group is disposed on a second column and first row position of the thirteenth section, the third pixel group is disposed on a first column and second row position of the thirteenth section, the fourth pixel group is disposed on a second column and second row position of the thirteenth section.

25. The image device according to claim 24, wherein an area of the fourth color dot is smaller than that of the first color dot in the first pixel group, an area of the second color dot is smaller than that of the third color dots in the second pixel group, and an area of the second color dot is smaller than that of the fourth color dots in the third pixel group; an area of the fourth color dot is smaller than that of the fifth color dot in the fourth pixel group.

26. The image device according to claim 23, wherein the image device comprises a plurality of fourteenth sections, each fourteenth section comprises the first pixel group, the second pixel group, the third pixel group and the fourth pixel group, the third pixel group is disposed on a first column and first row position of the fourteenth section, the fourth pixel group is disposed on a second column and first row position of the fourteenth section, the first pixel group is disposed on a first column and second row position of the fourteenth section, the second pixel group is disposed on a second column and second row position of the fourteenth section.

27. The image device according to claim 26, wherein an area of the fourth color dot is smaller than that of the first color dot in the first pixel group, an area of the second color dot is smaller than that of the third color dots in the second pixel group, and an area of the second color dot is smaller than that of the fourth color dots in the third pixel group; an area of the fourth color dot is smaller than that of the fifth color dot in the fourth pixel group.

28. The image device according to claim 23, wherein the image device comprises a plurality of fifteenth sections, each fifteenth section comprises the first pixel group, the second pixel group, the third pixel group and the fourth pixel group, the third pixel group is disposed on a first column and first row position of the fifteenth section, the second pixel group is disposed on a second column and first row position of the fifteenth section, the first pixel group is disposed on a first column and second row position of the fifteenth section, the fourth pixel group is disposed on a second column and second row position of the fifteenth section.

29. The image device according to claim 28, wherein an area of the fourth color dot is smaller than that of the first color dot in the first pixel group, an area of the second color dot is smaller than that of the third color dots in the second pixel group, and an area of the second color dot is smaller than that of the fourth color dots in the third pixel group; an area of the fourth color dot is smaller than that of the fifth color dot in the fourth pixel group.

30. The image device according to claim 23, wherein the image device comprises a plurality of sixteenth sections, each sixteenth section comprises the first pixel group, the second pixel group, the third pixel group and the fourth pixel group, the first pixel group is disposed on a first column and first row position of the sixteenth section, the fourth pixel group is disposed on a second column and first row position of the sixteenth section, the third pixel group is disposed on a first column and second row position of the sixteenth section, the second pixel group is disposed on a second column and second row position of the sixteenth section.

31. The image device according to claim 30, wherein an area of the fourth color dot is smaller than that of the first color dot in the first pixel group, an area of the second color dot is smaller than that of the third color dots in the second pixel group, and an area of the second color dot is smaller than that of the fourth color dots in the third pixel group; an area of the fourth color dot is smaller than that of the fifth color dot in the fourth pixel group.

32. The image device according to claim 2, wherein the first pixel group comprises one first color dot and one second color dot, an area of the first color dot is bigger than that of the second color dot; the second pixel group comprises one third color dot and one second color dot, an area of the third color dot is bigger than that of the second color dot; the third pixel group comprises one fourth color dot and one second color dot, an area of the fourth color dot is bigger than that of the second color dot; and the fourth pixel group comprises two second color dots, an area of one of two second color dots is bigger than that of the other second color dot.

33. The image device according to claim 32, wherein the image device comprises a plurality of seventeenth sections, each seventeenth section comprises the first pixel group, the second pixel group, the third pixel group and the fourth pixel group, the first pixel group is disposed on a first column and first row position of the seventeenth section, the second pixel group is disposed on a second column and first row position of the seventeenth section, the third pixel group is disposed on a first column and second row position of the seventeenth section, the fourth pixel group is disposed on a second column and second row position of the seventeenth section.

34. The image device according to claim 32, wherein the image device comprises a plurality of eighteenth sections, each eighteenth section comprises the first pixel group, the second pixel group, the third pixel group and the fourth pixel group, the first pixel group is disposed on a first column and first row position of the eighteenth section, the fourth pixel group is disposed on a second column and first row position of the eighteenth section, the third pixel group is disposed on a first column and second row position of the eighteenth section, the second pixel group is disposed on a second column and second row position of the eighteenth section.

35. The image device according to claim 32, wherein the image device comprises a plurality of nineteenth sections, each nineteenth section comprises the first pixel group, the second pixel group, the third pixel group and the fourth pixel group, the third pixel group is disposed on a first column and first row position of the nineteenth section, the second pixel group is disposed on a second column and first row position of the nineteenth section, the first pixel group is disposed on a first column and second row position of the nineteenth section, the fourth pixel group is disposed on a second column and second row position of the nineteenth section.

36. The image device according to claim 32, wherein the image device comprises a plurality of twentieth sections, each twentieth section comprises the first pixel group, the second pixel group, the third pixel group and the fourth pixel group, the third pixel group is disposed on a first column and first row position of the twentieth section, the fourth pixel group is disposed on a second column and first row position of the twentieth section, the first pixel group is disposed on a first column and second row position of the twentieth section, the second pixel group is disposed on a second column and second row position of the twentieth section.

37. The image device according to claim 3, wherein the fourth pixel group comprises two fifth color dots and one second color dot, the second color dot is disposed between the two fifth color dots in the fourth pixel group and the fifth color dot is a yellow color dot.

38. The image device according to claim 37, wherein the image device comprises a plurality of twenty-first sections, each twenty-first section comprises the first pixel group, the second pixel group, the third pixel group and the fourth pixel group, the first pixel group is disposed on a first column and first row position of the twenty-first section, the second pixel group is disposed on a second column and first row position of the twenty-first section, the third pixel group is disposed on a first column and second row position of the twenty-first section, the fourth pixel group is disposed on a second column and second row position of the twenty-first section.

39. The image device according to claim 38, wherein an area of the second color dot is smaller than that of the first color dot in the first pixel group, an area of the second color dot is smaller than that of the third color dots in the second pixel group, and an area of the second color dot is smaller than that of the fourth color dots in the third pixel group; an area of the second color dot is smaller than that of the fifth color dot in the fourth pixel group.

40. The image device according to claim 37, wherein the image device comprises a plurality of twenty-second sections, each twenty-second section comprises the first pixel group, the second pixel group, the third pixel group and the fourth pixel group, the third pixel group is disposed on a first column and first row position of the twenty-second section, the fourth pixel group is disposed on a second column and first row position of the twenty-second section, the first pixel group is disposed on a first column and second row position of the twenty-second section, the second pixel group is disposed on a second column and second row position of the twenty-second section.

41. The image device according to claim 40, wherein an area of the second color dot is smaller than that of the first color dot in the first pixel group, an area of the second color dot is smaller than that of the third color dots in the second pixel group, and an area of the second color dot is smaller than that of the fourth color dots in the third pixel group; an area of the second color dot is smaller than that of the fifth color dot in the fourth pixel group.

42. The image device according to claim 37, wherein the image device comprises a plurality of twenty-third sections, each twenty-third section comprises the first pixel group, the second pixel group, the third pixel group and the fourth pixel group, the third pixel group is disposed on a first column and first row position of the twenty-third section, the second pixel group is disposed on a second column and first row position of the twenty-third section, the first pixel group is disposed on a first column and second row position of the twenty-third section, the fourth pixel group is disposed on a second column and second row position of the twenty-third section.

43. The image device according to claim 42, wherein an area of the second color dot is smaller than that of the first color dot in the first pixel group, an area of the second color dot is smaller than that of the third color dots in the second pixel group, and an area of the second color dot is smaller than that of the fourth color dots in the third pixel group; an area of the second color dot is smaller than that of the fifth color dot in the fourth pixel group.

44. The image device according to claim 37, wherein the image device comprises a plurality of twenty-fourth sections, each twenty-fourth section comprises the first pixel group, the second pixel group, the third pixel group and the fourth pixel group, the first pixel group is disposed on a first column and first row position of the twenty-fourth section, the fourth pixel group is disposed on a second column and first row position of the twenty-fourth section, the third pixel group is disposed on a first column and second row position of the twenty-fourth section, the second pixel group is disposed on a second column and second row position of the twenty-fourth section.

45. The image device according to claim 44, wherein an area of the second color dot is smaller than that of the first color dot in the first pixel group, an area of the second color dot is smaller than that of the third color dots in the second pixel group, and an area of the second color dot is smaller than that of the fourth color dots in the third pixel group; an area of the second color dot is smaller than that of the fifth color dot in the fourth pixel group.

46. The image device according to claim 2, wherein the first pixel group comprises one first color dot and one second color dot, an area of the first color dot is bigger than that of the second color dot; the second pixel group comprises one third color dot and one second color dot, an area of the third color dot is bigger than that of the second color dot; the third pixel group comprises one fourth color dot and one second color dot, an area of the fourth color dot is bigger than that of the second color dot; and the fourth pixel group comprises one fifth color dot and one second color dot, an area of the fifth color dots is bigger than that of the second color dot, the fifth color dot is a yellow color dot.

47. The image device according to claim 46, wherein the image device comprises a plurality of twenty-fifth sections, each twenty-fifth section comprises the first pixel group, the second pixel group, the third pixel group and the fourth pixel group, the first pixel group is disposed on a first column and first row position of the twenty-fifth section, the second pixel group is disposed on a second column and first row position of the twenty-fifth section, the third pixel group is disposed on a first column and second row position of the twenty-fifth section, the fourth pixel group is disposed on a second column and second row position of the twenty-fifth section.

48. The image device according to claim 46, wherein the image device comprises a plurality of twenty-sixth sections, each twenty-sixth section comprises the first pixel group, the second pixel group, the third pixel group and the fourth pixel group, the third pixel group is disposed on a first column and first row position of the twenty-sixth section, the fourth pixel group is disposed on a second column and first row position of the twenty-sixth section, the first pixel group is disposed on a first column and second row position of the twenty-sixth section, the second pixel group is disposed on a second column and second row position of the twenty-sixth section.

49. The image device according to claim 46, wherein the image device comprises a plurality of twenty-seventh sections, each twenty-seventh section comprises the first pixel group, the second pixel group, the third pixel group and the fourth pixel group, the third pixel group is disposed on a first column and first row position of the twenty-seventh section, the second pixel group is disposed on a second column and first row position of the twenty-seventh section, the first pixel group is disposed on a first column and second row position of the twenty-seventh section, the fourth pixel group is disposed on a second column and second row position of the twenty-seventh section.

50. The image device according to claim 46, wherein the image device comprises a plurality of twenty-eighth sections, each twenty-eighth section comprises the first pixel group, the second pixel group, the third pixel group and the fourth pixel group, the first pixel group is disposed on a first column and first row position of the twenty-eighth section, the fourth pixel group is disposed on a second column and first row position of the twenty-eighth section, the third pixel group is disposed on a first column and second row position of the twenty-eighth section, the second pixel group is disposed on a second column and second row position of the twenty-eighth section.

51. The image device according to claim 37, wherein the image device comprises a plurality of twenty-ninth sections, each twenty-ninth section comprises the first pixel group, the second pixel group, the third pixel group and the fourth pixel group, the first pixel group is disposed on a first column and first row position of the twenty-ninth section, the second pixel group is disposed on a second column and first row position of the twenty-ninth section, the fourth pixel group is disposed on a first column and second row position of the twenty-ninth section, the third pixel group is disposed on a second column and second row position of the twenty-ninth section.

52. The image device according to claim 51, wherein an area of the second color dot is smaller than that of the first color dot in the first pixel group, an area of the second color dot is smaller than that of the third color dots in the second pixel group, and an area of the second color dot is smaller than that of the fourth color dots in the third pixel group; an area of the second color dot is smaller than that of the fifth color dot in the fourth pixel group.

53. The image device according to claim 37, wherein the image device comprises a plurality of thirtieth sections, each thirtieth section comprises the first pixel group, the second pixel group, the third pixel group and the fourth pixel group, the fourth pixel group is disposed on a first column and first row position of the thirtieth section, the third pixel group is disposed on a second column and first row position of the thirtieth section, the first pixel group is disposed on a first column and second row position of the thirtieth section, the second pixel group is disposed on a second column and second row position of the thirtieth section.

54. The image device according to claim 53, wherein an area of the second color dot is smaller than that of the first color dot in the first pixel group, an area of the second color dot is smaller than that of the third color dots in the second pixel group, and an area of the second color dot is smaller than that of the fourth color dots in the third pixel group; an area of the second color dot is smaller than that of the fifth color dot in the fourth pixel group.

55. The image device according to claim 37, wherein the image device comprises a plurality of thirty-first sections, each thirty-first section comprises the first pixel group, the second pixel group, the third pixel group and the fourth pixel group, the fourth pixel group is disposed on a first column and first row position of the thirty-first section, the second pixel group is disposed on a second column and first row position of the thirty-first section, the first pixel group is disposed on a first column and second row position of the thirty-first section, the third pixel group is disposed on a second column and second row position of the thirty-first section.

56. The image device according to claim 55, wherein an area of the second color dot is smaller than that of the first color dot in the first pixel group, an area of the second color dot is smaller than that of the third color dots in the second pixel group, and an area of the second color dot is smaller than that of the fourth color dots in the third pixel group; an area of the second color dot is smaller than that of the fifth color dot in the fourth pixel group.

57. The image device according to claim 37, wherein the image device comprises a plurality of thirty-second sections, each thirty-second section comprises the first pixel group, the second pixel group, the third pixel group and the fourth pixel group, the first pixel group is disposed on a first column and first row position of the thirty-second section, the third pixel group is disposed on a second column and first row position of the thirty-second section, the fourth pixel group is disposed on a first column and second row position of the thirty-second section, the second pixel group is disposed on a second column and second row position of the thirty-second section.

58. The image device according to claim 57, wherein an area of the second color dot is smaller than that of the first color dot in the first pixel group, an area of the second color dot is smaller than that of the third color dots in the second pixel group, and an area of the second color dot is smaller than that of the fourth color dots in the third pixel group; an area of the second color dot is smaller than that of the fifth color dot in the fourth pixel group.

59. The image device according to claim 46, wherein the image device comprises a plurality of thirty-third sections, each thirty-third section comprises the first pixel group, the second pixel group, the third pixel group and the fourth pixel group, the first pixel group is disposed on a first column and first row position of the thirty-third section, the second pixel group is disposed on a second column and first row position of the thirty-third section, the fourth pixel group is disposed on a first column and second row position of the thirty-third section, the third pixel group is disposed on a second column and second row position of the thirty-third section.

60. The image device according to claim 46, wherein the image device comprises a plurality of thirty-fourth sections, each thirty-fourth section comprises the first pixel group, the second pixel group, the third pixel group and the fourth pixel group, the fourth pixel group is disposed on a first column and first row position of the thirty-fourth section, the third pixel group is disposed on a second column and first row position of the thirty-fourth section, the first pixel group is disposed on a first column and second row position of the thirty-fourth section, the second pixel group is disposed on a second column and second row position of the thirty-fourth section.

61. The image device according to claim 46, wherein the image device comprises a plurality of thirty-fifth sections, each thirty-fifth section comprises the first pixel group, the second pixel group, the third pixel group and the fourth pixel group, the fourth pixel group is disposed on a first column and first row position of the thirty-fifth section, the second pixel group is disposed on a second column and first row position of the thirty-fifth section, the first pixel group is disposed on a first column and second row position of the thirty-fifth section, the third pixel group is disposed on a second column and second row position of the thirty-fifth section.

62. The image device according to claim 46, wherein the image device comprises a plurality of thirty-sixth sections, each thirty-sixth section comprises the first pixel group, the second pixel group, the third pixel group and the fourth pixel group, the first pixel group is disposed on a first column and first row position of the thirty-sixth section, the third pixel group is disposed on a second column and first row position of the thirty-sixth section, the fourth pixel group is disposed on a first column and second row position of the thirty-sixth section, the second pixel group is disposed on a second column and second row position of the thirty-sixth section.

63. An image device, comprising:

a plurality of sections, each of the sections comprising:

a plurality of pixel groups arranged in a first predetermined identical matrix form, each of the pixel groups comprising a plurality of dots arranged in a second predetermined identical matrix form, each of the sections having a first pixel group, a second pixel group, a third pixel group and a fourth pixel group, wherein the first pixel group comprises at least one first color dot and a second color dot or a fourth color dot, the second pixel group comprises at least one third color dot and the second color dot, the third pixel group comprises at least one fourth color dot and the second color dot, and the fourth pixel group comprises at least one fifth color dot or at least one second color dot; and any four of the first pixel group, the second pixel group, the third pixel group and the fourth pixel group are arranged adjacent to each other in a 2×2 matrix in order to reach a white balance, wherein the first color dot is a green color dot, the second color dot is a white color dot, the third color dot is a red color dot and the fourth color dot is a blue color dot, wherein the first pixel group comprises two first color dots and one fourth color dot, the fourth color dot is disposed between the two first color dots; the second pixel group comprises two third color dot and one second color dot, the second color dot is disposed between the two third color dots; the third pixel group comprises two fourth color dots and one second color dot, the second color dot is disposed between the two fourth color dots; and the fourth pixel group comprises two fifth color dots and one fourth color dot, the fourth color dot is disposed between the two fifth color dots and the fifth color dot is a yellow color dot.

64. An image device, comprising:

a plurality of sections, each of the sections comprising:

a plurality of pixel groups arranged in a first predetermined identical matrix form, each of the pixel groups comprising a plurality of dots arranged in a second predetermined identical matrix form, each of the sections having a first pixel group, a second pixel group, a third pixel group and a fourth pixel group, wherein the first pixel group comprises at least one first color dot and a second color dot or a fourth color dot, the second pixel group comprises at least one third color dot and the second color dot, the third pixel group comprises at least one fourth color dot and the second color dot, and the fourth pixel group comprises at least one fifth color dot or at least one second color dot; and any four of the first pixel group, the second pixel group, the third pixel group and the fourth pixel group are arranged adjacent to each other in a 2×2 matrix in order to reach a white balance, wherein the first color dot is a green color dot, the second color dot is a white color dot, the third color dot is a red color dot and the fourth color dot is a blue color dot, wherein the first pixel group comprises two first color dots and one second color dot, the second color dot is disposed between the two first color dots; the second pixel group comprises two third color dot and one second color dot, the second color dot is disposed between the two third color dots; the third pixel group comprises two fourth color dots and one second color dot, the second color dot is disposed between the two fourth color dots, wherein the fourth pixel group comprises two fifth color dots and one second color dot, the second color dot is disposed between the two fifth color dots in the fourth pixel group and the fifth color dot is a yellow color dot.

* * * * *